US006382858B1

(12) United States Patent
Nojima et al.

(10) Patent No.: US 6,382,858 B1
(45) Date of Patent: May 7, 2002

(54) SHEET MATERIAL CONVEYING APPARATUS AND RECORDING APPARATUS

(75) Inventors: Takashi Nojima, Tokyo; Koh Hasegawa, Yokohama; Shinya Asano, Tokyo; Hiroyuki Inoue, Yokohama; Akira Kida, Kawasaki; Takeshi Iwasaki, Yokohama; Noriko Kawasaki, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/188,687

(22) Filed: Nov. 10, 1998

(30) Foreign Application Priority Data

Nov. 14, 1997 (JP) ..... 9-330875
Apr. 15, 1998 (JP) ..... 10-122815

(51) Int. Cl.[7] ..... B65H 3/06

(52) U.S. Cl. ..... 400/691; 400/693; 400/642; 400/647; 347/108

(58) Field of Search ..... 400/691, 692, 400/693, 88, 624, 642, 647, 625, 690.4

(56) References Cited

U.S. PATENT DOCUMENTS 4,303,013 A * 12/1981 Shimodaira ..... 101/99
4,423,972 A * 1/1984 Inoue et al. ..... 400/155
4,551,033 A * 11/1985 Koike et al. ..... 400/308
4,623,965 A * 11/1986 Wing ..... 364/408
5,061,097 A 10/1991 Piatt ..... 400/619
5,332,323 A * 7/1994 Murai et al. ..... 400/605
5,348,407 A * 9/1994 Hock et al. ..... 400/711
5,364,196 A 11/1994 Baitz et al. ..... 400/691
5,423,529 A * 6/1995 Saito et al. ..... 400/629
5,538,237 A * 7/1996 Miyauchi ..... 271/117
5,567,068 A * 10/1996 Egashira et al. ..... 400/625
5,672,019 A * 9/1997 Hiramatsu et al. ..... 400/624
5,738,456 A * 4/1998 Tanahashi et al. ..... 400/642
6,200,043 B1 * 3/2001 Inoue et al. ..... 400/88

FOREIGN PATENT DOCUMENTS

EP 0 314 140 5/1989

* cited by examiner

*Primary Examiner*—John S. Hilten
*Assistant Examiner*—Kevin D. Williams
(74) *Attorney, Agent, or Firm*—Fitzpatrick, Cella, Harper & Scinto

(57) ABSTRACT

A recording apparatus for recording an image on a sheet material, includes an outer case having a box-shape, a convey path for conveying a sheet material within the outer case, a recording device disposed within the outer case and adapted to effect recording on the sheet material conveyed by the convey path. Opening portions formed in the outer case provide an inlet and an outlet of the convey path. A lid member closes at least one of the opening portions defining the inlet and the outlet, and wherein flexion of the outer case is reduced by closing the opening portion or portions by means of the lid member.

8 Claims, 41 Drawing Sheets

FIG. 33B
FIG. 33A
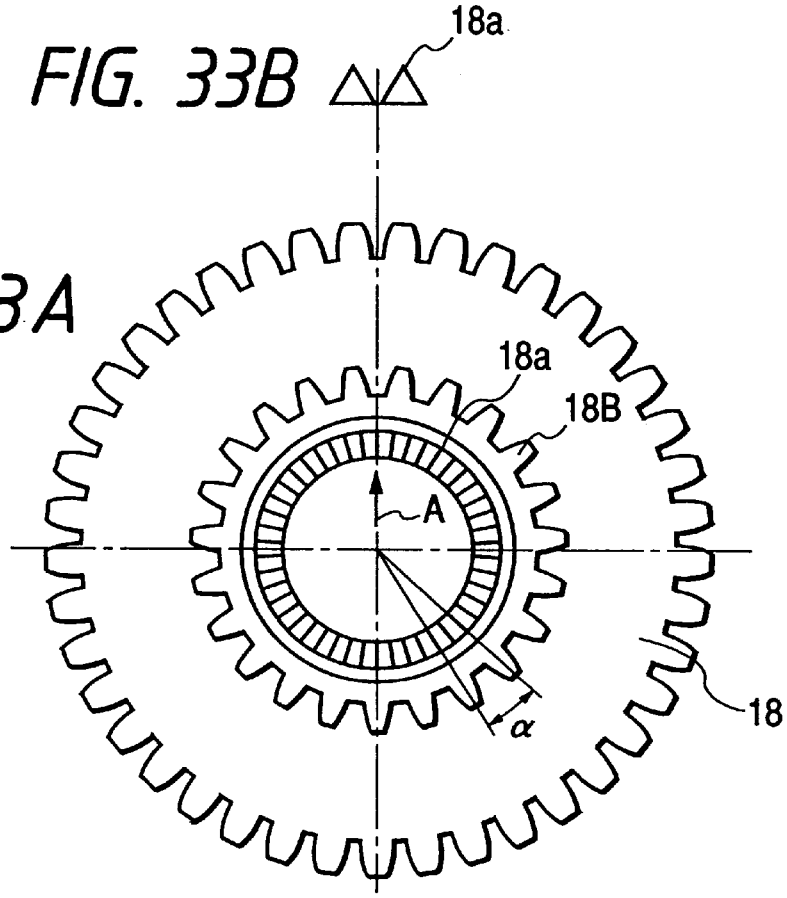
FIG. 34B
FIG. 34A
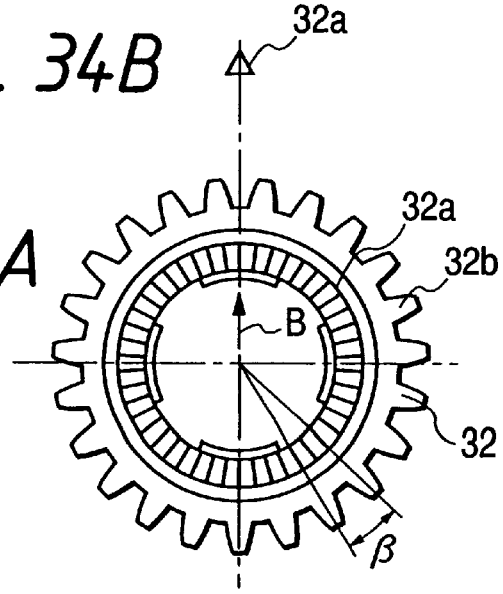

SHEET MATERIAL CONVEYING APPARATUS AND RECORDING APPARATUS

BACKGROUND OF THE INVENTION

1. Field of the Invention

The present invention relates to a sheet material conveying apparatus and a recording apparatus, and more particularly, it relates to a technique in which rigidity of frames of such apparatuses is enhanced.

2. Related Background Art

In recording apparatuses having a printer function, a copying function and a facsimile function or recording apparatuses used as an output equipment for a composite electronic equipment including a computer or a word processor and for a work station, a sheet material (recording medium) such as a paper sheet or a plastic thin plate is conveyed by a sheet material conveying apparatus in response to image information, and an image is recorded on the sheet material by a recording means.

The recording apparatuses can be grouped into an ink jet type, a wire dot type, a thermal type and a laser beam type, in dependence upon a recording system of the recording means.

Generally, in recording apparatuses of serial type in which a serial scan system effecting main scan in a direction substantially perpendicular to a conveying direction (sub-scan direction) of the sheet material is used, after the sheet material is set at a predetermined recording position, an image having a predetermined width in the main scan direction is recorded on the sheet material by shifting a carriage on which a recording head (recording means) is mounted over the sheet material.

After one-line recording is finished, a predetermined amount of sheet feed (pitch conveyance) is effected, and thereafter, a next line image is recorded again on the sheet material which is now stopped, in the main scan direction.

In recent years, portable computers such as a notebook-type have widely been used. To this end, compact recording apparatuses attaching importance to portable ability have been proposed.

FIG. 58 is a sectional explanatory view showing such a compact recording apparatus of portable serial type.

There is provided a recording head 1011 for effecting recording on a recording medium, and the recording medium (sheet material) P is conveyed by a sheet feed roller 1013 along a sheet material convey path H defined by a sheet supply tray 1016, a lower guide 1014 and an upper guide 1015 to be sent to a recording portion M.

The sheet material on which the recording was effected at the recording portion M is discharged out of the apparatus by a sheet discharge roller 1012.

Normally, when a minimum width of a recording apparatus tries to be designed, a width of a carriage and a width for accelerating carriage scan are added to a width of the sheet material. Thus, the convey path H has a width of 60 to 90% of the width of the recording apparatus.

However, in such a conventional recording apparatus, since the convey path H having the width of 60 to 90% of the width of the recording apparatus forms a tunnel-shaped space in a sheet conveying direction of the apparatus, the apparatus is apt to become weak to an urging force acting from a direction substantially perpendicular to the convey path H.

Accordingly, in consideration of shock during transportation and/or the fact that other devices or books are rested on the compact apparatus, it is desirable that the apparatus has greater rigidity.

Further, such a compact apparatus is designed also in consideration of the portability, and thus, one of important design factors is to reduce a weight of the apparatus as much as possible. Accordingly, if the rigidity of a frame surrounding the convey path H is merely increased, the weight of the apparatus is increased, or if light weight material having great strength is used, the apparatus becomes more expensive. Thus, these problems must be solved with good balance.

That is to say, when a recording apparatus is of stationary type, for example, the rigidity can be enhanced by a method including "increasing a thickness of an outer frame" or "providing a double-wall outer frame"; however, in case of the portable recording apparatus, both light weight and compactness are required, such a method cannot be used.

The present invention aims to solve the abovementioned conventional problems, and an object of the present invention is to provide an apparatus in which a weight and cost are reduced as less as possible and which is strong to load and shock by increasing rigidity of a frame forming the apparatus and in which increase in weight is suppressed to improve portable ability.

SUMMARY OF THE INVENTION

To achieve the above object, according to the present invention, there is provided a recording apparatus for recording an image on a sheet material, comprising an outer case formed as a box shape, a convey path for conveying the sheet material within the case, a recording means disposed within the case for recording on the sheet material conveyed by the convey path, opening portions provided in the case and defining a sheet inlet and a sheet outlet of the convey path, and a lid member for closing at least one of the opening portions defining the inlet and outlet, and wherein flexion of the outer case is reduced by closing the opening portion by means of the lid member.

Further, the present invention provides a recording apparatus for recording an image on a sheet material, comprising a convey path for conveying the sheet material, first and second cases opposed to each other with the interposition of the convey path and defining a box-shaped outer case, a recording means disposed within the case and adapted to effect recording on the sheet material conveyed by the convey path, opening portions disposed between the first and second cases and defining a sheet inlet and a sheet outlet of the convey path, and a lid member provided for closing at least one of the opening portions defining the inlet and outlet and selectively shiftable between a first position where the lid member is engaged by an engagement portions provided on the first and second cases to maintain a positional relation between the cases and a second position where the lid member is not engaged by the engagement portion of at least one of the cases.

BRIEF DESCRIPTION OF THE DRAWINGS

FIG. 33A is a side view of an LF gear, showing engagement between the gear and a trigger gear, and FIG. 33B is a view of a triangular teeth, looked at from a direction shown by the arrow A;

FIG. 34A is a side view of the trigger gear, showing engagement between the gear and the LF gear, and FIG. 34B is a view of a triangular teeth, looked at from a direction shown by the arrow B;

DESCRIPTION OF THE PREFERRED EMBODIMENTS

A recording apparatus 401 according to an embodiment of the present invention will now be explained with reference to the accompanying drawings. Regarding a sheet conveying system and an image recording system of the recording apparatus 401, the arrangements as conventional ones can be adopted.

Figure 1:
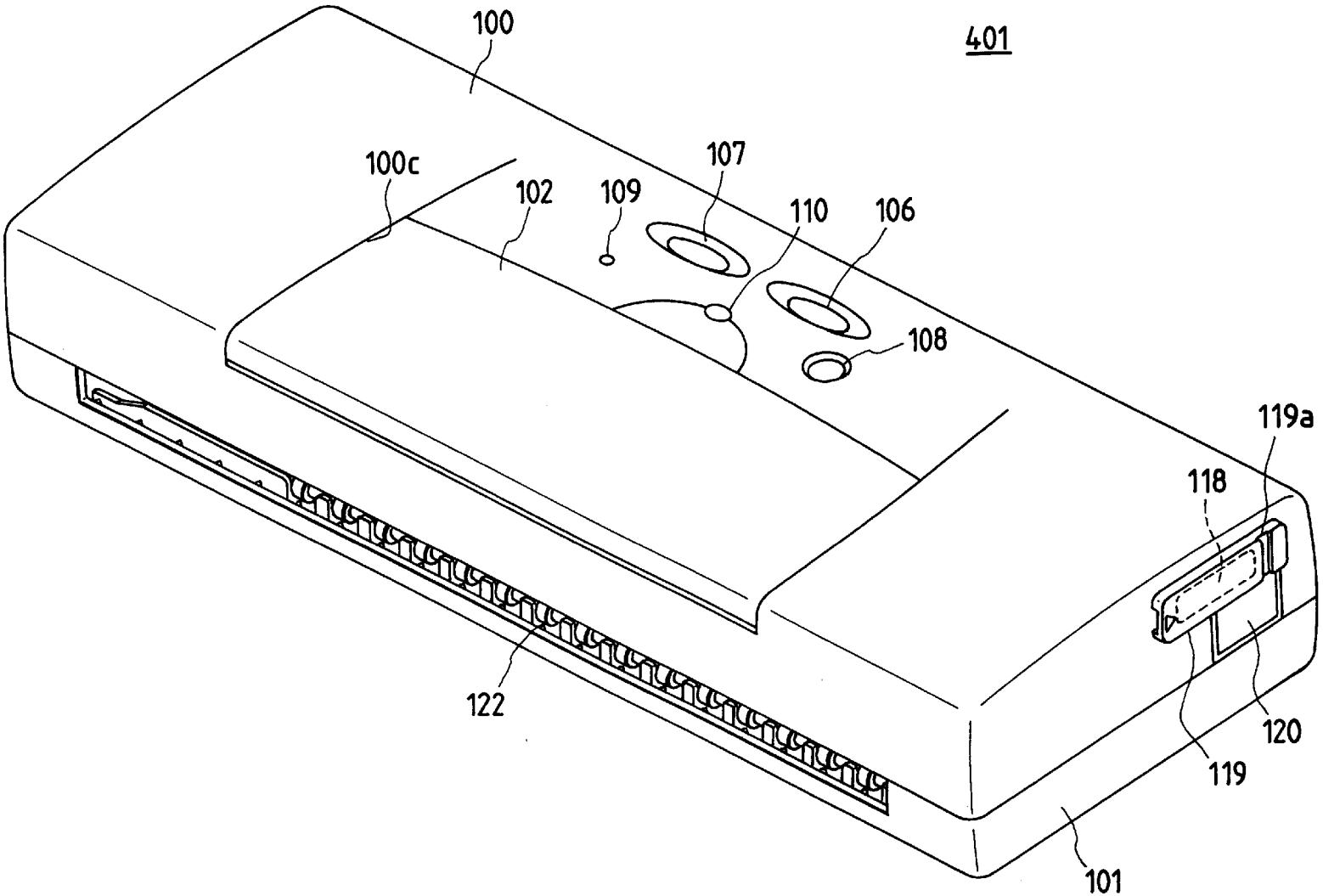
FIG. 1 is a perspective view of an ink jet recording apparatus according to an embodiment of the present invention.
Figure 4:
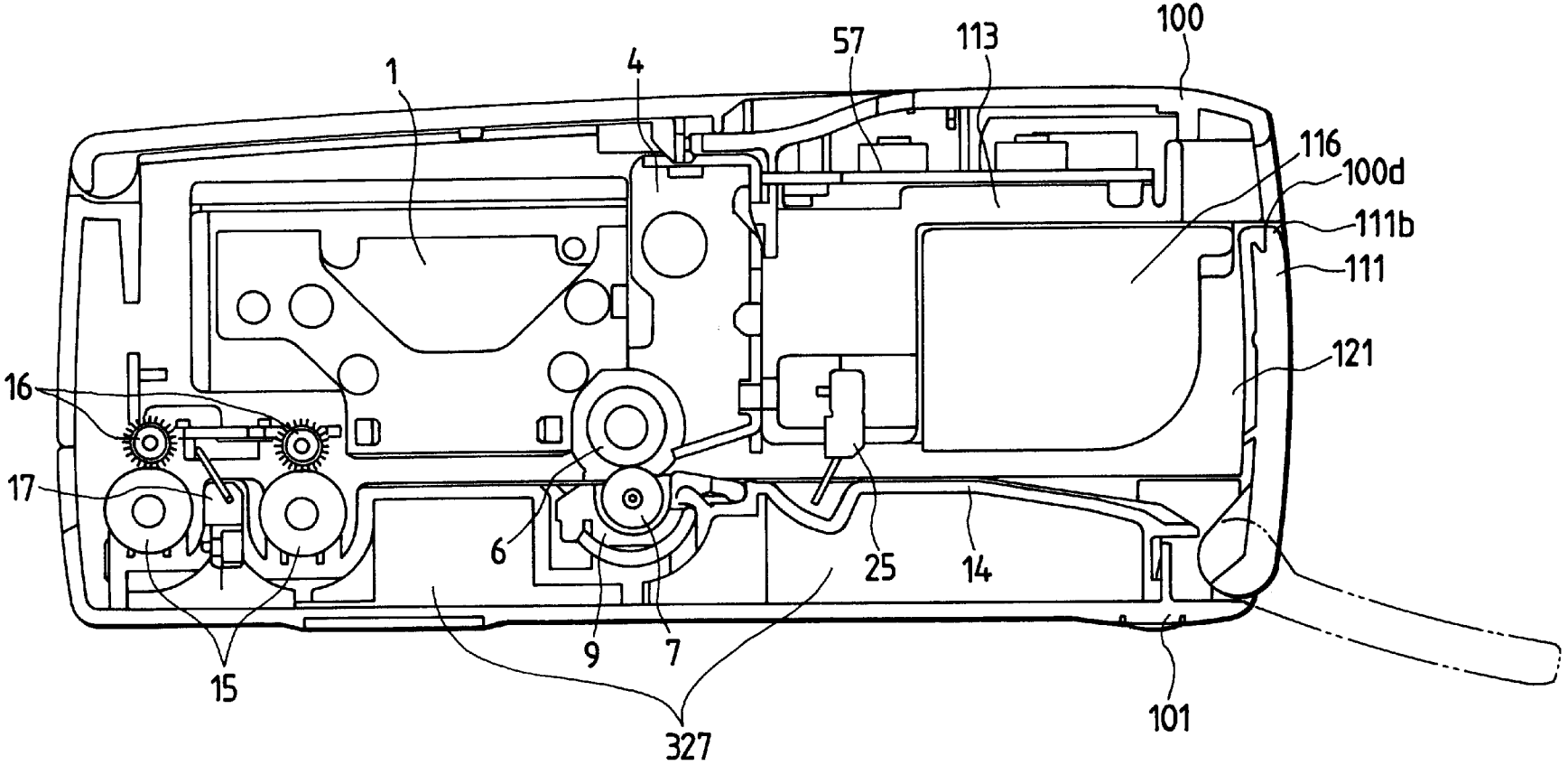
FIG. 4 is a sectional side view of the recording apparatus.
Figure 9:
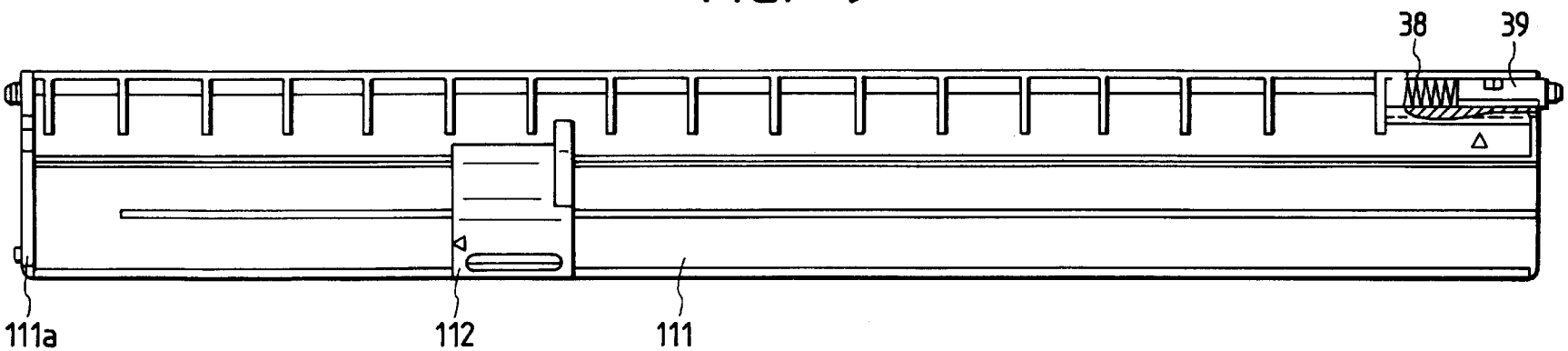
FIG. 9 is a detailed view of a sheet supply tray of a recording apparatus according to an embodiment of the present invention.
Figure 10:
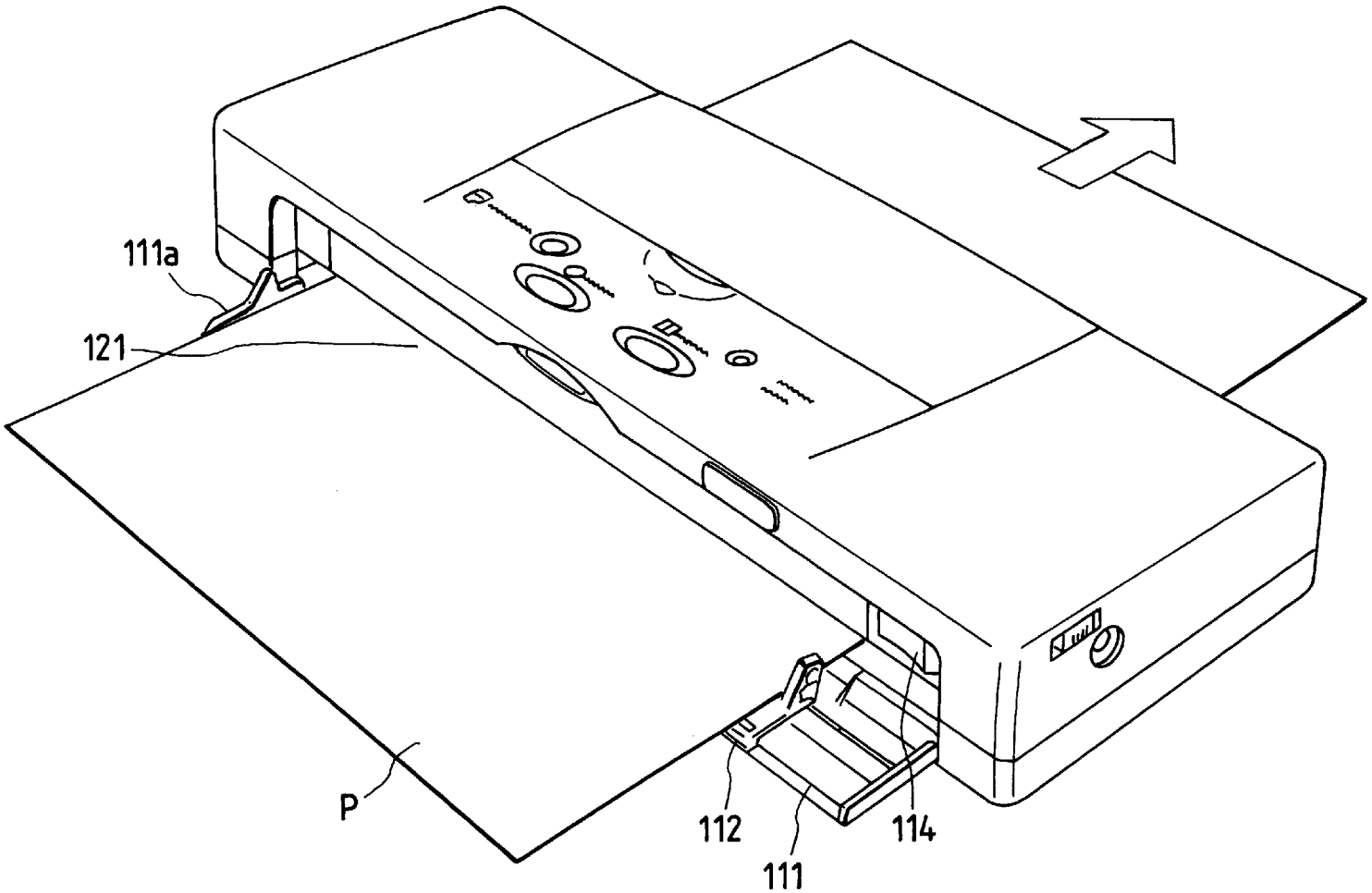
FIG. 10 is an entire perspective view showing a usable condition of the recording apparatus.

FIG. 1 is a perspective view of the recording apparatus 401, and FIG. 4 is a sectional view of the recording apparatus. FIG. 10 is a perspective view of the recording apparatus 401 in a condition that a sheet supply tray 111 is opened, and FIG. 9 is a view showing the sheet supply tray 111 in detail. Now, the construction of the recording apparatus 401 will be described with reference to these Figures.

In FIG. 1, there is provided an error release switch 107 for releasing an error condition of the apparatus so that, after a trouble condition of the recording apparatus is removed, the error is released by depressing the error release switch. An error lamp 109 for indicating the error condition of the apparatus is turned ON if any of various trouble conditions of the recording apparatus occurs.

The reference numeral 110 denotes a power lamp for indicating an ON condition of a power source; 102 denotes a head exchange lid which can be opened when a recording head cartridge arranged within the apparatus is exchanged; 108 denotes a head exchange switch to be depressed when the recording head cartridge is cleaned; 111 denotes the sheet supply tray as a lid member; and 106 denotes a power source switch for switching the power source.

These operation parts are positioned on an upper surface at a center of the recording apparatus so that an operator (user) can manipulate these parts from either a left side or a right side.

A frame (outer wall) of the recording apparatus 401 is constituted by two frame portions (upper case 100 and lower case 101) which will be described later.

In FIG. 4, a substrate plate 57 is disposed immediately below the upper case (first frame portion) 100, and the error release switch (input switch of the operation portion), power source switch 106 and lamps 109, 110 are provided on the substrate plate 57. Further, input/output devices of the operation portions, a logic portion for controlling the entire recording apparatus and a power source portion for supplying power to a recording head and the logic portion are provided on the substrate plate 57.

Further, a battery 116 for supplying an electric power to the substrate plate 57 is detachably mounted to a lower part of the substrate plate 57.

In FIG. 4, a recording head cartridge (recording means) 1 is mounted on a carrier 2 shiftable along a guide shaft 5 and a guide rail 12 in a main scan direction. The carrier 2 can be shifted reciprocally by a carrier motor 10 via a drive pulley 13 and a belt 11. A shifting direction of the carrier 2 is determined by changing the rotational direction of the carrier motor 10.

When the recording head cartridge 1 is of ink jet recording type, it is preferable that a sheet is conveyed substantially horizontally and ink is discharged downwardly so that the ink flow is prevented and a discharging speed of the ink does not interfere with a gravity force.

The sheet P inserted through a sheet supply opening 121 is passed through a sheet supply path. The sheet P is sent to a printing portion M by a sheet feeding roller 6 and a pinch roller 7. A sheet discharge roller 15 and a spur roller 16 are provided at a downstream side, and the sheet P is conveyed by using these elements.

It is so designed that the sheet P is pushed up and urged against the sheet feeding roller 6 and the spur roller 16 by the pinch roller 6 and the sheet discharge roller 15, respectively, so that a distance between the printed surface of the sheet P and the recording head cartridge 1 is maintained at a constant value regardless of a thickness of the sheet P.

The sheet P on which the recording was effected is pinched between two pairs of sheet discharge rollers 15 and spur rollers 16 and is discharged out of the recording apparatus. The direction of the sheet P is determined by two sets of sheet discharge rollers 15 so that, after a trail end of the sheet P leaves the sheet feeding roller 6, the distance between the sheet P and the recording head cartridge 1 is maintained at the constant value.

The sheet supply tray (lid member) 111 is rotatably connected to the lower case (second frame portion) 101 of the recording apparatus 401. In the lower case 101, a bearing portion provides an engagement portion for the sheet supply tray 111. When the sheets P are inserted into the recording apparatus 401, the sheet supply tray 11 is opened (second position) as shown in FIG. 10.

The sheet supply tray 111 has a left guide 111*a* formed integrally therewith, so that the sheets P are inserted into the sheet supply path of the recording apparatus 401 while guiding left edges of the sheets along the left guide. A right guide 112 can be shifted on the sheet supply tray 111 while sliding on the tray with predetermined friction therebetween, so that the right tray is appropriately shifted by the operator in accordance with the width of the sheet P.

An urging mechanism as shown in FIG. 9 is provided on a shaft portion opposed to the left guide 111*a* of the sheet supply tray 111. A shaft 39 urged by a spring 38 is disposed in a hole of the sheet supply tray 111, thereby generating an urging force directing toward the left guide 111*a*.

Normally, a width of a fit portion (for the sheet supply tray) of the lower case 101 (width of the sheet supply opening 121 in the vicinity of the opening portion of the sheet supply path) is designed to become slightly greater than a width of the sheet supply tray 111 in consideration of dispersion in dimensions of parts.

However, by the urging action of the spring 38, the entire sheet supply tray 111 is always urged against one side of the lower case 101, thereby preventing occurrence of any play at the left guide 111*a* side.

Thus, the position of the left guide 11*a* as a reference for the sheet P is maintained as a constant without changing due to margins (occurrence of play) of the width of the fit portion (for the sheet supply tray) of the lower case 101 and the width of the sheet supply tray 111.

Figure 2:
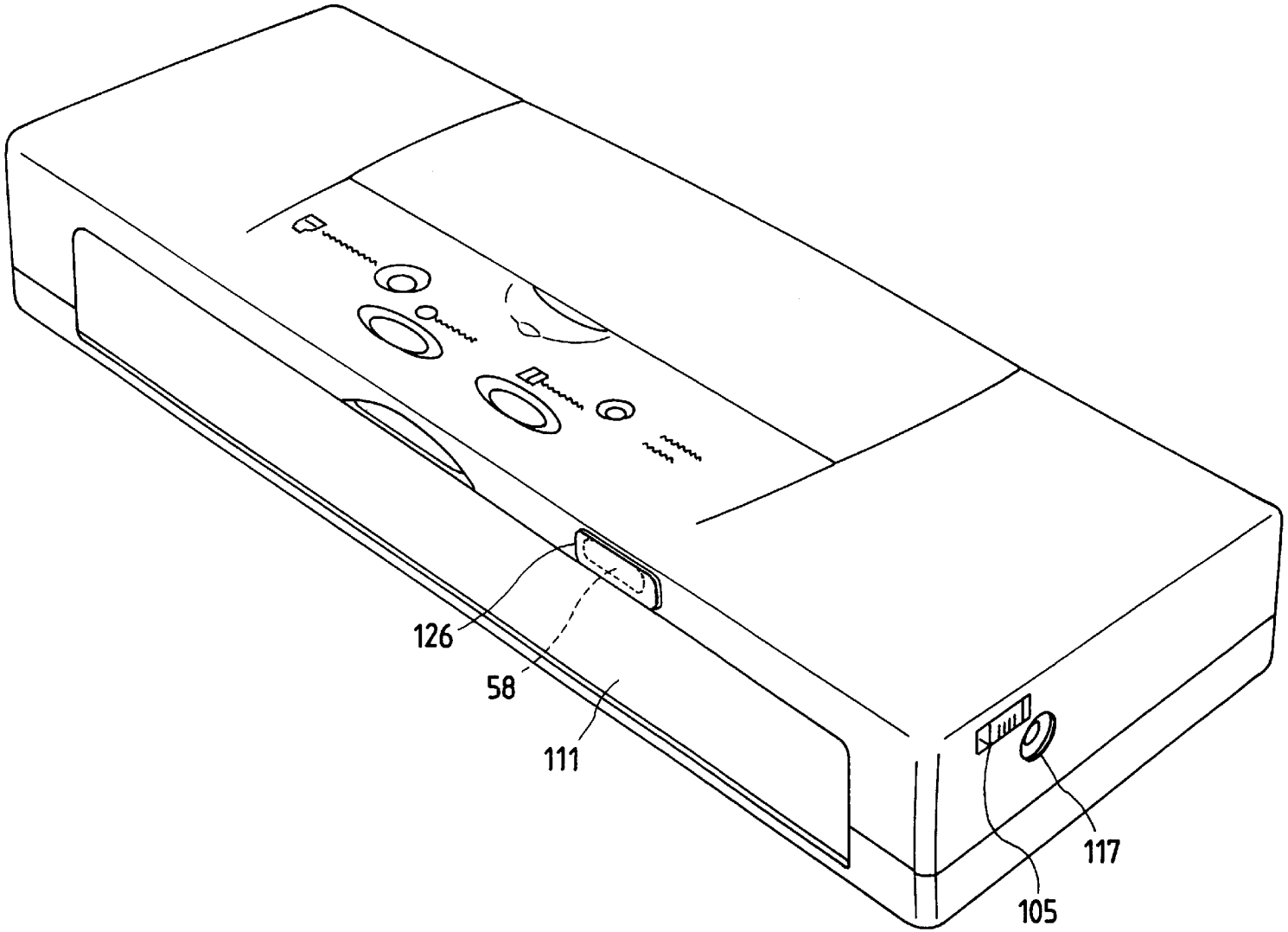
FIG. 2 is a perspective view of the recording apparatus of FIG. 1, looked at from above and in an oblique direction.

When the recording apparatus 401 is not used, the sheet supply tray 111 is closed (first position) as shown in FIG. 2. In a condition that the sheet supply tray 111 is closed, the sheet supply opening 121 (opening portion of the sheet supply path of the apparatus) is closed. Thus, the sheet supply tray 111 acts as both a dust-proof cover and a reinforcing member.

Since explanation of a dust-proof effect is unnecessary, now, a reinforcing effect will be explained.

As shown in FIG. 4, the sheet supply tray 111 is closed in such a manner that a tip end portion 111*b* of the tray is inserted into an engagement portion 100*d* provided on a peripheral edge portion (position near the opening portion of the sheet supply opening) of a sheet supply opening of the upper case 100.

Since the sheet supply path creates a tunnel-shaped space in a sheet conveying direction of the recording apparatus 401, the sheet supply path is apt to be flexed by an urging force from a direction perpendicular to a sheet path. However, since the sheet supply tray 111 is closed to be inserted into the peripheral edge portion, the opening portion of the sheet supply path is closed and the tip end portion 111*b* of the sheet supply tray abuts against the engagement portion 100*d* to form a beam, thereby strongly opposing to the urging force. Accordingly, in the condition that the sheet supply tray 111 is closed, if the urging pressure acts on both cases, 100, 101, the flexion of the cases is suppressed, thereby maintaining the proper positional relation.

The battery 116 and the substrate plate 57 are positioned at the sheet supply opening 121 side, and the recording portion M has great space due to the existence of the carriage scanning space. Thus, a gravity center of the apparatus is generally located near the sheet supply opening 121 from the center, when looked at on a line connecting between the sheet supply opening 121 and a sheet discharge opening of the apparatus.

Therefore, when the user transports the recording apparatus by hand, the apparatus is more stabilized by gripping the sheet supply side of the apparatus. Accordingly, in consideration of the stabilization during the transportation, an outline of the sheet supply tray 111 is constituted by a curved surface.

The recording apparatus includes the battery 116 therein for use as a portable equipment. Since a length of a human's palm is generally about 70 to 120 mm, in consideration of easy gripping, a thickness of the apparatus is preferably 60 mm or less. Thus, the dimension of the apparatus is selected to have a length of about 300 mm, a width of about 110 mm and a thickness of about 50 mm to permit hand gripping, thereby improving the portable ability.

Further, by using light weight elements (aluminum pinch roller, hollow sheet feeding roller, hollow guide shaft, lithium ion battery having good volume efficiency), a total weight of the recording apparatus is made about 900 g(grams), thereby improving its portability.

Now, the recording apparatus using a sheet material conveying apparatus according to an embodiment of the present invention will be fully explained.

[Entire Construction]

FIG. 1 is a perspective view of an ink jet recording apparatus according to an embodiment of the present invention. FIG. 2 is a perspective view of the recording apparatus of FIG. 1, looked at from above and oblique direction. FIG. 10 is a perspective view of the recording apparatus in a usable condition. In FIGS. 1 and 2, there are provided the upper case 100 covering an upper surface of the recording apparatus and the lower case 101 covering a lower surface of the recording apparatus, which cases are divided at a sheet passage.

Figure 11:
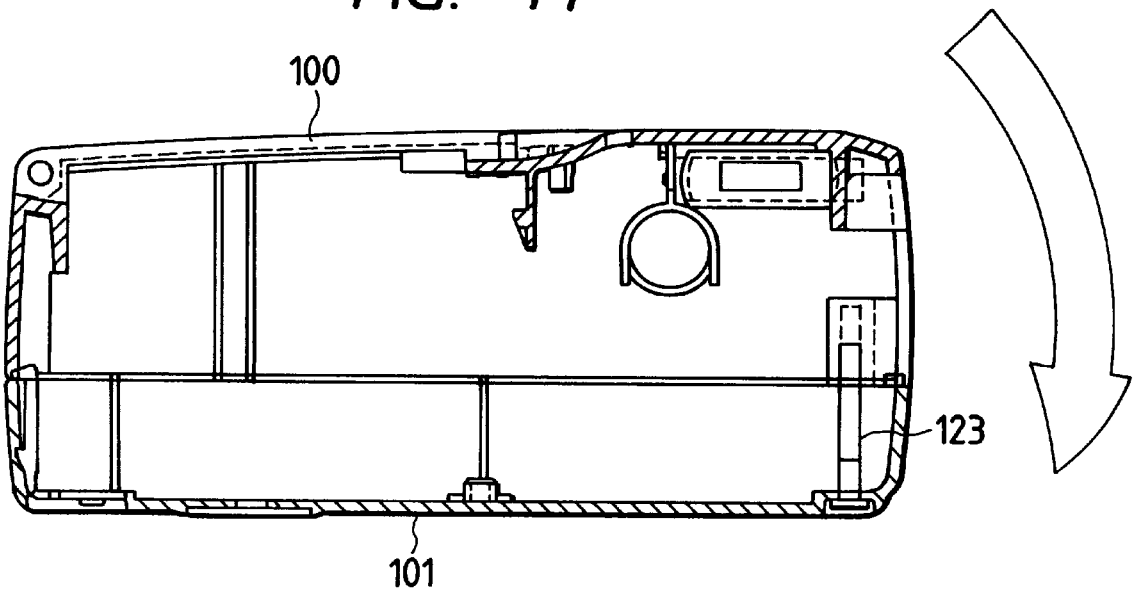
FIG. 11 is a sectional side view of upper and lower cases.
Figure 12:
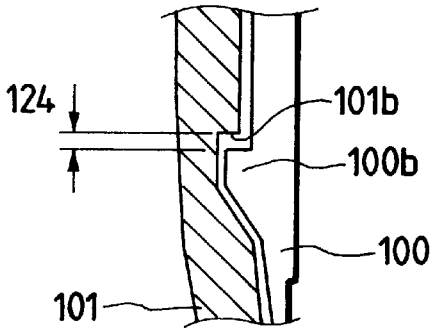
FIG. 12 is an enlarged view showing an engagement condition between hooks of the upper and lower cases and pawls.
Figure 13:
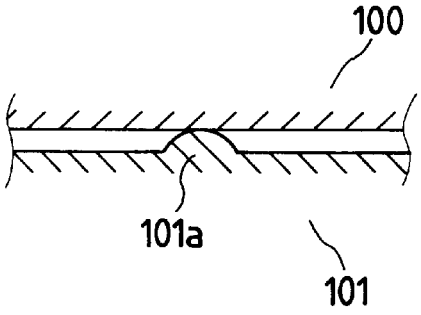
FIG. 13 is an enlarged view of a projection disposed between the upper and lower cases.
Figure 14:
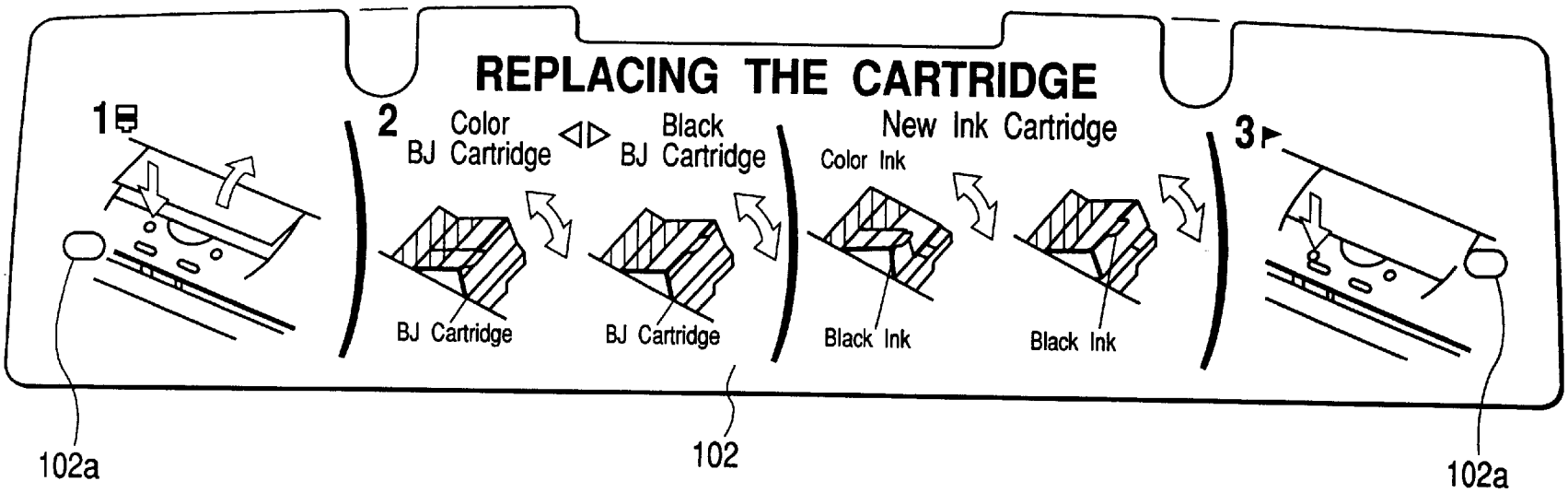
FIG. 14 is a plan view of the head exchange explaining plate.

Now, a method for assembling the upper and lower cases 100, 101 will be explained with reference to FIGS. 11 to 13.

A pawl 100*b* is formed on the upper case 100, and a corresponding hook portion 100*b* is formed on the lower case 101. Normally, a gap 124 is created between the pawl 100*b* and the hook portion 101*b*. The gap 124 is normally selected to be about 0.2 to 0.5 mm in consideration of dispersion in dimensions of parts and assembling error. Further, a projection 101*a* is formed on a surface of the lower case 101 to be contacted with the upper case 100. After the pawl 100*b* is engaged by the hook portion 101*b*, when a screw 123 is tightened, the upper case 100 is slightly rotated in a direction shown by the arrow in FIG. 11 around the projection 101*a* to be integrally connected to the lower case 101. By this rotational movement, as the screw 123 is being tightened, the gap 124 is gradually decreased to zero.

Due to the rotational movement around the projection 101*a*, the gap is eliminated to absorb any play between the upper case 100 and the lower case 101, thereby improving rigidity and preventing noise due to vibration in a printing operation of the recording apparatus. In comparison with a case where four corners are secured by using four screws, the number of parts and the number of assembling steps are reduced, thereby making the recording apparatus cheaper. Further, spaces for the screws can be omitted, thereby making the recording apparatus more compact. The head exchange lid 102 is positioned to cover an opening portion 100*c* of the upper case 100.

Figure 5:
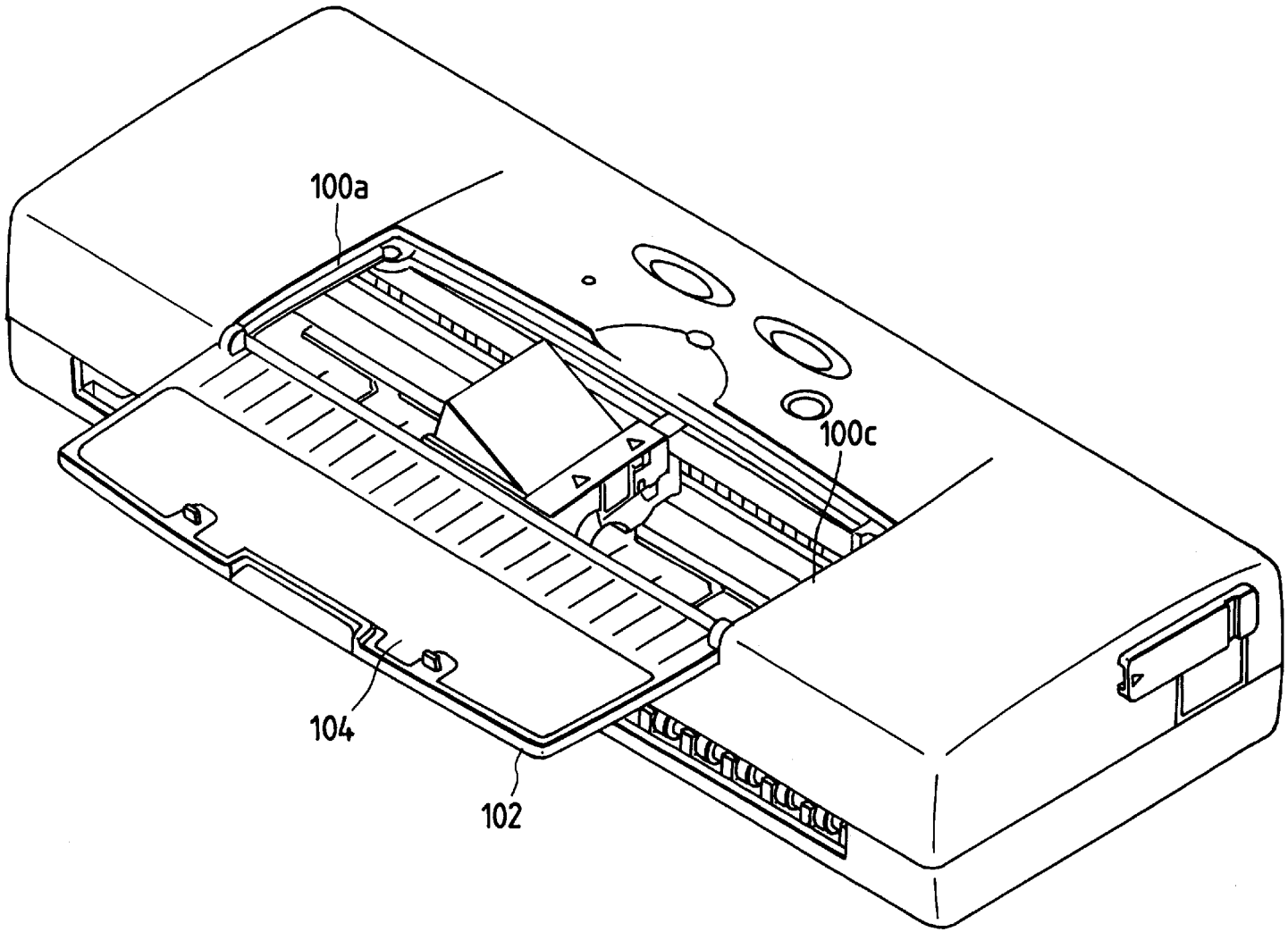
FIG. 5 is a perspective view of the recording apparatus, showing a condition that a head exchange lid is opened.
Figure 6:
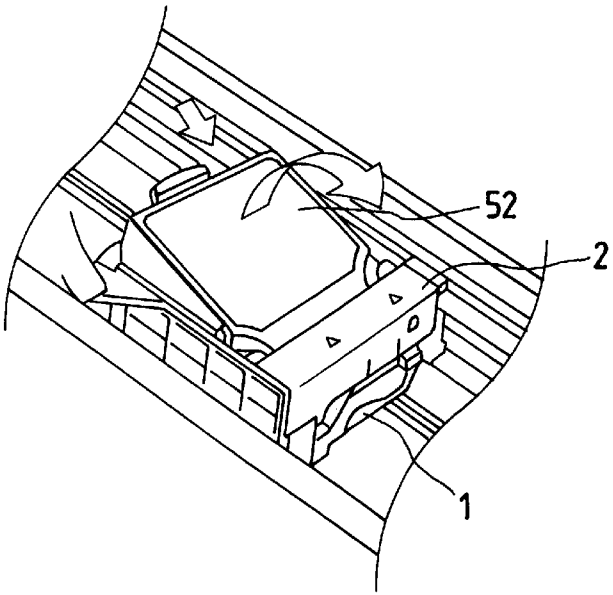
FIG. 6 is a perspective view showing exchange of a monochromatic tank.

The opening portion 100*c* can be opened by opening the head exchange lid 102 as shown in FIG. 5 when a recording head is exchanged or when a sheet Jammed within the recording apparatus is removed or when the internal structure of the recording apparatus is cleaned. The opening portion 100*c* is formed in a substantially central portion of the upper case 100 through which a portion of a carriage scan range is exposed (described later). By forming the opening portion 100*c* in the part of the upper case 100, reduction of rigidity of the upper case 100 can be minimized. Further, since an upper part of a recovery portion (described later) is always covered by the upper case 100, dust can be prevented from adhering to the recovery portion, and, if the carrier 2 was shifted to the recovery portion to effect the recovery operation, the head can be prevented from being contacted by the operator erroneously.

Figure 7:
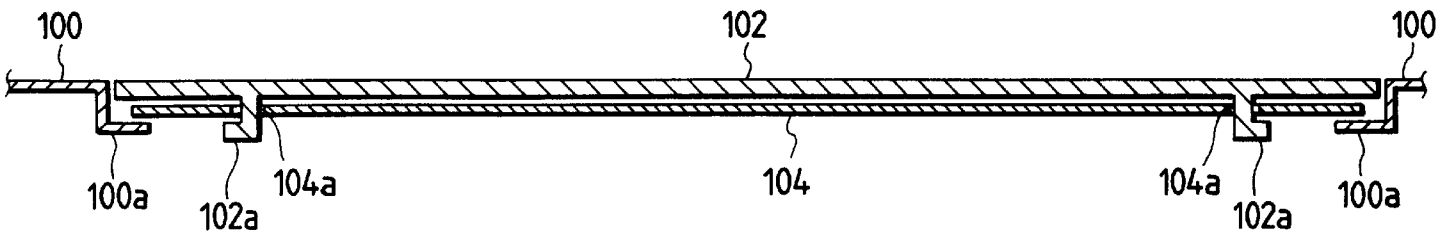
FIG. 7 is a sectional view showing attachment structure for a head exchange explaining plate.
Figure 8:
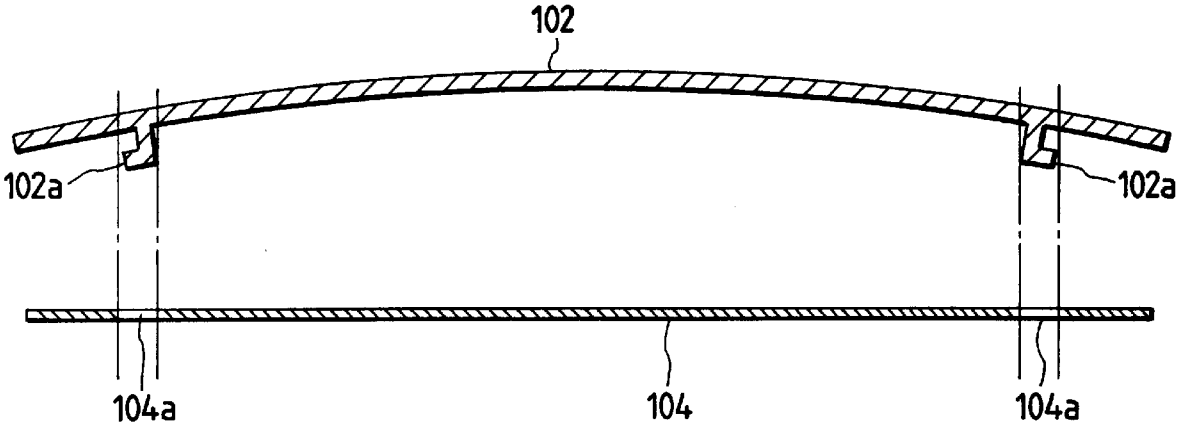
FIG. 8 is an explanatory view for explaining attachment of the head exchange explaining plate to the head exchange lid.

As shown in FIGS. 7 and 8, a head exchange explaining plate 104 is formed from a polyester sheet having a thickness of 0.2 mm on which a method for exchanging the head and the like is printed. The reason that the head exchange explaining plate 104 is provided separately from the head exchange lid 102 is that, if the printing is effected on the head exchange lid 102 or a printed matter is adhered to the head exchange lid, in the recycle, the head exchange lid is handled as a foreign matter. The head exchange lid 102 is formed as a plate shape having a first face as an outer surface when closed and a second face opposed to a carrier operation portion. The head exchange explaining plate 104 is provided on the second face of the head exchange lid 102. The head exchange lid 102 is provided with two opposed hooks 102*a* to which hole portions 104*a* of the head exchange explaining plate 104 can be engaged and secured. The head exchange explaining plate 104 and the head exchange lid 102 are formed to be greater than the opening portion 100*c* of the upper case 100 by about 2 mm so that they are overlapped with a stepped portion 100*a* of the opening portion 100*c* of the upper case 100. Thus, when the head exchange lid 102 is closed, an end of the head exchange explaining plate 104 is pinched between the head exchange lid 102 and the upper case, thereby preventing the end from suspending to interfere with the carrier 2.

FIG. 8 shows a method for attaching the head exchange explaining plate 104. The head exchange lid 102 is formed from polycarbonate plastic having a thickness of 2 mm and is fitted into the hole portions 104*a* of the head exchange explaining plate 104 by flexing it as shown in FIG. 8. The flexion of the head exchange lid 102 is released, as shown in FIG. 7, the head exchange explaining plate 104 is attached via the hooks 102*a*. When discrimination is effected for recycle, the head exchange explaining plate can be dismounted in a manner reverse to the above-mentioned manner. In FIGS. 1, 2 and 10, the power lamp 110 indicating an ON condition of the power source switch 106 for switching the power source of the recording apparatus. The error lamp 109 indicates an error condition of the recording apparatus and is turned ON if any of various trouble conditions of the recording apparatus occurs. The error release switch 107 serves to release or remove the error condition of the recording apparatus, so that, after the trouble condition of the recording apparatus is removed, the error is released by depressing the error release switch. A hold switch 105 has a function for nullifying the power source switch 106 not to turn ON the power source erroneously when the recording apparatus is transported.

A power source connector 117 provided on the upper case 100 serves to supply electric power to the recording apparatus. An interface connector 118 for connecting a signal cable from a host computer is covered by an interface connector cover 119. The interface connector cover 119 is made of an elastic body and has one end forming a hinge portion 119*a* on the upper case 110 and the other free end. The hinge portion 119*a* is made thinner than the other portion so as to be used as a hinge of the interface connector cover 119. Material of the hinge portion 119*a* thermoplastic polyurethane having good anti-tearing ability and adipate group hardness (Shore hardness) of 85. In recent years, some notebook-type personal computers have infrared ray communication function. To permit the infrared ray communication, an infrared ray communication window 120 is provided in the vicinity of a flush surface of the interface connector 118 and the lower case 101.

The sheet is inserted through the sheet supply opening 121 and is discharged from the sheet discharge opening 122. In an inoperative condition, the sheet supply tray 111 is closed as shown in FIG. 2, and, in use, the sheet supply tray is opened as shown in FIG. 10 to guide the insertion of the sheet P. The sheet supply tray 111 is provided with the left guide (reference for sheet insertion) 111*a* formed integrally therewith. The left reference position is unchanged regardless of the size of the sheet. On the other hand, the right guide 112 for guiding the right edge of the sheet P can be slid by the operator in accordance with the size of the sheet.

Figure 15:
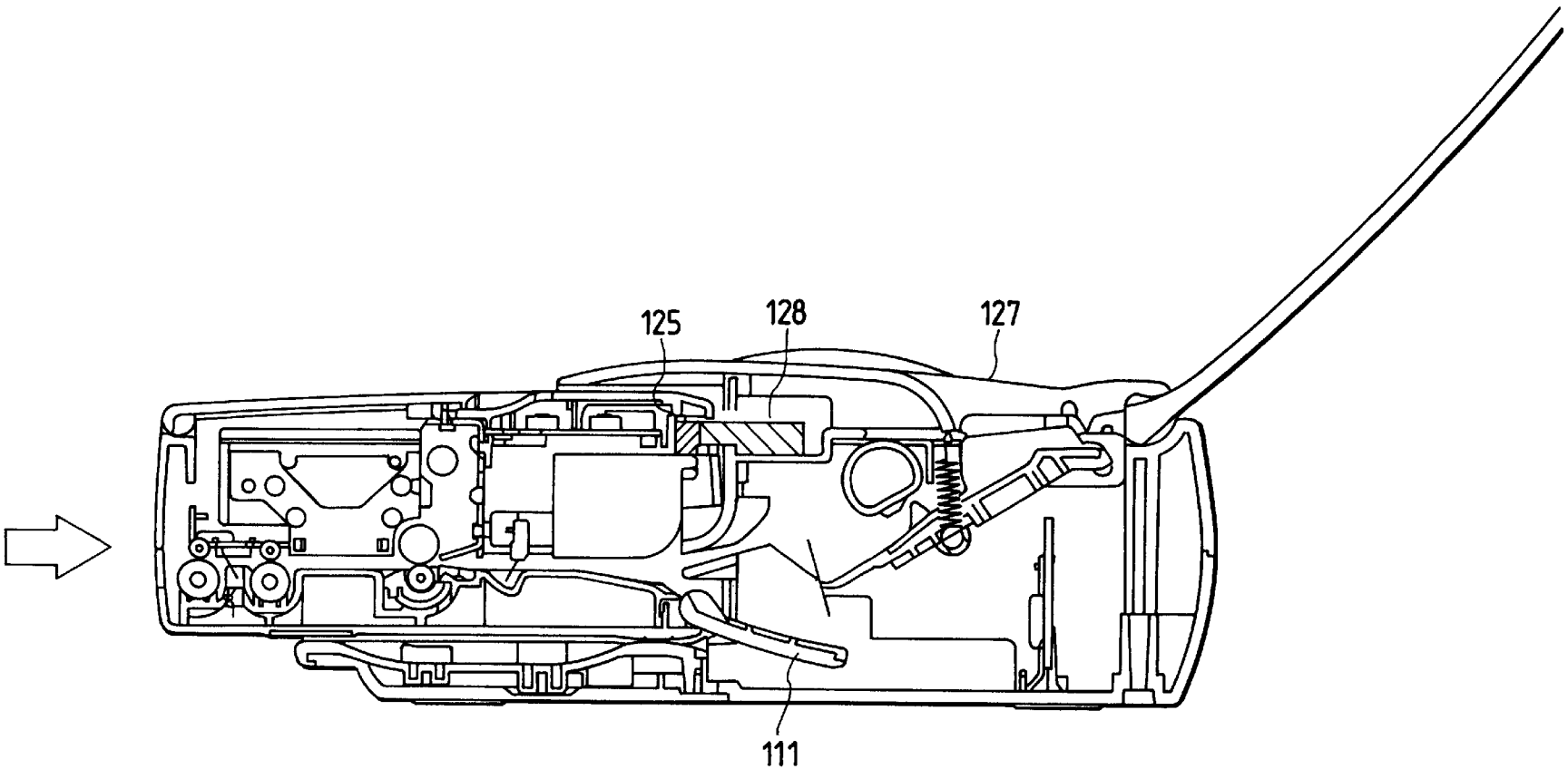
FIG. 15 is a sectional side view showing a recording apparatus to which an automatic sheet supplying apparatus is mounted.

An option connector 58 is provided on a face of the sheet supply opening 121. In the inoperative condition, the option connector 58 is covered by an option connector cover 126. As an example of option of the recording apparatus, there is an automatic sheet supplying apparatus or feeder (ASF) 127. The ASF 127 is provided with an ASF connector 128 connected to the option connector 58. The re-cording apparatus can be connected to the ASF 127 by sliding it in a direction shown by the arrow in FIG. 15. In this case, since the direction of the sheet path and the connecting direction are the same, a space for discharging the sheet is normally maintained in the sheet discharging direction at a place where the ASF 127 is installed. Thus, the mounting of the ASF can easily be effected. For example, in a method in which the recording apparatus is connected to the ASF from a direction perpendicular to the sheet path, since spaces on both sides of the ASF 127 are also required, the installation place for the ASF is limited. Further, since the direction of the sheet path and the connecting and disconnecting direction are the same, the sheet jam treatment can easily be performed. During the connection, since the option connector 58 is located in flush with the sheet supply opening 121, the connection to the ASF connector 128 is also effected simultaneously and automatically. Thus, the time required for the connection can be saved and trouble such as misconnection and poor insertion can be prevented.

The recording apparatus includes the battery therein for providing the portability. Since the length of the human's palm is about 70 to 120 mm, in consideration of easy gripping, the thickness of the apparatus is preferably 60 mm or less. Thus, the dimension of the apparatus is selected to have the length of about 300 mm, the width of about 110 mm and the thickness of about 50 mm to permit hand gripping, thereby improving the portability. Further, by using light weight elements (aluminum pinch roller, hollow sheet feeding roller, hollow guide shaft, lithium ion battery having good volume efficiency), the total weight of the recording apparatus is made about 900 grams, thereby improving its portability.

Figure 26:
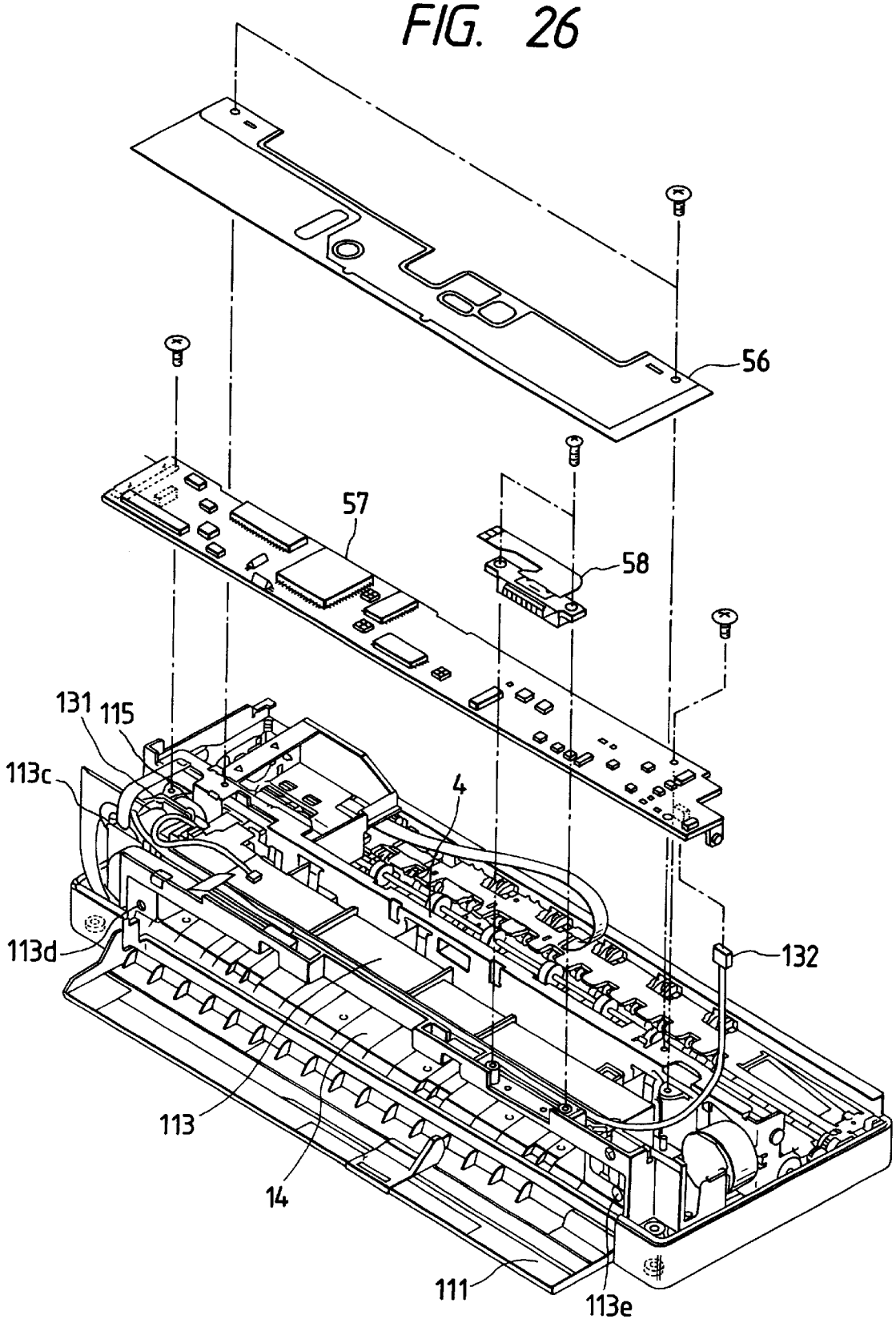
FIG. 26 is an exploded perspective view showing an internal structure of the recording apparatus.
Figure 27:
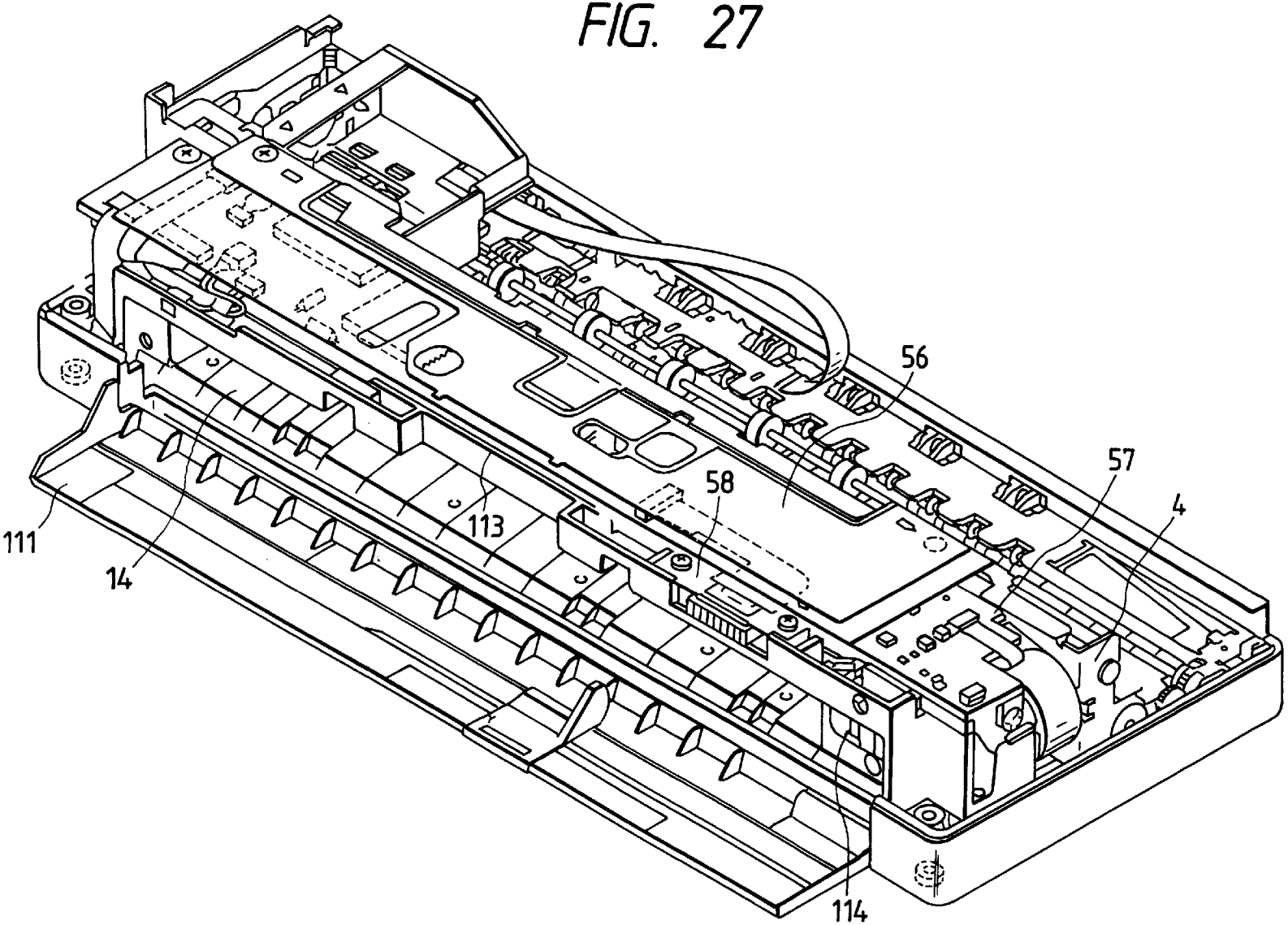
FIG. 27 is a perspective view showing the internal structure of the recording apparatus.

FIGS. 26 and 27 are perspective view showing an internal construction of the recording apparatus according to the embodiment of the present invention. In FIGS. 26 and 27, a platen 14 constitutes a part of a recovery system (described later) and a lower part of a sheet feeding portion. A frame 4 made of aluminium to achieve light weight purpose holds a carrier operation portion (described later) and an upper part of the sheet feeding portion to define the recording apparatus. The platen 14 and the frame 4 are positioned to each other by fitting bosses of the platen 14 provided on left and right side at the sheet discharge side into notched portions of the frame 4 provided on left and right side at the sheet discharge side and are secured to each other by hooking the frame 4 to pawl portions of the platen 14 provided on left and right side at the sheet supply side. A substrate holder 113 shown in FIGS. 26 and 27 is positioned at the sheet supply side of the frame 4 by two bosses (not shown) and is secured by three upper pawls and a lower central screw. The substrate holder 113 has a function for detachably holding the battery 116, a function for holding the substrate plate 57, a function for guiding an upper path when the sheet P is supplied and the like.

Figure 28:
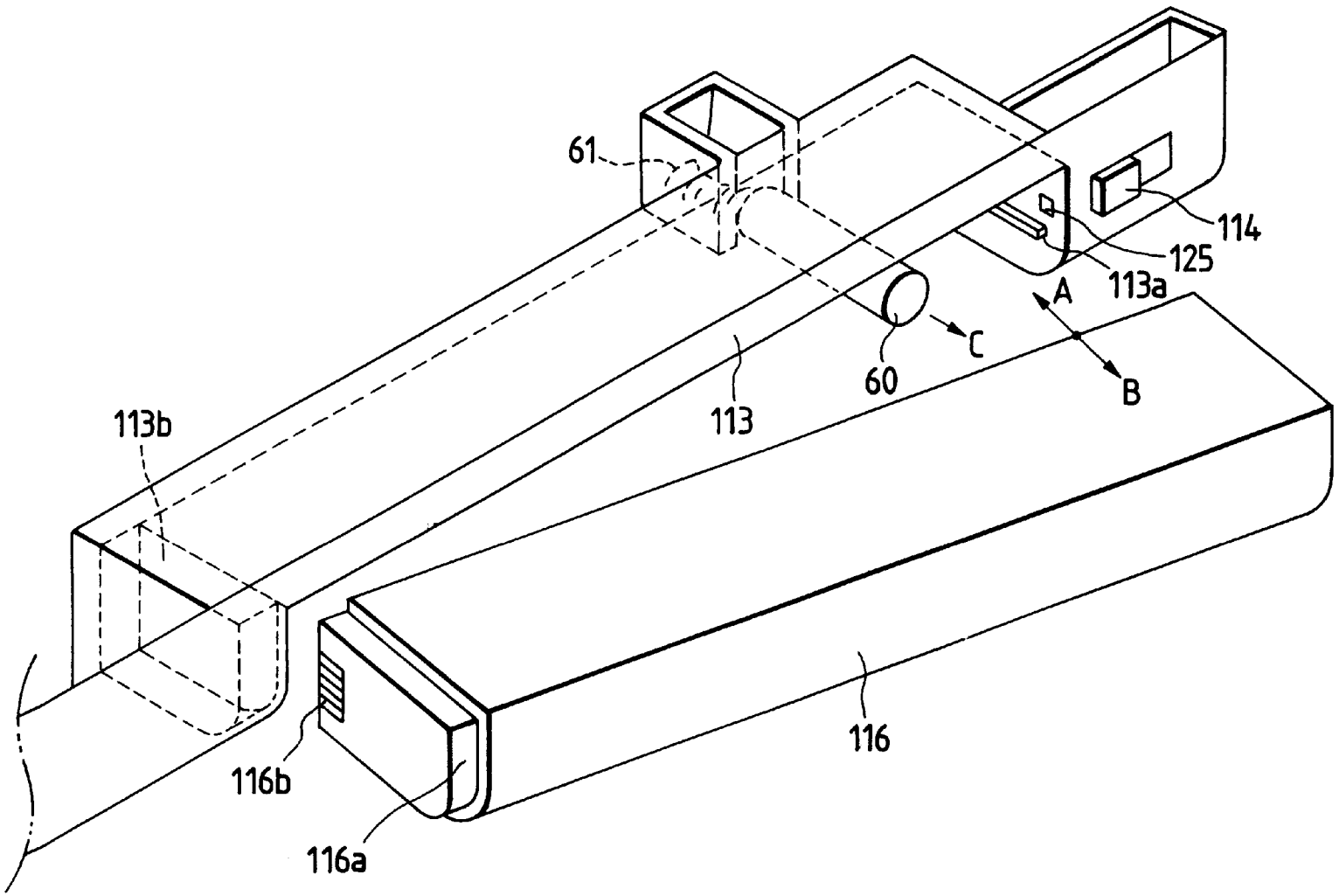
FIG. 28 is a perspective view for explaining mounting and dismounting operations of a battery.

Now, the function of the substrate holder 113 for holding the battery 116 will be described with reference to FIGS. 26 to 28. A battery contact 115 having four male terminals is welded to a battery substrate (not shown) outside of a left wall of the substrate holder 113, looked at from the sheet supply side for the sheet P. The male terminals of the battery contact 115 protrude into a substrate holder recess 113b into which the battery 116 is housed. Further, a battery cable 131 from the battery substrate is connected to the substrate plate 57 via a battery connector 132. On an opposed face (right side face), there are provided a substrate holder rail 113*a* substantially parallel with a sheet pass direction and provided on the substrate holder 113, and a battery hook 125 slidable for extension and retraction. The battery hook 125 is extended and retracted in synchronous with a sliding movement of a battery lock lever 114. The battery hook 125 is normally held in an extended condition by a battery lock spring (not shown).

Figure 29:
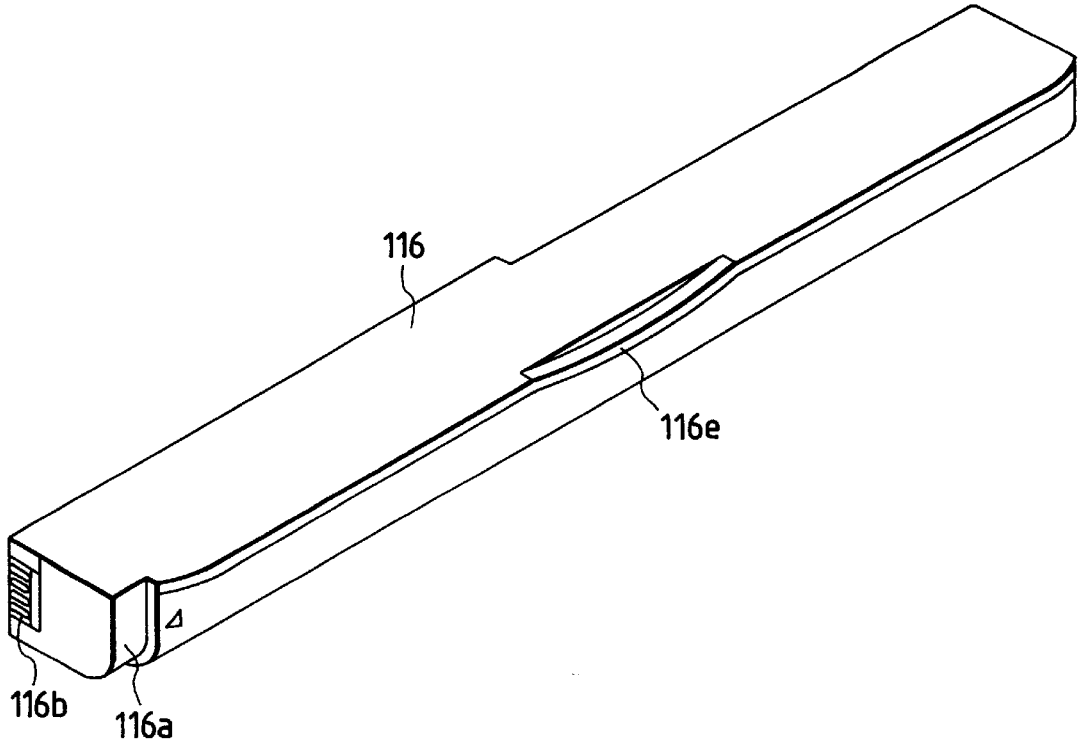
FIGS. 29 and 30 are perspective views of the battery.

As shown in FIG. 29, at an end of the battery 116, there is provided a battery stepped portion 116*a* in correspondence to the substrate holder recess 113*b* of the substrate holder 113, and a female battery contact 116*b* is located at a position where it is connected to the battery contact 115. At an opposite end, a battery groove 116*c* is located at a position corresponding to the substrate holder rail 113*a* and a battery recess 116*d* is located at a position corresponding to the battery hook 125.

With this arrangement, the battery stepped portion 116*a* of the battery 116 is inserted into the substrate holder recess 113*b* of the substrate holder 113. The battery contact 115 and the female battery contact 116*b* are contacted with each other, and, when the battery 116 is rotated in a direction shown by the arrow A in FIG. 28 while inserting the battery groove 116*c* onto the substrate holder rail 113*a* until the groove abuts against the rail, the battery hook 125 is fitted into the battery recess 116*d* by the spring force of the battery lock spring (not shown) and is secured therein. Further, at a rear side of the substrate holder 113 where the battery 116 is housed, a battery pop-up 60 near the battery hook 125 is biased by a battery pop-up spring 61 toward a direction along which the battery 116 is pushed out. Thus, when the battery lock lever 114 is slid in opposition to the spring force of the battery lock spring, the battery hook 125 is driven to disengage from the battery recess 116*d*, with the result that the battery pop-up 60 is protruded in a direction shown by the arrow C in FIG. 28 by the spring force of the battery pop-up spring 61, thereby pushing out the battery 116. Consequently, the battery 116 is rotated in a direction shown by the arrow B in FIG. 28 around the battery contact 115 and the female battery contact 116*b*, thereby disengaging the battery 116.

Figure 30:
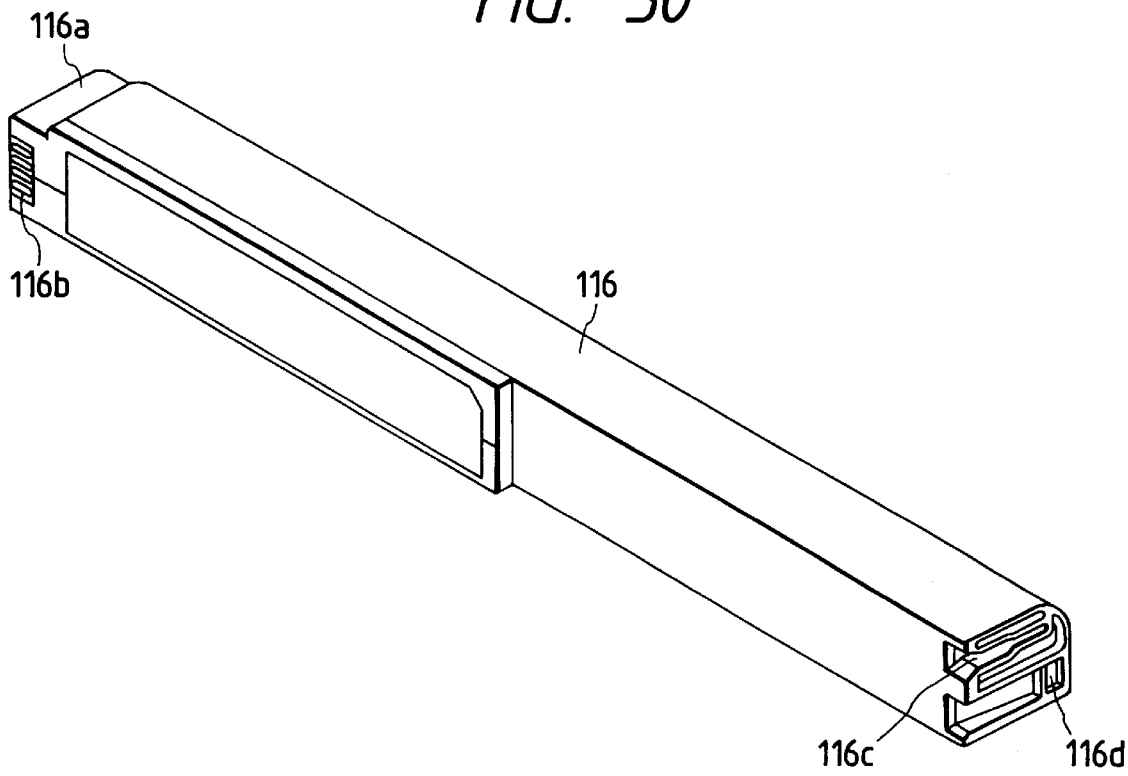

Now, the battery 116 will be briefly described with reference to FIGS. 29 and 30. In the battery 116, battery cells are arranged in series and are covered by a welded lid. Further, a battery rib 116*e* is provided at a front upper part of the battery 116 to prevent entrance of dust when the sheet supply tray 111 is closed. A central portion of the battery rib 116*e* is curved and is slightly bent downwardly not to interfere with the operator's finger when the sheet supply tray 111 is opened.

Next, a function of the recording apparatus for supplying the sheet P will be explained. As shown in FIG. 4, front lower portions (looked at from the sheet supply side of the sheet P) of the substrate holder 113 and the battery 116 are curved to facilitate the sheet supply. Further, a supply path for the sheet P is defined by the platen 14 (at a lower side) and the substrate holder 113 and the battery 116 (at an upper side). Thus, the substrate holder 113 and the battery 116 also act as a guide of the sheet supply path.

Further, substrate holder bosses 113*c* are formed on left and right upper parts of the substrate holder 113 at a front sheet supply side. The substrate holder bosses 113*c* are inserted into holes of the substrate plate 57 to position and support the substrate plate 57. The rear side of the substrate plate 57 is secured to the frame 4 by two left and right screws. At this position, the substrate plate 57 is grounded. Further, the option connector 58 is secured to the substrate holder 113 by two screws.

As shown in FIG. 4, a sheet sensor 25 is held at a lower part of the substrate holder 113 where the sheet P is passed. A memory back-up secondary battery (not shown) is housed in a space surrounded by the substrate holder 113. At the front sheet supply side, a substrate holder hole 113*d* is formed in the substrate holder 113 at the left side thereof and a substrate holder elongated hole 113*e* is formed in the substrate holder at the right side thereof, which holes serve to position the ASF 127.

Figure 24:
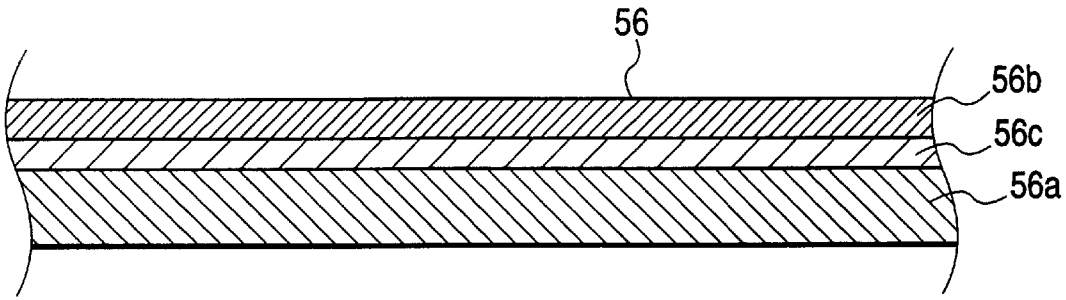
FIG. 24 is a sectional view of a shield plate.

Now, the shield plate 56 will be explained with reference to FIG. 24. The shield plate 56 is constituted by an upper conductive shield plate aluminium foil 56*b* and a lower insulation shield plate PET 56*a*. The aluminium foil 56*b* and the PET 56*a* are bonded together by a shield plate adhesive layer 56*c*. The shield plate 56 is secured to the frame 4 by two screws and is electrically connected to the frame 4 by contacting the screws with the upper aluminium foil 56*b*. The frame 4 is electrically connected to a ground (not shown). The shield plate 56 covers the upper surface of the substrate plate 57 to shield radiation noise generated from the substrate plate 57. Under a low humidity condition, static electricity may be accumulated in the operator, and, when the operator manipulates the recording apparatus, atmospheric discharge to the recording apparatus may occur. The voltage of the atmospheric discharge may reach up to 40 kV. If the voltage is discharged to the pattern on the substrate plate 57, elements on the substrate plate 57 will be destroyed or erroneous operation will occur. Also in such a case, since the substrate plate 57 is covered by the shield plate 56, the static electricity is flowing to the ground through the aluminium foil 56*b*, thereby protecting the substrate plate 57.

Regarding thicknesses of the members constituting the shield plate 56, a thickness of the shield plate aluminium foil 56*b* is about 50 $\mu$m, a thickness of the shield plate PET 56*a* is about 100 $\mu$m and a thickness of the shield plate adhesive layer 56*c* is about 40 $\mu$m. These thicknesses are determined as follows. If the shield plate aluminium foil 56*b* is thinner than the aforementioned value, it is hard to be handled in manufacture and/or wrinkles may formed in the foil. If the shield plate PET 56*a* is thinner than the aforementioned value, wrinkles are formed in the PET when the shield plate is secured to the frame 4 by the screws. Further, the shield plate 56 is formed from flame retardant material having self-fire-extinguishing ability.

Figure 25:
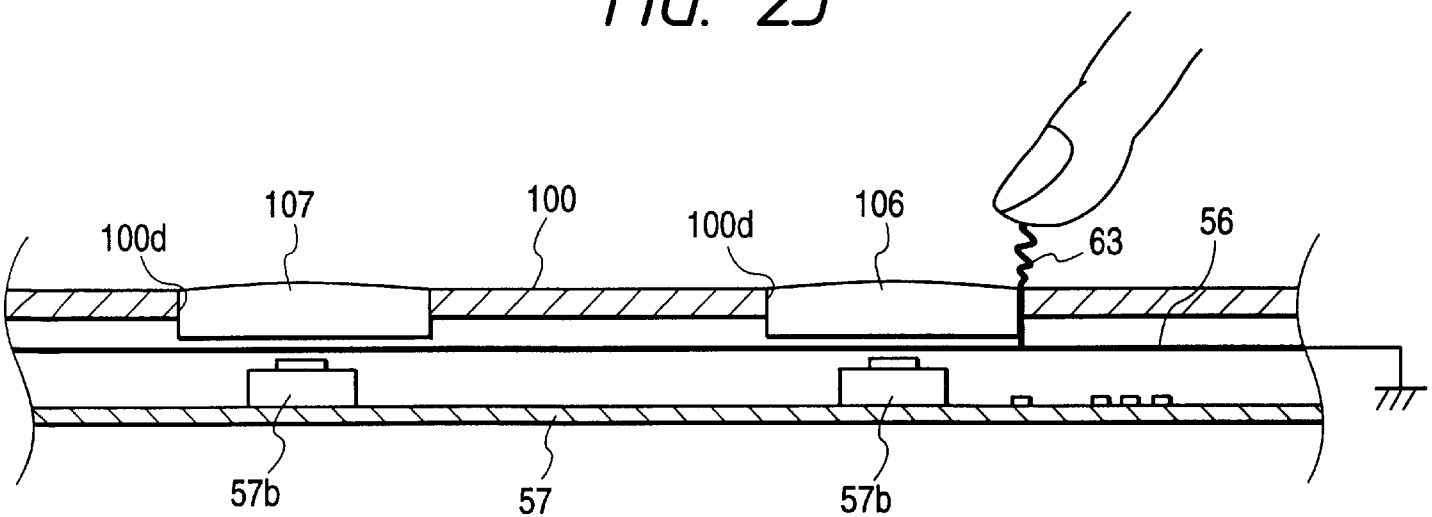
FIG. 25 is a sectional view for explaining an operation of a switch portion.

Arrangement of the upper case 100, power source switch 106, error release switch 107, shield plate 56 and substrate plate 57 will be explained with reference to FIG. 25 (sectional view). The power source switch 106 and the error release switch 107 are elastically attached so that the operation faces of these switches protrude from the holes 100*d* of the upper case 100. Contact switches 57*b* are provided on the substrate plate 57 via the shield plate 56 immediately below the power source switch 106 and the error release switch 107. Accordingly, the contact switch 57*b* corresponding to the power source switch 106 arranged on the substrate plate 57 and the contact switch corresponding to the error release switch 107 are depressed via the shield plate 56. Similarly, in FIG. 25, a contact switch (not shown) corresponding to the head exchange switch is also depressed via the shield plate 56. Further, the holes 100*d* are formed to be greater than the power source switch 106 and the error release switch 107 by about 0.2 mm in dimension so as not to interfere with the latter. Thus, when the operator tries to depress the switch, the static electricity is discharged through the gap between the hole 100*d* and the power source switch 106 or the error release switch 107 as shown by the reference numeral 63. Since the shield plate 56 is grounded, the static electricity is flowing into the ground, thereby protecting the elements and patterns on the substrate plate 57.

[Carrier Operation Portion]

Figure 3:
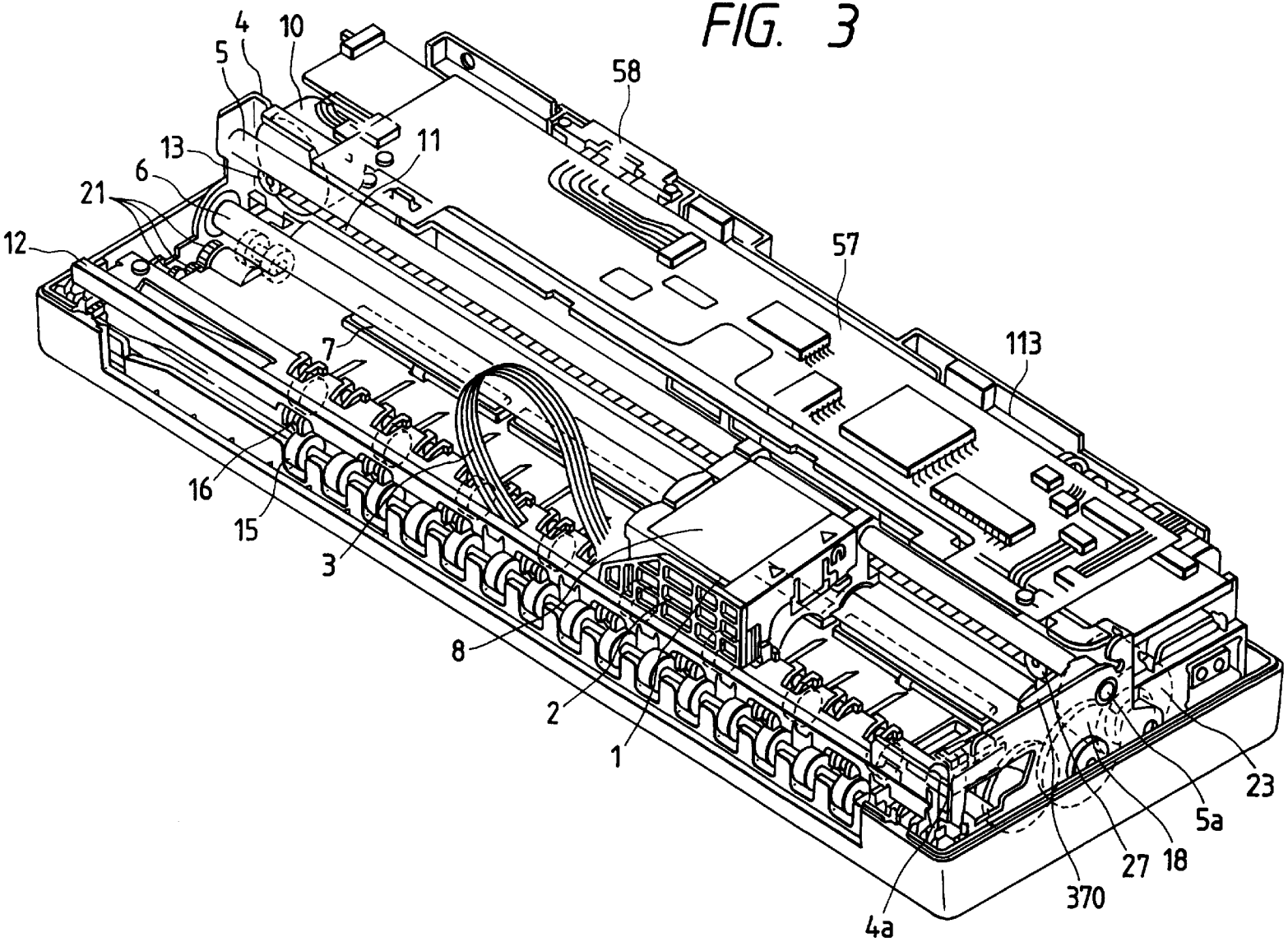
FIG. 3 is a perspective view showing an internal structure of the recording apparatus.

As shown in FIG. 3, the recording apparatus has the carrier 2 for detachably holding the recording head cartridge 1. The carrier 2 is supported by the guide shaft 5 and the guide rail 12 which have both ends secured to the frame 4 and are disposed in parallel with each other in such a manner that the carrier is located perpendicular to the sheet conveying direction and can be slid in the main scan direction parallel with the surface of the sheet P. The guide shaft 5 is formed from a pipe-shaped hollow shaft having a thin wall. A look arm 370 and a plug 5*a* having a groove for securing the guide shaft 5 to the frame 4 are secured within one end of the guide shaft 5.

The carrier 2 is connected to a portion of a belt 11 mounted between a drive pulley 13 rotating driven by a carrier motor 10 secured to the frame 4 and an idle pulley slidable in a direction parallel to the guide shaft 5 and rotatably supported by the frame 4 via a spring (not shown), so that, when the carrier motor 10 is energized, the belt 11 is driven to reciprocally shift the carrier in the above-mentioned direction along the guide shaft 5 and the guide rail 12.

An ink tank 8 is detachably mounted on the recording head cartridge 1 so that, when ink is used up by the recording, the ink tank 8 can be exchanged. Further, the recording apparatus has a home position sensor 26 for detecting the position of the carrier 2 by detecting the passage of the carrier 2, and a flexible cable 3 for transmitting an electric signal from the substrate plate 57 to the recording head cartridge 1.

[Sheet Conveying Portion]

Figure 55:
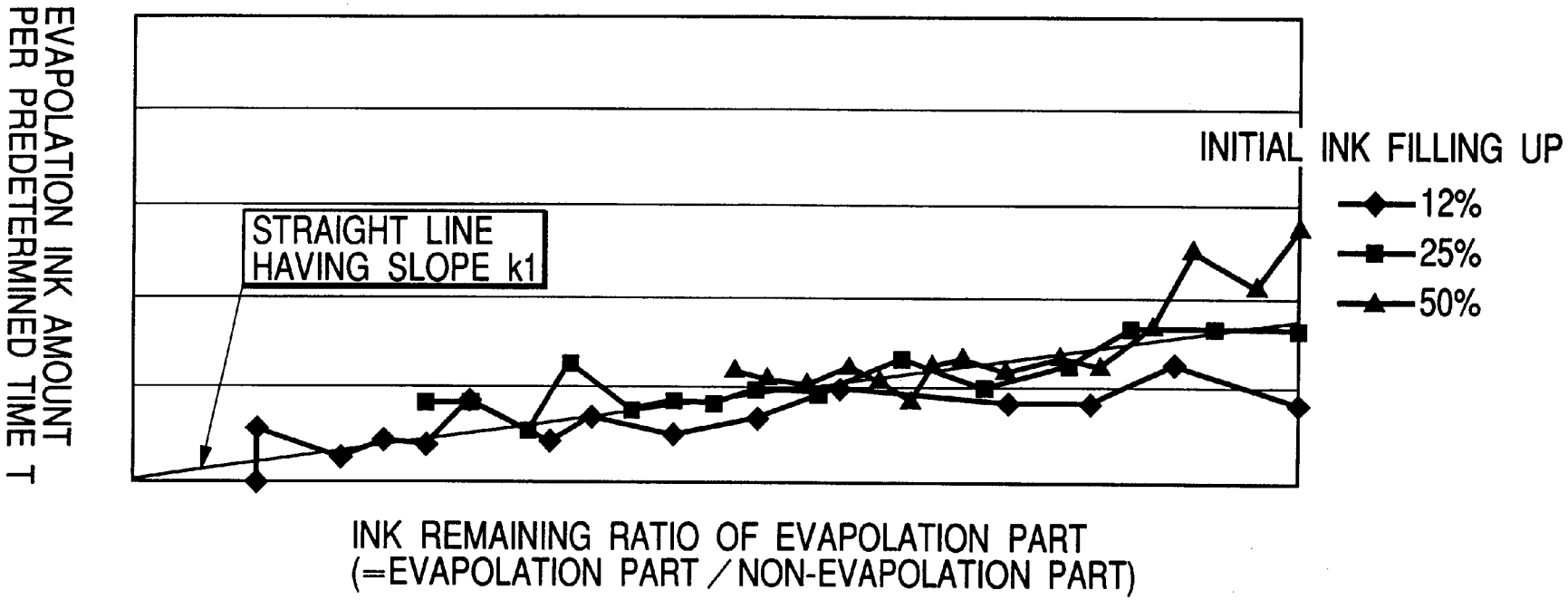
Figure 57:
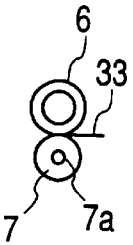
FIG. 57 is a left side view of FIG. 56.
Figure 56:
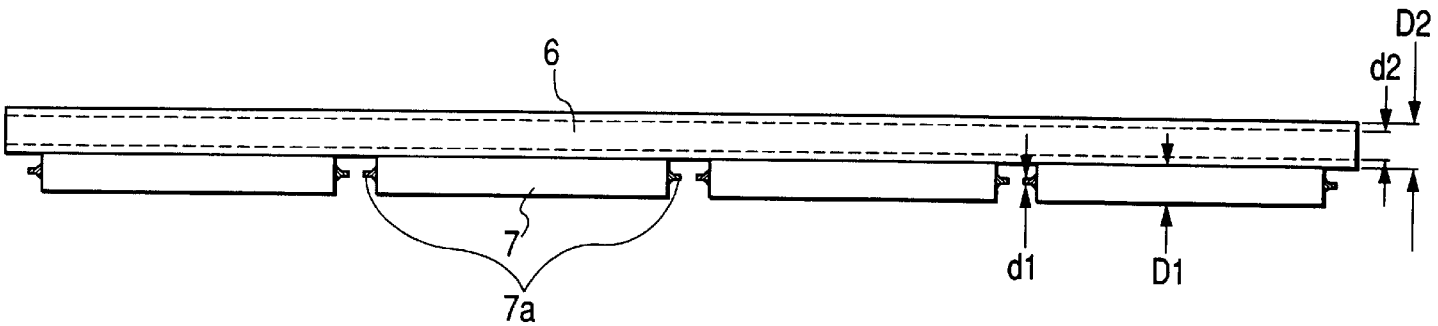
FIG. 56 is a front view of a drive roller and a pinch roller (driven roller)
Figure 58:
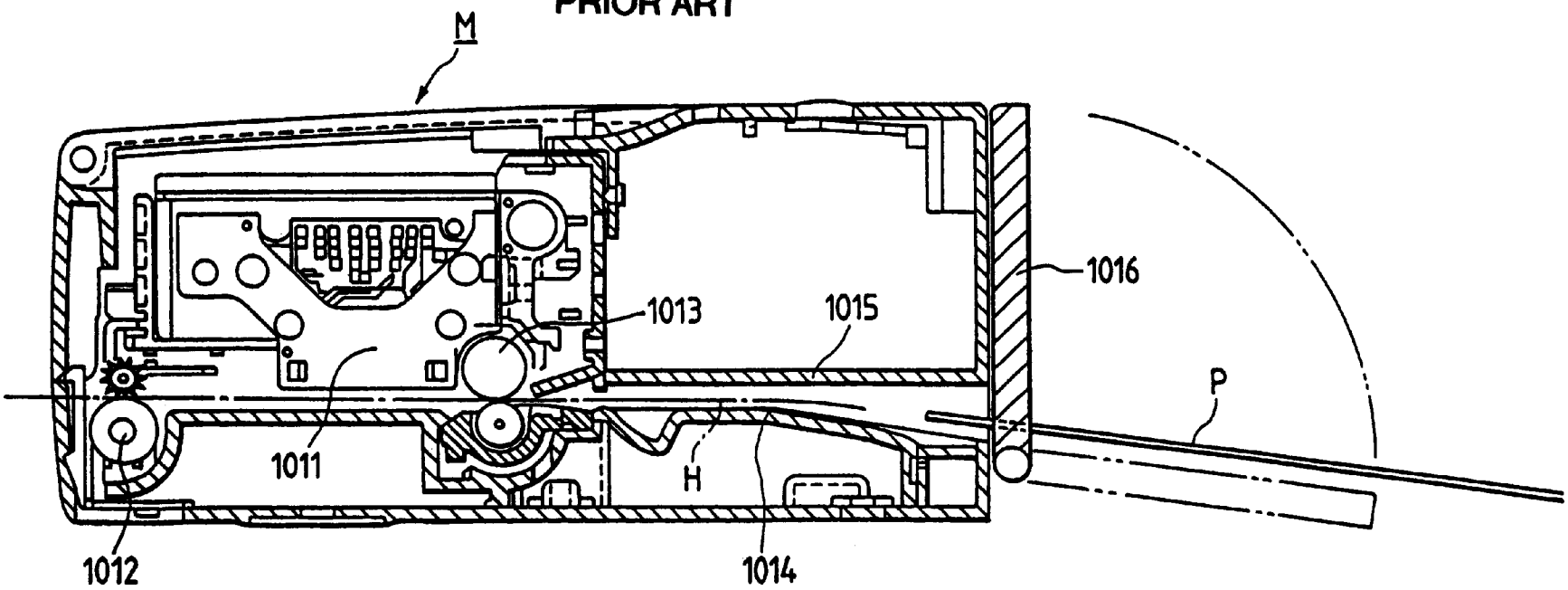
FIG. 58 PRIOR ART
FIG. 58 is a sectional view of a conventional recording apparatus.

Next, an arrangement for conveying the sheet P will be explained with reference to FIGS. 3, 4, 56 and 57. A sheet feeding roller 6 is rotatably supported by the frame 4, and an LF gear 18 is secured to an end of a shaft of the sheet feeding roller 6. In order to reduce the weight of the roller, the sheet feeding roller 6 is a pipe-shaped hollow shaft having a thin wall and coated by urethane. As shown in FIG. 55, the pipe has an outer diameter D2 of about 7.561 mm, an inner diameter d2 of about 5 mm and a wall thickness t of about 1.28 mm. The sheet feeding roller 6 is rotatingly driving by a sheet feeding motor 23 via the LF gear 18.

The above-mentioned dimensions are determined in consideration of manufacturing run-out accuracy, outer peripheral tolerance, light weight and shock strength.

That is to say, the outer diameter D2 of the sheet feeding roller 6 is selected by the following reasons.

(1) A speed reduction ratio between an LF motor gear 30, an LF double gear 31 and the LF gear 18 in a gear train located between the sheet feeding motor 23 and the sheet feeding roller 6 is set to 1:7.

(2) When the sheet feeding motor 23 is steppingly rotated, a rotational angle of the LF motor gear 30 becomes about 7.5 degrees.

(3) Slight slip is generated between the sheet P and the sheet feeding roller 6.

Thus, in consideration of the above reasons (1), (2) and (3), the outer diameter D2 is so selected that, when the sheet feeding motor 23 is rotated by one step, the sheet P is fed by the sheet feeding roller 6 by 1/360 inch.

In order to make the sheet feeding roller 6 having the outer diameter D2 lighter as much as possible and to provide the shock strength of the frame 4, the wall thickness of the pipe must be made thinner. On the other hand, when it is manufactured so that the run-out accuracy of the sheet feeding roller 6 and flexion due to pinch pressure receiving four pinch rollers 7 do not affect an influence upon sheet feeding accuracy, the greater wall of the pipe more the sheet feeding roller is stabilized. By balancing these two conditions, the thickness of the pipe is determined, with the result that the inner diameter d2 is also determined.

FIG. 4 is a sectional view of the recording apparatus.

A lower side of the sheet conveying path is defined by the platen 14. The platen 14 is incorporated along the inner wall of the lower case 101 and has a box shape for providing a space for containing a disposal ink absorbing body 327 (described later) between the platen and the lower case 101. In this condition, by tightening the platen 14 and the lower case 101 with screws, camber of parts is corrected, thereby improving the rigidity of the recording apparatus. A plurality of rows of protruded ribs (not shown) for reducing adhesion of the sheet P to the platen due to the static electricity and the sliding load during the sheet conveyance are formed on the surface of the platen 14 along the sheet conveying direction. The pinch roller 7 held by a pinch roller holder 9 rotatably attached to the platen 14 is urged against the sheet feeding roller 6 from below by a spring (not shown), so that the sheet P pinched between the sheet feeding roller 6 and the pinch roller 7 is conveyed by driving the sheet feeding motor 23.

As shown in FIG. 55, an outer peripheral portion D1 of the pinch roller 7 for pinching the sheet between it and the sheet feeding roller 6 has a diameter of about 6 mm substantially equal to or slightly smaller than the sheet feeding roller 6. Further, a ratio between an outer diameter d1 of a rotary shaft portion 7*a* held by the pinch roller holder 9 and the diameter D1 of the outer peripheral portion of the pinch roller 7 is 2:15, and, thus, the shaft diameter d1 is 0.8 mm. The sheet feeding roller 6 is made of aliminium (light weight metal). Thus, since the sheet feeding roller 6 has light weight and less rotational load, there is almost no sheet feeding loss. Further, the outer diameter D1 of the pinch roller 7 and the outer diameter D2 of the sheet feeding roller 6 are substantially the same, when the sheet is supplied, the sheet P can easily be directed to a nip 33 between the pinch roller 7 and the sheet feeding roller 6. Thus, a pushing force for penetrating the tip end of the sheet into the nip 33 can be reduced.

The outer peripheral portion and the shaft portion of the pinch roller 7 made of aluminium are both subjected to allodine treatment, so that corrosion of these parts due to the presence of ink mist discharged from the recording head cartridge 1 and included in the atmosphere within the apparatus and wear of the outer peripheral portion when it is driven for a long time while contacting with the pinch roller 7 are reduced, with the result that the rotational load of the pinch roller 7 is almost not increased even after the long term use.

In FIGS. 3 and 4, two rows of sheet discharge rollers 15 for discharging the recorded sheet out of the apparatus are attached at an opposite side of the sheet feeding roller 6 with the interposition of the recording head cartridge 1. The sheet discharge rollers are rotated in synchronism with the sheet feeding roller 6 by transmitting a driving force from the sheet feeding roller 6 through an idle gear train 21. The spur rollers 16 attached to the guide rail 12 are located above the sheet discharge rollers 15, and the sheet discharge rollers 15 are urged against the spur rollers 16 from below by springs (not shown) so that the sheet is pinched between and conveyed by the sheet discharge rollers and the spur rollers. The sheet sensor 25 is disposed at an upstream side of the sheet feeding roller 6 at the side of the sheet supply opening 121 remote from the recording head cartridge 1 and a discharge sheet sensor 17 is disposed between two rows of sheet discharge rollers 15, thereby detecting presence/absence of the sheet P.

Figure 23:
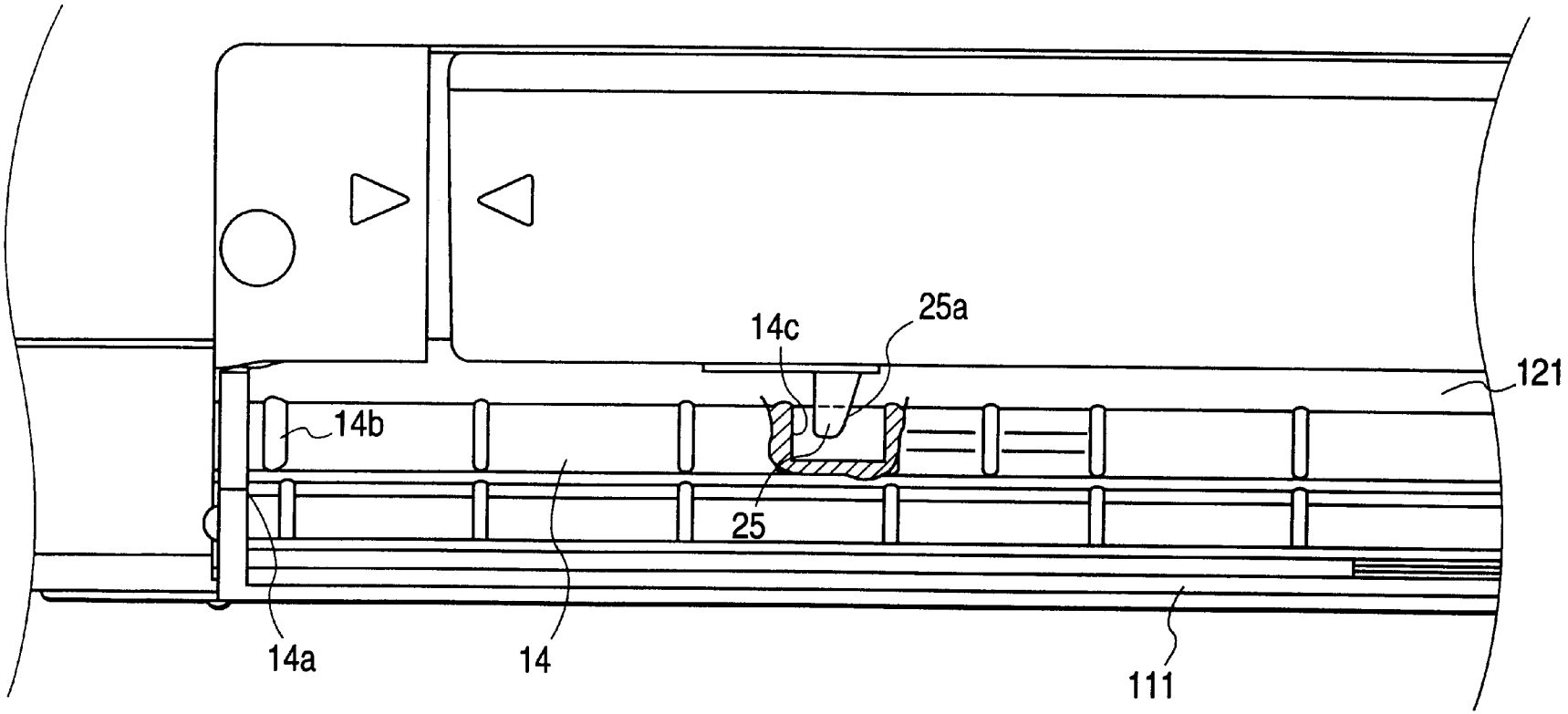
FIG. 23 is a front view of a sheet supply opening of the recording apparatus.

FIG. 23 is a front view of the sheet supply opening 121 of the recording apparatus according to the illustrated embodiment.

The platen 14 is provided at its left end with a sheet guide portion 14*a* acting as a reference when the sheet is inserted. Among the plurality of protruded ribs formed on the surface of the platen 14, a rib 14*b* nearest to the sheet guide portion 14*a* has a smooth inclined surface or slope only at a side opposite to the sheet guide portion 14*a* in order to prevent the sheet from being caught by the rib when the sheet is directed toward the sheet guide portion 14*a*. Further, the platen 14 has a recess 14*c* for containing a tip end of the sheet sensor when the sheet is not inserted. The sheet sensor 25 has a tapered portion 25*a* at a side opposite to the sheet guide portion 14*a*. Thus, when the sheet is inserted to exceed the sheet sensor 25 at a side of the sheet sensor 25 remote from the sheet guide portion 14*a* and then is directed toward the sheet guide portion 14*a*, the damage of the sheet and the sheet sensor 25 can be prevented.

[Recording Portion]

The function of the recording apparatus is to effect one-line recording on the sheet by discharging the ink downwardly (in FIG. 3) from the recording head cartridge 1 in response to a recording signal in synchronism with the reciprocal movement of the carrier 2. That is to say, the recording head cartridge 1 has fine liquid discharge openings (orifices), liquid passages, energy acting portions provided within the liquid passages, and energy generating means for generating liquid droplet forming energy acting on the liquid in the acting portions. As a recording method utilizing such energy generating means, a recording method using electrical-mechanical converters such as piezo-electric elements, a recording method in which heat is generated by radiating an electromagnetic wave such as laser and a liquid droplet is charged by the action of the heat, or a recording method in which liquid is heated by an electrical-thermal converter such as a heat generating element having heat generating resistance thereby to discharge the liquid may be used.

Among them, in a recording head used in an ink jet recording method for discharging liquid by thermal energy, since liquid discharge openings for discharging recording liquid to form a discharge liquid droplet can be arranged with high density, recording with high resolving power can be performed. Among them, a recording head using an electrical-thermal converter as an energy generating source can easily be compact, can fully utilize merits of IC techniques and micro-working techniques in which progress of technique and reliability have remarkably been enhanced in a semi-conductor field, can be mounted with high density and can be manufactured cheaply.

Further, after the one-line recording was effected by shifting the recording head cartridge 1, the sheet is conveyed by one line by means of the sheet feeding motor 23 in the conveying direction shown by the arrow in FIG. 10, and then, the next one-line recording is effected.

[Recovery Portion]

A recovery portion has a recovery mechanism (described later) for removing the ink and/or foreign matters accumulated in the nozzles of the recording head cartridge 1. Further, a preliminary discharge operation for removing a small amount of foreign matters and/or ink remaining in the nozzles after the recovery operation is effected. In the preliminary discharge operation, the driving of the recording head for performing normal printing is effected at a predetermined position other than the surface of the sheet P. Disposal ink discharged by these operations is absorbed by the disposal ink absorbing body 327 incorporated into the inner wall of the platen 14.

Figure 31:
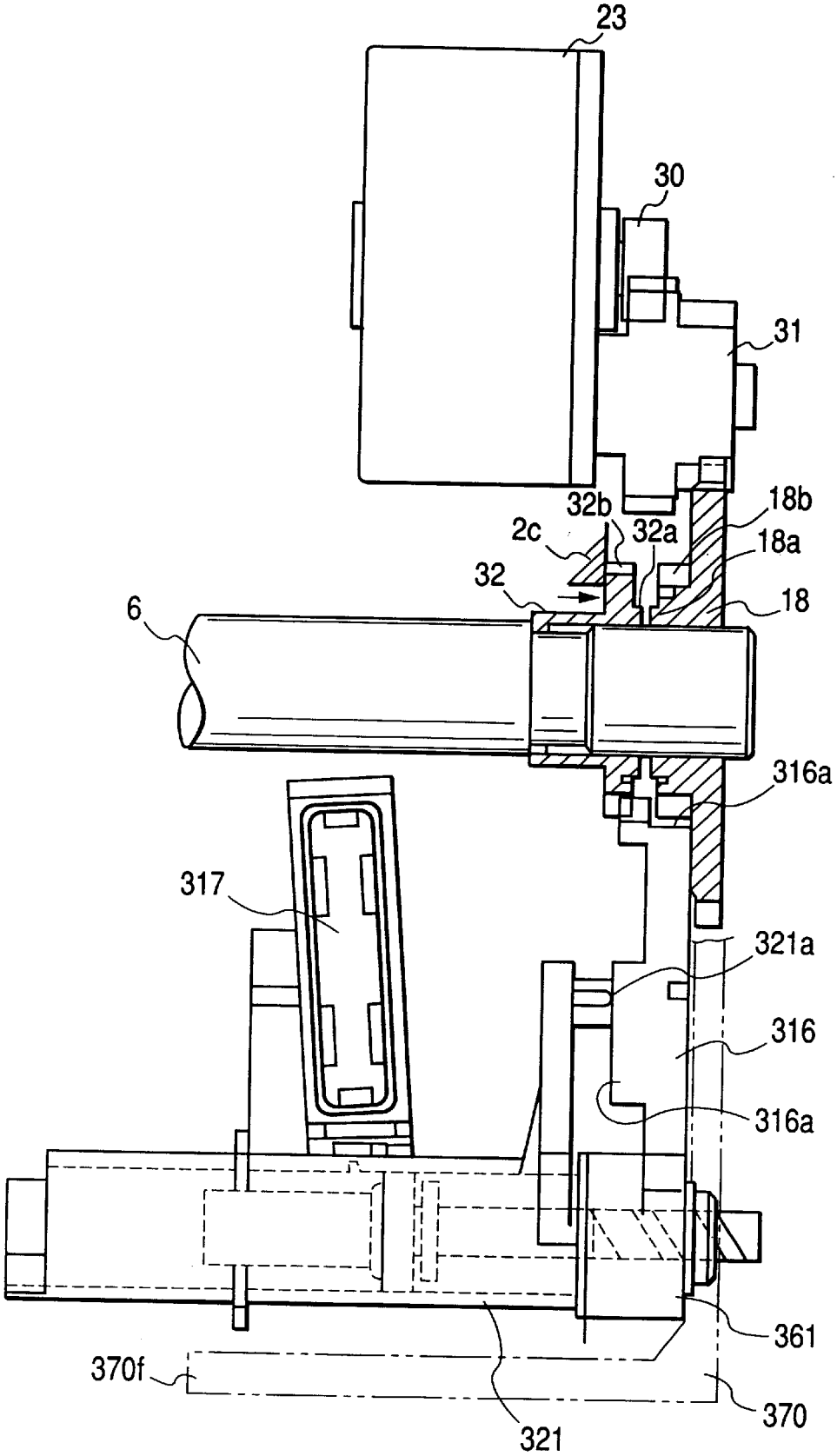
FIG. 31 is a view, partial in section, showing a piston drive transmitting path from a sheet feeding motor of the recording apparatus to a recovery system.

FIG. 31 is a view showing a piston drive transmitting path from the sheet feeding motor 23 to the recovery system of the ink jet recording apparatus. The rotation of the sheet feeding motor 23 is transmitted from the LF motor gear 30 and the LF double gear 31 to the LF gear 18 to rotate the sheet feeding roller 6. When the carrier 2 reaches a non-recording area and a trigger gear 32 (slidably and rotatably mounted on the sheet feeding roller 6 in coaxial therewith) is pressed by a clutch switching projection 2*c* formed on the carrier 2, the trigger gear 32 is shifted toward the LF gear 18, with the result that a driving force of the LF gear 18 is transmitted to the trigger gear 32 due to engagement which will be described later. In this condition, since the trigger gear 32 is meshed with a pump gear 316, the driving force is transmitted to the pump gear 316.

Normally, since the trigger gear 32 is separated from the LF gear 18 and a non-toothed portion of the pump gear 316 is located at an engagement position between the pump gear and the LF gear 18, the driving force from the LF gear 18 is not transmitted to the pump gear 316. At the same time when the LF gear 18 is engaged by the pump gear 316, the carrier 2 is shifted to a capping position, where the ink discharge openings of the recording head cartridge 1 is covered or closed by a cap 317. The pump gear 316 shifts a piston in a cylinder 321 via a cylinder gear 361, with the result that the ink is absorbed from the ink discharge openings of the recording head cartridge 1 into the cylinder 321 through the cap 317, thereby recovering the ink discharging function of the recording head cartridge 1. In this way, the transmission of the driving force from the sheet feeding motor 32 to the pump gear 316 is controlled by the pump gear 316, LF gear 18, trigger gear 32 and carrier 2.

Figure 32:
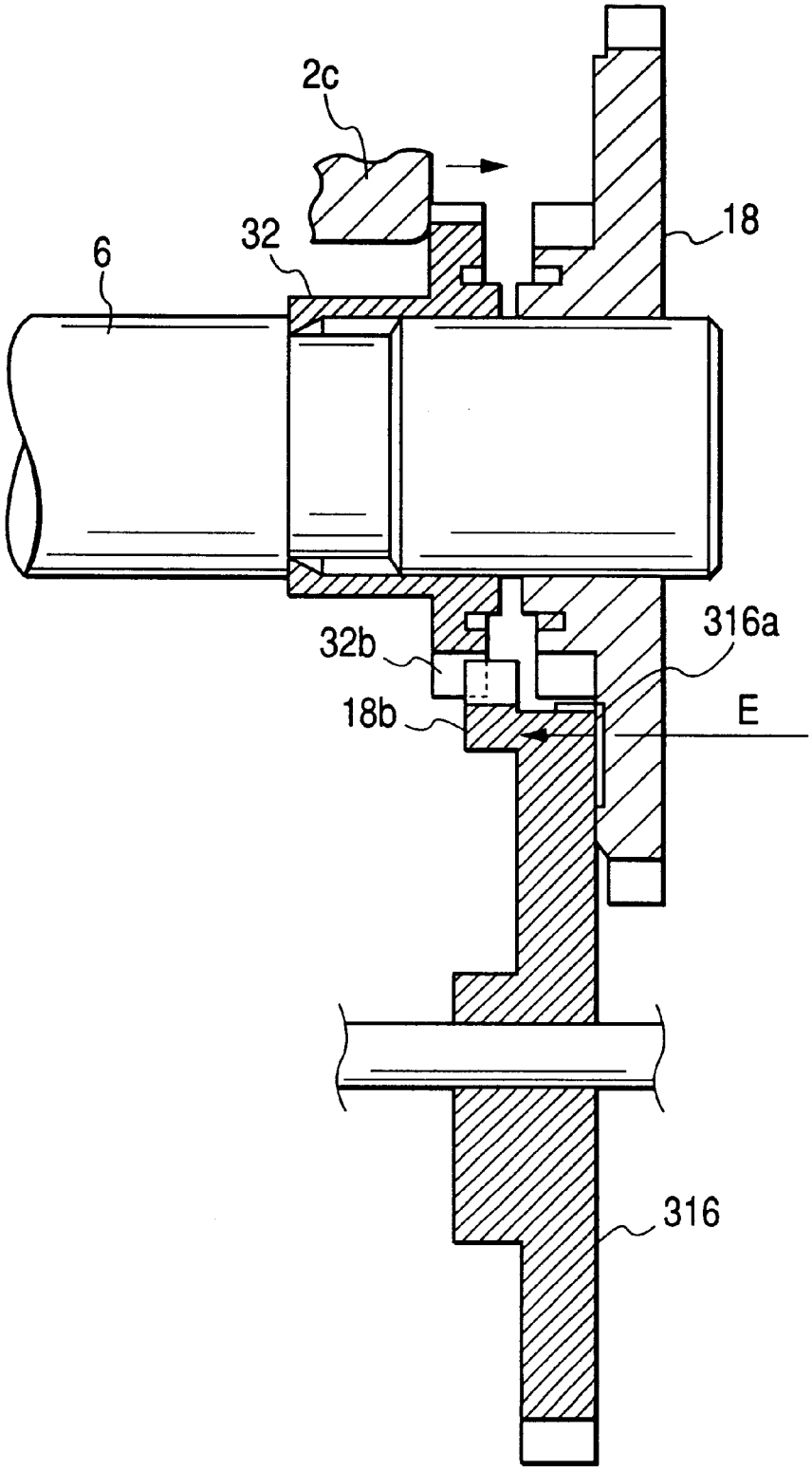
FIG. 32 is a sectional front view showing a switching mechanism of the recording apparatus and therearound.

FIG. 32 is an enlarged view showing a switching mechanism of the ink jet recording apparatus and therearound. The trigger gear 32 is slidably provided on the sheet feeding roller 6 in coaxial therewith. The trigger gear 32 is meshed with the pump gear 316. In this condition, since the trigger gear 32 is separated from the LF gear 18, the driving force from the LF gear 18 is not transmitted to the trigger gear 32. Further, the non-toothed portion of the pump gear 316 is opposed to the LF gear 18, the pump gear does not receive the driving force of the LF gear 18. When the carrier 2 is further shifted toward the LF gear 18, the trigger gear 32 is further shifted toward the LF gear 18 to contact with the LF gear 18. Opposed side surfaces of the trigger gear and of the LF gears are provided with triangular teeth which are to be engaged by each other.

FIGS. 33A, 33B, 34A and 34B are views showing the engagement condition between the LF gear 18 and the trigger gear 32. More specifically, FIG. 32 shows a contact surface configuration 18*a* of the LF gear 18 to be contacted with the trigger gear 32, and FIG. 34B shows a contact surface configuration 32*a* of the trigger gear 32 to be contacted with the LF gear 18. The contact teeth configuration shown in FIGS. 33B and 34B are looked at from directions shown by the arrows. As shown in FIG. 33B, the contact surface configuration is constituted by triangle-shaped teeth 18*a* (referred to as "triangular teeth" hereinafter) each having pitch angles $\alpha$ same as those of gears 18*b* and tooth bottoms aligned with those of the teeth 18*b*. Further, as shown in FIG. 34B, triangular teeth 32*a* constituting the contact surface configuration same as the contact surface configuration 18*a* of the LF gear 18 have a pitch angle $\beta$ the same as those of gears 32*b* and tooth tips aligned with tooth bottoms of the gear 32*b*.

With the arrangements as mentioned above, when the LF gear 18 and the trigger gear 32 are contacted with each other, the tooth bottoms of the triangular teeth of the contact surface 18*a* of the LF gear 18 are meshed with the tooth tips of the triangular teeth of the contact surface 32*a* of the trigger gear 32, so that the gears 18*b*, 32*b* of the LF gear 18 and of the trigger gear 32 become the same phase. Consequently, as the LF gear 18 is rotated, the trigger gear 32 is also rotated. Even when the trigger gear 32 is shifted toward the LF gear 18, since the engagement between the pump gear 316 and the trigger gear 32 is not released, the pump gear 316 is rotated by the rotation of the trigger gear 32.

However, in such indirect drive of the pump gear 316 effected by the LF gear 18 via the trigger gear 32, the driving force is limited.

To cope with this, as shown in FIG. 32, a wider notched portion 316*a* extending in a radial direction are formed on the peripheral portion of the pump gear 316. That is to say, the pump gear 316 has thicker portions than the trigger gear 32 and the LF gear 18, and, further, the peripheral portion of the pump gear 316 is provided with the notched portion having teeth parts of which are notched from the vicinity of an axial center toward one end direction (shown by the arrow E in FIG. 32).

Figure 35:
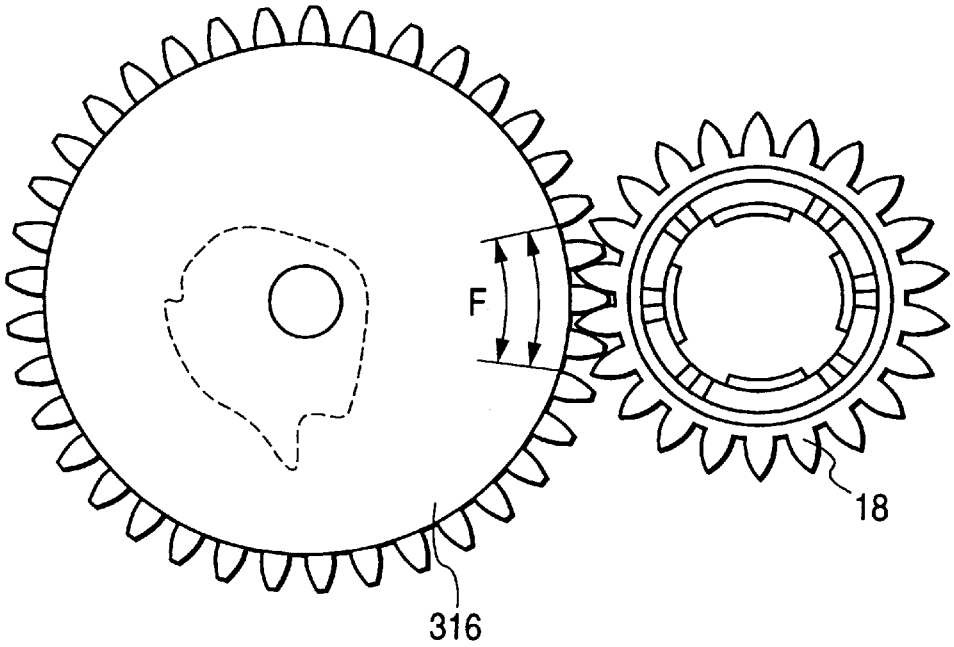
FIG. 35 is a right side view showing a construction of the trigger gear and a pump gear.
Figure 36:
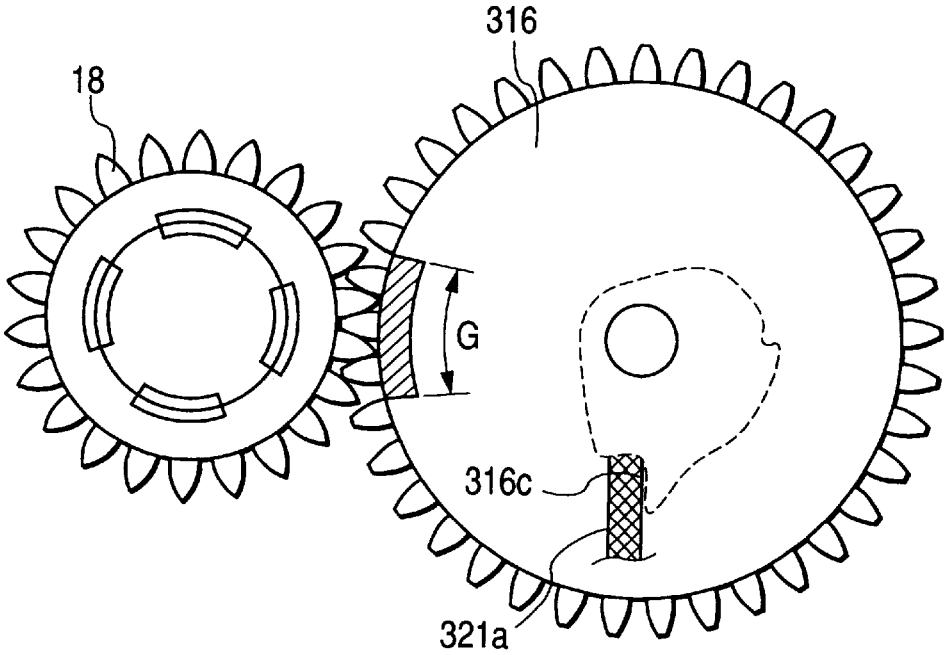
FIG. 36 is a left side view showing the construction of the trigger gear and the pump gear.

FIGS. 35 and 36 are views showing a positional relation between the pump gear and the trigger gear 32, and FIG. 35 is a view looked at from the right side in FIG. 31 and FIG. 35 is a view looked at from the left side in FIG. 31.

As shown in FIG. 36, a width of the notch (shown by the arrow F in FIG. 36) is selected so that, even when the pump gear 316 and the LF gear 18 are in the engagement position, the notched portion 316*a* is not in contact with the LF gear 18. However, when the trigger gear 32 is slightly rotated, the pump gear 316 is rotated to shift the notched portion, with the result that the pump gear 316 is directly engaged by the LF gear 18, thereby providing the great driving force. In this condition, even when the engagement between the trigger gear 32 and the LF gear 18 is released by means of a mechanism (described later) by shifting the carrier 2 away from the LF gear 18, since the pump gear 316 is directly engaged by the LF gear 18, the driving force continues to be transmitted. Further, since the trigger gear 32 is disengaged from the LF gear 18 while shifting in the condition that the trigger gear is still engaged by the pump gear 316, there is no problem regarding interference between the teeth due to the shifting of the trigger gear 32. Since the engagement condition between the pump gear 316 and the trigger gear 32 is not required at the time when the pump gear 316 is engaged by the LF gear 18, an engagement area (hatched portion indicated by the arrow G in FIG. 36) of the pump gear 316 regarding the trigger gear 32 may be greater than at least the notched area. With this arrangement, since the width of the gear other than the engagement portion of the pump gear 316 regarding the trigger gear 32 can be reduced, another mechanism or parts can be installed in such a width-reduced section.

Next, a mechanism for releasing the engagement between the trigger gear 32 and the LF gear 18 after the pump gear 316 is engaged by the LF gear 18 will be explained.

As mentioned above, in the condition that the trigger gear 32 is engaged by the LF gear 18, the triangular teeth formed on the contact surfaces of these gears are engaged by each other. From this condition, even when the carrier 2 is separated from the trigger gear 32 and the LF gear 18 is rotated, the driving force is directly transmitted between the LF gear 18 and the pump gear 316. Since the driving force is not transmitted to the trigger gear 32, the trigger gear 32 tries to maintain the engagement condition between the trigger gear and the LF gear 18 (Actually, the engagement condition may be released due to vibration or the like).

From this condition, the LF gear 18 is rotated reversely in order to release the drive transmission from the LF gear 18 to the pump gear 316. As a result, the notched portion 316*a* of the pump gear reappears again, and, at the same time, the engagement portion (G in FIG. 36) of the pump gear 316 regarding the trigger gear 32 is engaged by the trigger gear 32 again. When the LF gear 18 is further rotated, the direct drive transmission between the pump gear 316 and the LF gear 18 ceases, thereby stopping the pump gear 316.

However, since the trigger gear 32 is further rotated because of the engagement between the trigger gear and the LF gear 18, the drive transmission to the pump gear 316 is effected through the trigger gear 32. In this case, as shown in FIG. 35, in the non-toothed position, since an arm portion 321*a* of the cylinder 321 abuts against a recessed wall 316*c* of the pump gear 316, the pump gear 316 is not rotated. Thus, the trigger gear 32 is subjected to a thrust force directed along surfaces of the teeth of the pump gear 316, with the result that the trigger gear 32 is separated from the LF gear 18. Next, the recovery means comprising the cap, cylinder and the like will be explained with reference to FIGS. 37 to 43.

FIGS. 37 to 43 are explanatory views for explaining an operation of the recovery system according to the illustrated embodiment. The cap 317 made of butyl chloride rubber or other appropriate material having elasticity is integrally held on a cap holder 341. The cap holder 341 is rotatably connected to the arm portion 321*a* of the cylinder 321 via a connection pin 341*b* provided on the cap holder 341. The cylinder 321 includes a piston 342 made of elastic material such as rubber therein, so that negative pressure can be generated within the cylinder 321 by driving a piston shaft 343. Movements of the piston shaft 343 and the piston 342 will be described later.

A joint portion 317*a* is integrally formed with the cap 317. By fitting the joint portion 317*a* onto a joint portion 321*b* of the cylinder 321 with interference, the cylinder 321 and the cap 317 are interconnected in a sealed condition. An ink suction opening for communicating the interior of the cylinder with the cap 317 is formed within the joint portion 321*b* of the cylinder 321.

Next, engagement and disengagement of the cap 317 with respect to the recording head cartridge 1 will be explained with reference to FIGS. 38 to 40. The cap 317 integrally held on the cap holder 341 as mentioned above is sealingly connected to the cylinder 321, and the cap holder 341 is rotatably held by the arm portion 321*a* of the cylinder 321. Although the cap 317 and the cylinder 321 are interconnected via the joint portions 317*a*, 321*b*, since the joint portion 317*a* is made of elastic material such as butyl chloride rubber and is integrally formed with the cap 317 and has an L-shape which can be deformed, the rotation of the cap holder 341 is not obstructed (refer to FIGS. 38, 39 and 40).

Figure 39:
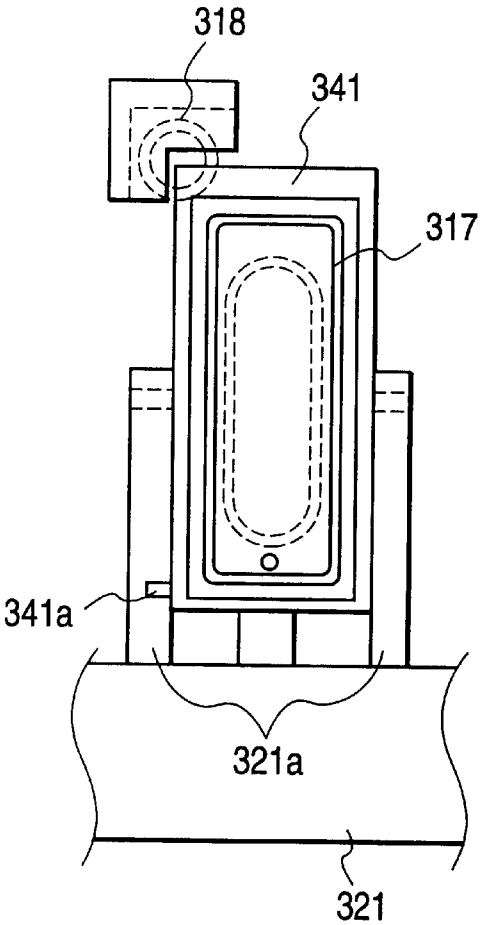
Figure 38:
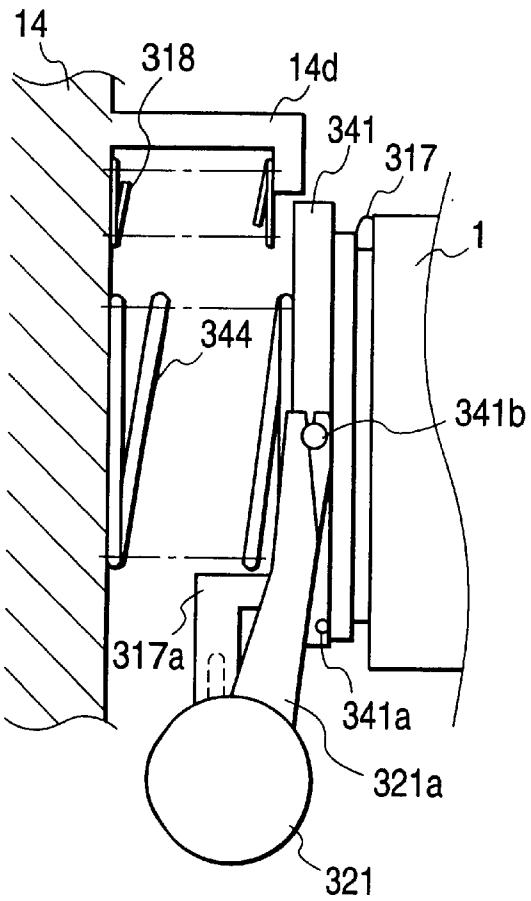

As shown in FIGS. 38 and 39, at a lower part of the cap holder 341, a different diameter compression cap spring 344 is disposed between the platen 14 and the cap holder 341 to always bias the cap holder 341 toward the recording head cartridge. The cylinder 321 is supported by the platen for rotation around a cylinder axis. Accordingly, the cylinder 321 and the cap 317 are subjected to a rotating force from the different diameter compression cap spring 344 for rotation around the cylinder axis.

Figure 37:
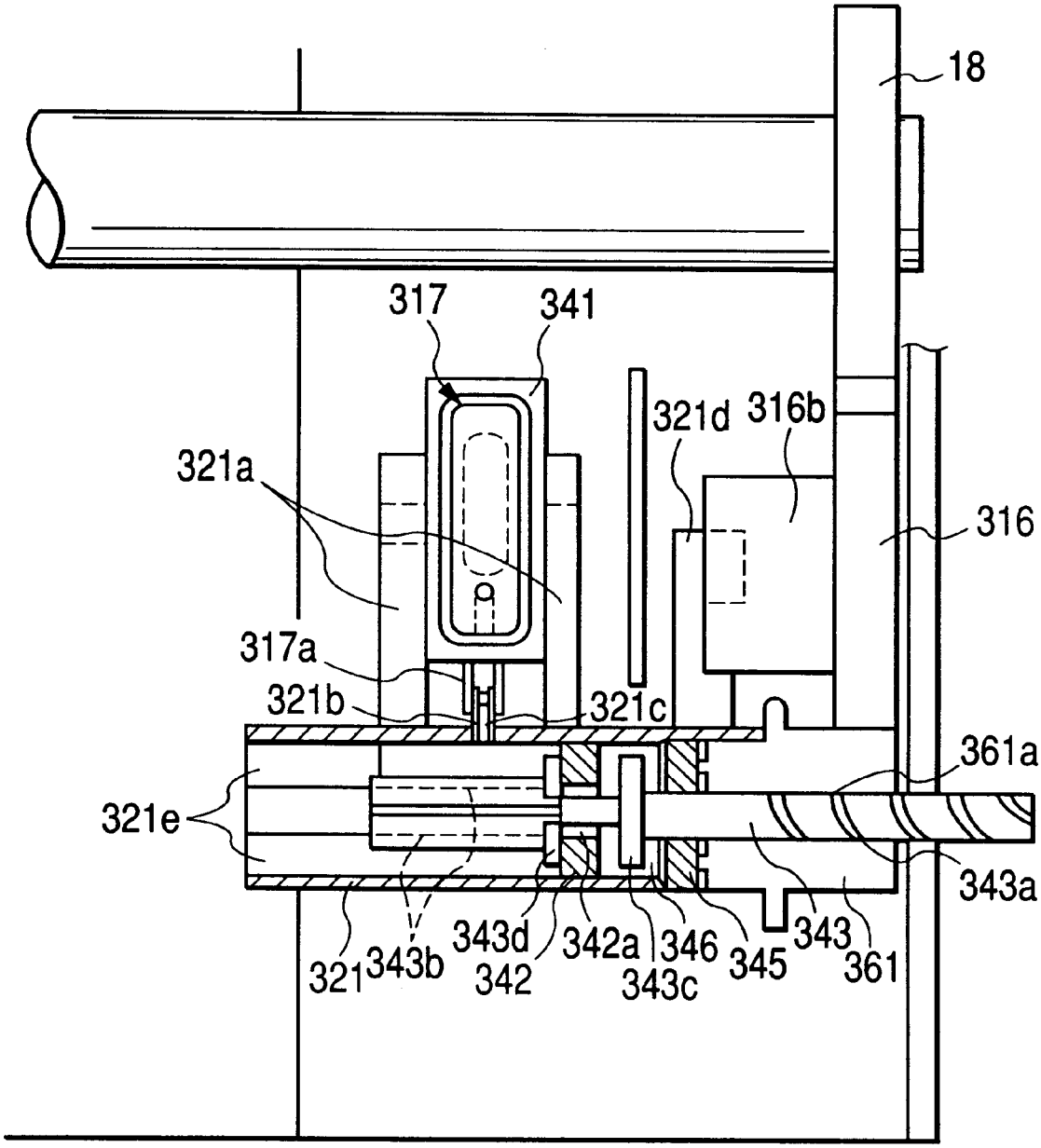
FIG. 37 is an explanatory view for explaining a recovery system to remove disposal ink from a head cartridge.

As shown in FIG. 37, a cylinder control portion 321*d* is integrally formed with the cylinder 321, and a tip end of the cylinder control portion 321*d* abuts against a cap control cam portion (first cam member) 316*b* of the pump gear 316. Accordingly, the rotation of the cylinder is controlled by the cap control cam portion 316*b* of the pump gear 316 via the cylinder control portion 321*d*. That is to say, by shifting the cylinder control portion 321*d* upwardly and downwardly along the cap control cam portion 316*b* of the pump gear 316, the capping and uncapping of the cap 317 with respect to the recording head cartridge 1 can be effected via the cylinder 321.

Figure 40:
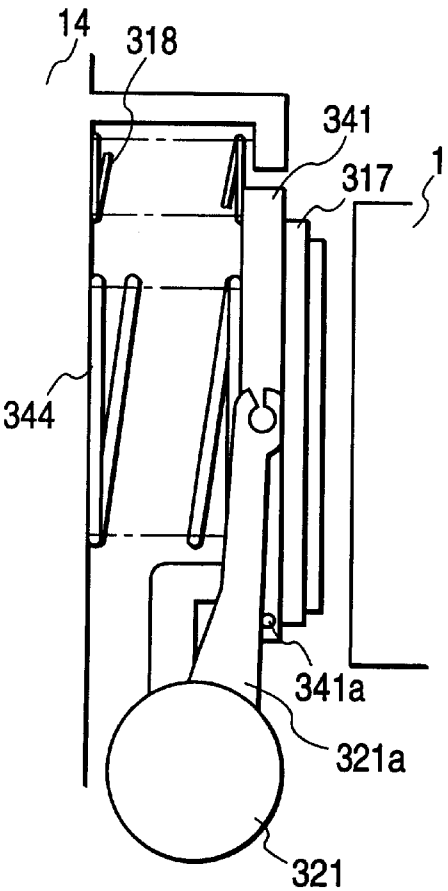
FIGS. 38, 39, 40, 41, 42 and 43 are views for explaining an operation of the recovery system.

FIGS. 38 and 39 show a condition that the cap 317 is engaged by the recording head cartridge 1, and FIG. 40 shows a condition that the cap 317 is disengaged from the recording head cartridge 1. In FIG. 38, the entire length of a cap control spring 318 is regulated by a spring regulating portion 14*d* of the platen 14 so that the cap control spring is spaced apart from the lower surface of the cap holder 341. Accordingly, the engagement condition of the cap 317 is not influenced upon the cap control spring.

FIG. 40 shows a condition that the cylinder 321 is rotated by the rotation of the pump gear 316 to separate the cap 317 from the recording head cartridge 1. In this condition, the cap control spring 318 abuts against the lower surface of the cap holder 341 to provide a clockwise rotating force on the cap holder 341. Thus, the cap holder 341 is rotated in a clockwise direction until a stopper 341*a* of the cap holder 341 abuts against the arm portion 321*a* of the cylinder. By selecting a position of the stopper 341*a* so that the cap 317 and the recording head cartridge 1 become in parallel with each other in this case, when the cap is released, the cap 317 and the recording head cartridge 1 can always be maintained in a parallel relation.

As a result, since the posture is stabilized when the cap is released, even when an uncappling shifting amount of the cap holder 341 is small, the cap 317 is not contacted with the recording head carriage 1 due to inclination of the cap 317 and the cap holder 341, thereby making the apparatus more compact.

Incidentally, the pump gear 316 can selectively be connected to the LF gear 18 so that the driving force of the sheet feeding motor (not shown) is transmitted to the LF gear 18 through a gear train (not shown). Thereafter, when the clutch operation is performed by the movement of the carrier 2, the driving force transmitted to the LF gear 18 is transmitted to the pump gear 316. When the clutch operation is not performed by the carrier 2, since the non-toothed portion is provided in the pump gear 316, the driving force of the LF gear 18 is not transmitted to the pump gear 316.

Now, the movement of the piston shaft 343 and the piston 342 will be explained. In FIG. 37, the pump gear 316 is engaged by a cylinder gear 361. That is to say, when the clutch operation is performed by the carrier 2, the rotation of the LF gear 18 is transmitted to the pump gear 316 and then is transmitted to the cylinder gear 361. Further, a boss 361*a* provided on an inner wall of the cylinder gear 361 is received in a lead groove 343*a* formed in the piston shaft 343 and guides 321*e* of the cylinder 321 are fitted into grooves 343*b* provided at a tip end of the piston shaft 343 so that rotation of the piston shaft 343 is prevented, thereby converting the rotational movement of the pump gear 316 into a straight movement of the piston shaft 343.

Two flange portions 343*c*, 343*d* are integrally formed with the piston shaft 343. A doughnut-shaped piston 342 having a central through hole and made of elastic material such as silicone rubber, NBR rubber or the like is disposed between the flanges. The cylinder 321 and the piston 342 are cylindrical, and an outer diameter of the piston 342 is greater than an inner diameter of the cylinder 321 to provide any interference (about 0.2 to 0.5 mm) therebetween. Accordingly, during the shifting movement of the piston 342, the sealing ability can be maintained between the inner wall of the cylinder and the outer wall of the piston.

A cylinder seal 345 has a doughnut shape, and an outer diameter of the cylinder seal 345 is selected to provide a sealing ability between the seal and the inner wall of the cylinder and an inner diameter of the cylinder seal 345 is selected to provide a sealing ability between the seal and the piston shaft 343. A cylinder washer 346 is locked to a different diameter portion of the cylinder 321. A circumferential rib 342*a* is formed on a side surface of the piston 342 in a confronting relation to the flange 343*c*, and an inner diameter of the piston 342 is greater than an outer diameter of the piston shaft 343 to provide a gap therebetween. Further, a distance between two flanges provided on the piston shaft 343 is greater than a width of the piston 342. Such gaps contribute to the discharging of the sucked ink, which will be described later. As shown in FIG. 37, in an initial condition of the pump, the piston shaft is lifted to urge the piston 342 against the flange 343*d* (FIG. 37).

Figure 41:
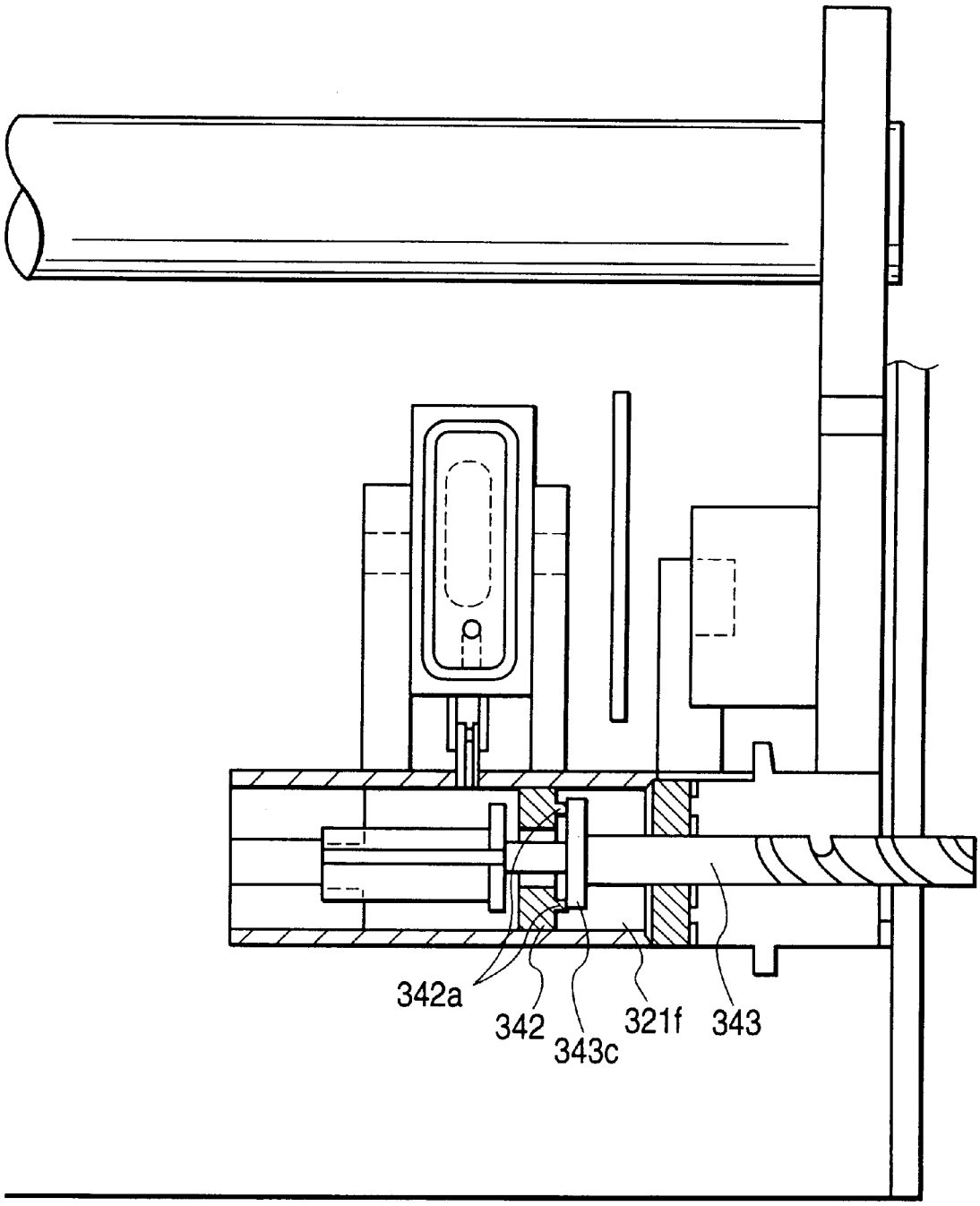
Figure 42:
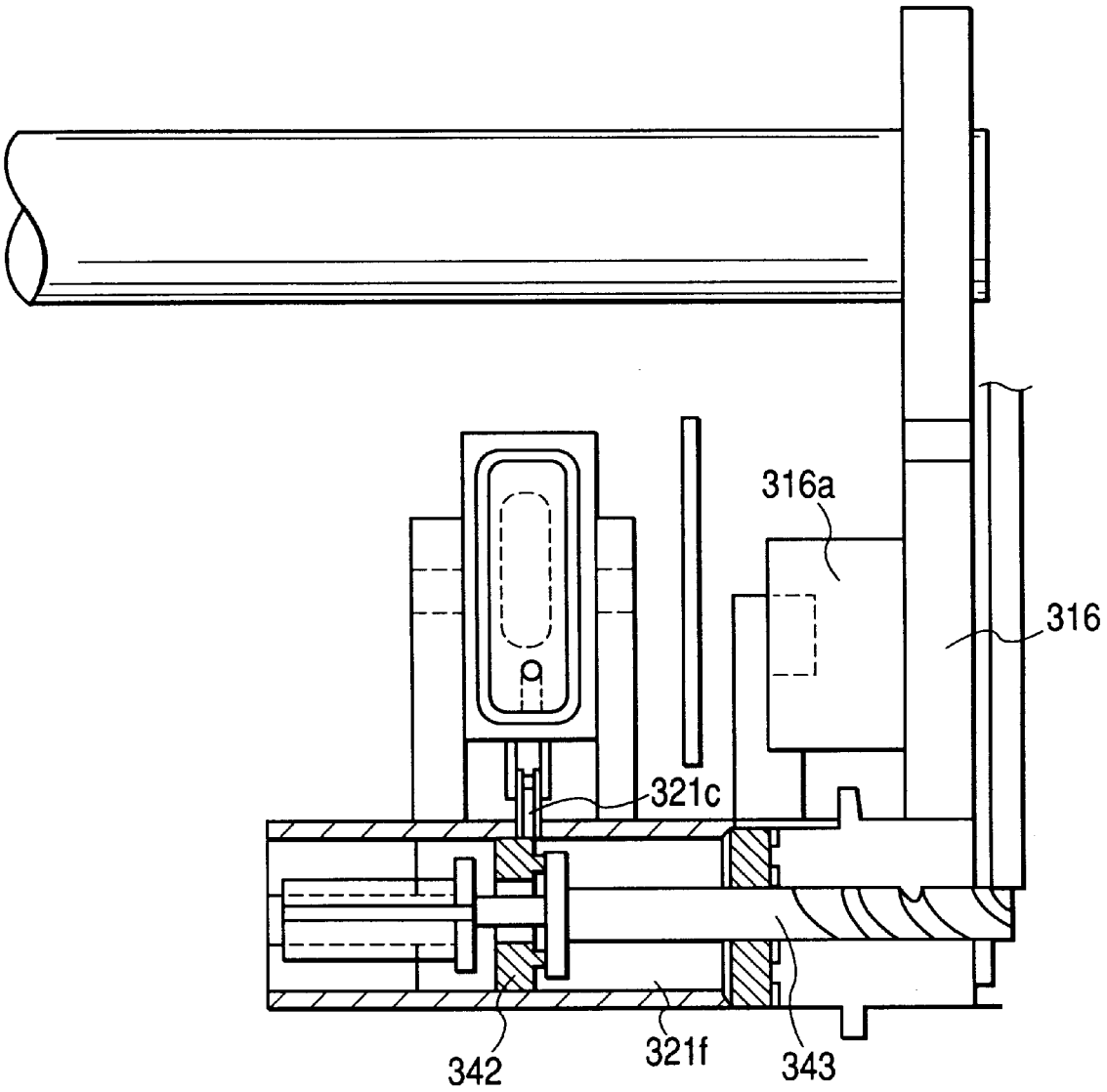

Then, a suction signal is emitted from an MPU, the clutch operation is performed by the carrier 2, with the result that the driving force is transmitted from the LF gear 18 to the pump gear 316 and the cylinder gear 361 and then the rotation of the cylinder gear 361 is converted into the straight movement of the piston shaft 343. When the piston shaft 343 is shifted to the right (FIG. 37), as shown in FIG. 41, the flange 343*c* is urged against the rib 342*a* on the side surface of the piston, with the result that a space 321*f* at the right side of the piston 342 becomes a sealed condition. When the piston shaft 343 is further shifted to the left, since the volume of the space 321*f* is increased while keeping the sealed condition, the pressure in the space 321*f* is gradually decreased below atmospheric pressure (negative pressure condition). The negative pressure is gradually increased as the piston shaft 343 (piston 342) is shifted and reaches a maximum value immediately before the end of the side surface of the piston 342 passes by the ink suctio nopening 321*c* (FIG. 42).

The reason is that, if the space 321*f* is communicated with the ink suction opening 321*c*, since ink or air flows into the space 321*f* through the ink suction opening and the cap 317, the negative pressure in the space 321*f* disappears.

In this case, by forming the cap control cam portion 316*b* of the pump gear 316 so that when the piston 342 passes through the ink suction opening 321*c* the recording head cartridge 1 is sealingly closed by the cap 317, the ink can be sucked.

Figure 43:
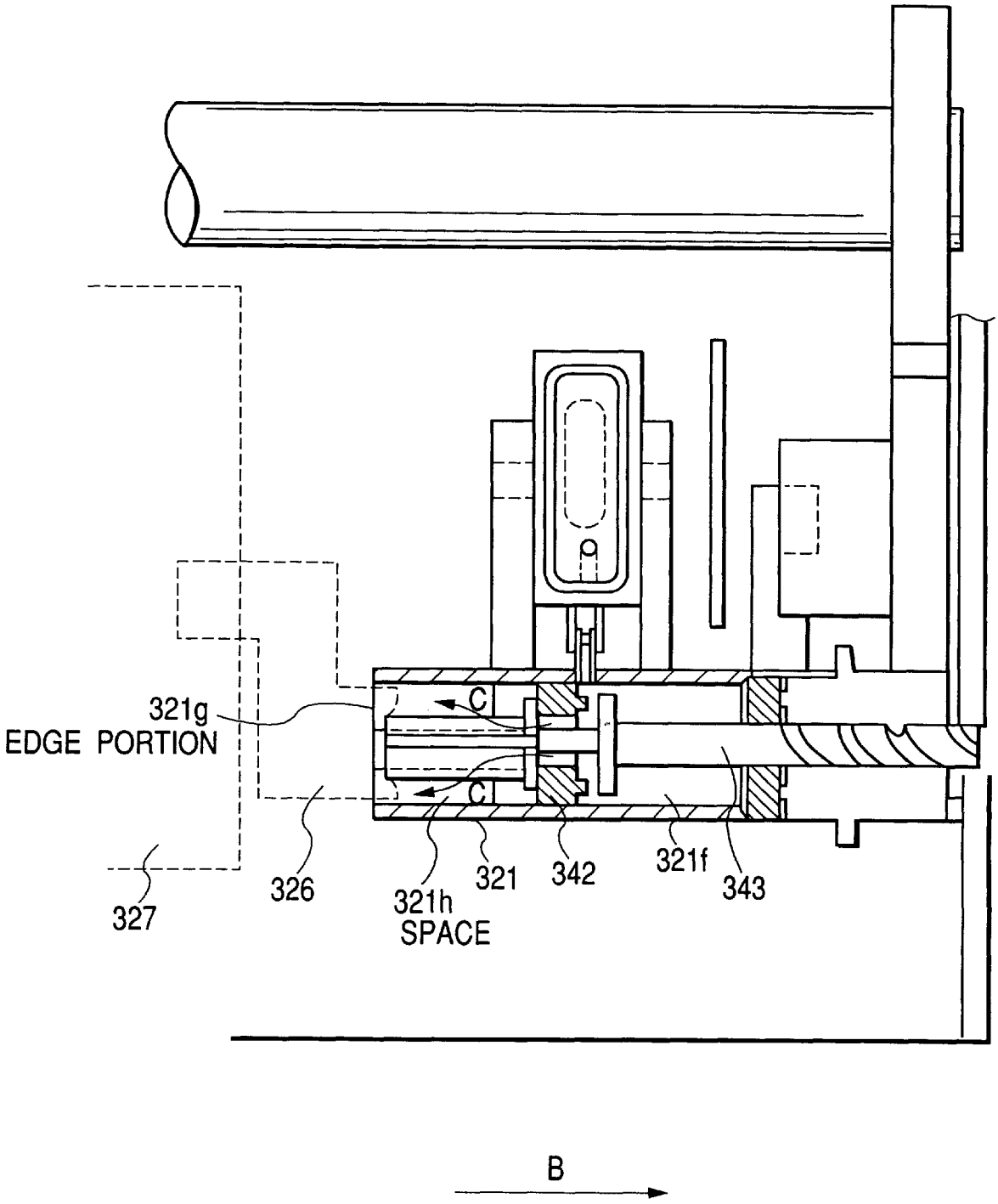

Next, the discharging of the ink in the cylinder will be explained with reference to FIG. 43.

As mentioned above, the ink absorbed from the recording head cartridge 1 is accumulated in the space 321*f* of the cylinder. Then, when the motor is driven reversely, the piston shaft 343 is shifted to the right shown by the arrow B in FIG. 43. As a result, since the width of the piston 342 is smaller than the distance between the flanges of the piston shaft 343 and the inner diameter of the piston is greater than the outer diameter of the piston shaft 343, as the piston shaft 343 (piston 342) is shifted to the right, the ink within the space 321*f* flows to a space 321*h* at a left side of the piston 342 through the gap between the piston 342 and the piston shaft 343 (as shown by the arrows C in FIG. 43).

Accordingly, by repeating reciprocal movement of the piston shaft (piston 342), the ink is gradually discharged through an end 321*g* of the cylinder 321.

A cylinder absorbing body 326 is inserted into the cylinder end 321*g*. The cylinder absorbing body 326 is formed from material having good ink transferring ability such as a foam sponge. That is to say, an ability for effectively discharging the ink in the cylinder 321 outside is required for the cylinder absorbing body, and, thus, in the illustrated embodiment, the cylinder absorbing body is formed from foam material selected from a melamine resin group. The cylinder absorbing body 326 is contacted with the disposal ink absorbing body 327 contained within the platen 14. For example, the disposal ink absorbing body 327 is formed from material having high ink holding ability such as a laminated sheet or a polymer absorbing body.

With the arrangement as mentioned above, the disposal ink absorbed from the recording head cartridge 1 is transmitted to the disposal ink absorbing body 327 through the cylinder and the cylinder absorbing body 326 and is held therein. In the illustrated embodiment, a volume of the disposal ink absorbing body. 327 itself is about 120 $cm^3$, and it was found from tests that an amount of ink which can be held by the disposal ink absorbing body is about 84 $cm^3$ (about 70% of the body volume).

Figure 44:
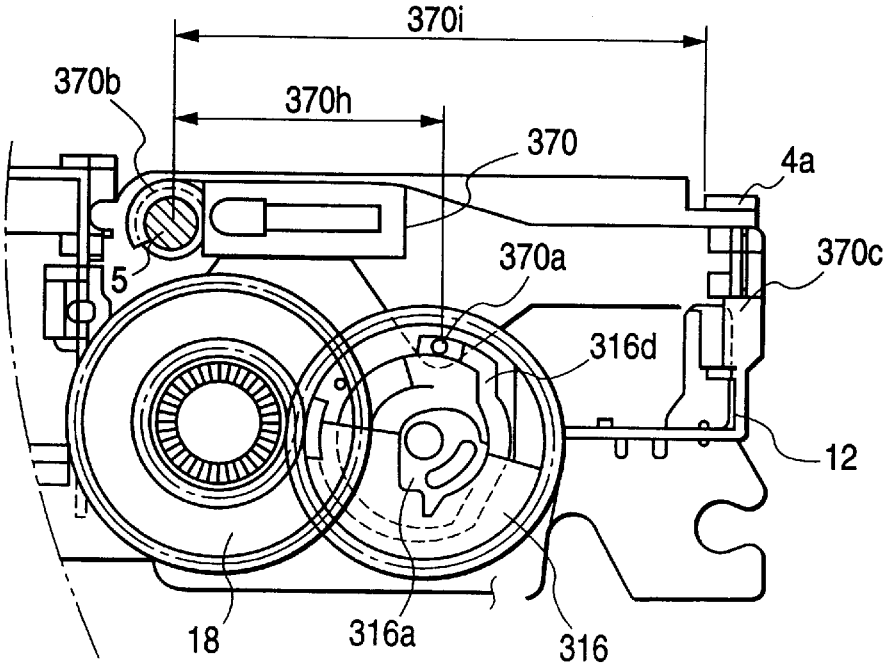
FIG. 44 is a view showing a release condition of a lock arm of an ink jet recording apparatus, looked at from the left in FIG. 31.
Figure 45:
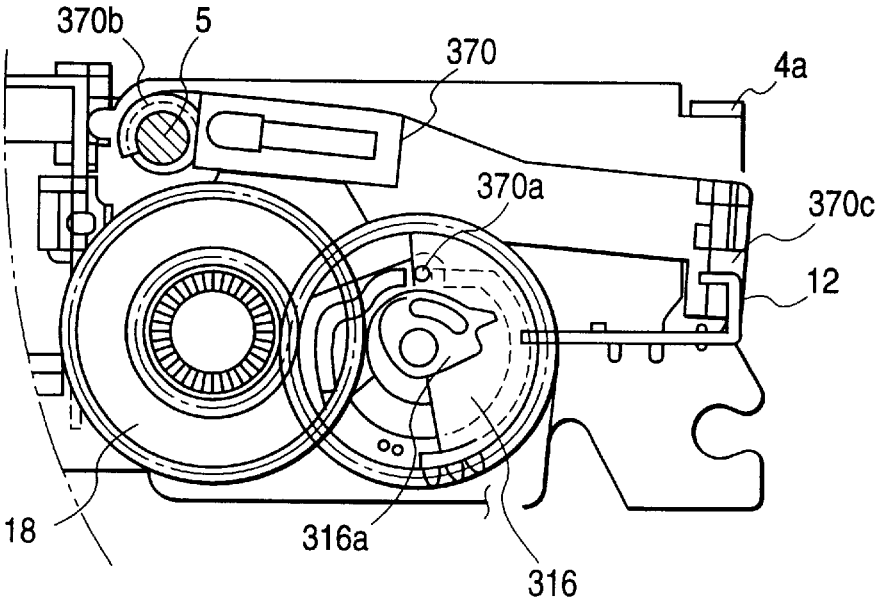
FIG. 45 is a view showing a locked condition of the lock arm, looked at from the left in FIG. 31.
Figure 46:
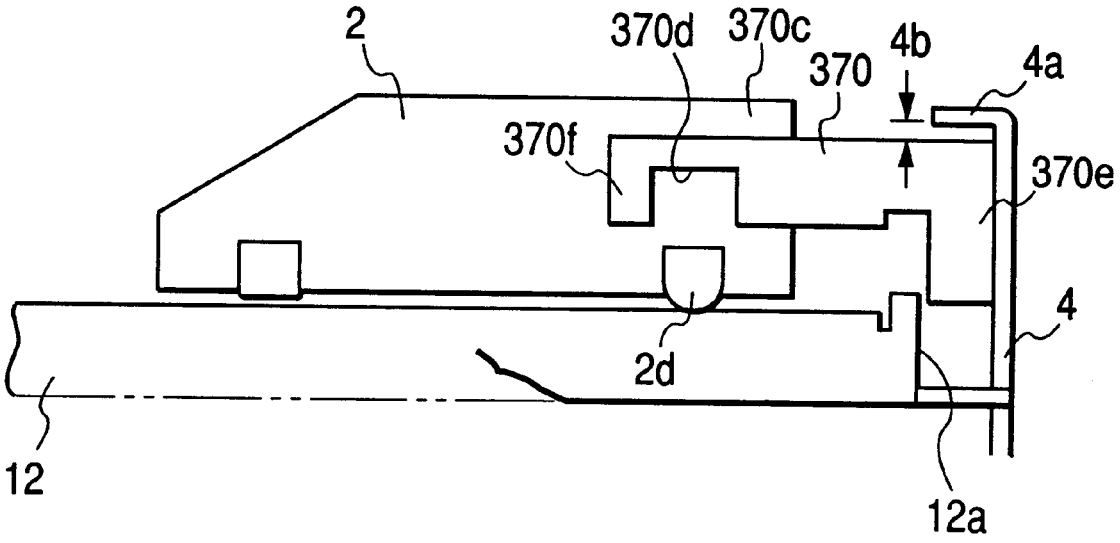
FIG. 46 is a view showing a carriage release condition of the lock arm, looked at from a front side in FIG. 31.
Figure 47:
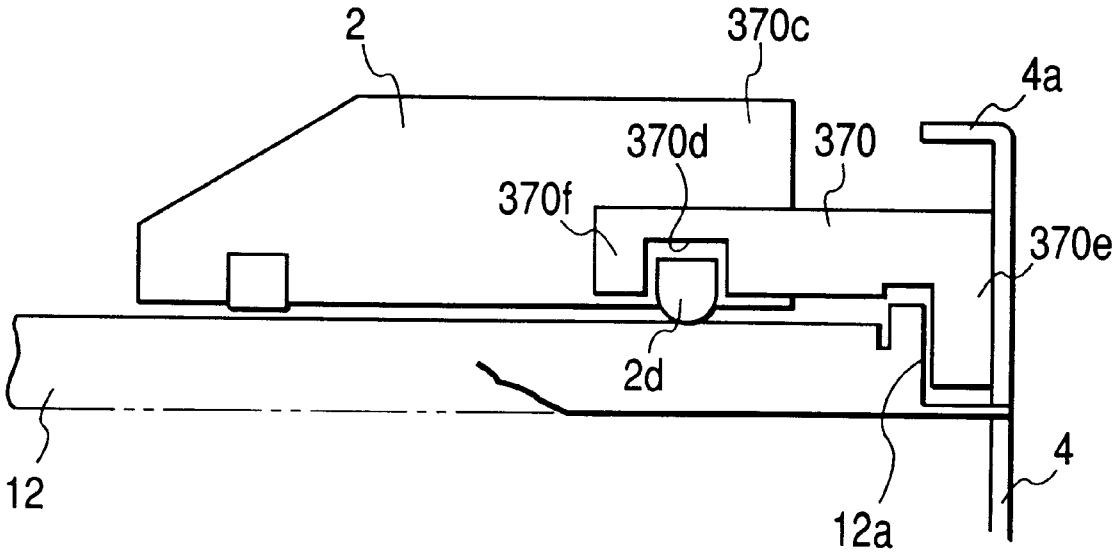
FIG. 47 is a view showing a carriage locking condition of the lock arm, looked at from the front side in FIG. 31.

Next, an operation in which a lock arm (arm member) 370 is controlled by the pump gear 316 to secure or fix t he carrier 2 will be explained with reference to FIGS. 3, 31, 33 and 44 to 47. FIG. 44 shows a released condition of the lock arm according to the illustrated embodiment, looked at from the left in FIG. 31. FIG. 45 shows a locked condition of the lock arm, looked at from the left in FIG. 31. FIG. 46 shows a carrier releasing condition obtained by the lock arm 370, looked at a front side in FIG. 31. FIG. 47 shows a carrier locking condition obtained by the lock arm according to the illustrated embodiment, looked at from the front side in FIG. 31.

As explained in connection with the recovery operation, the cap control cam portion 316*b* for controlling the opening and closing of the cap 317 via the arm portion 321*a* of the cylinder 321 is provided on the left (FIG. 31) side surface of the pump gear 316. On the other hand, the right (FIG. 31) side surface of the pump gear 316 is provided with a groove-shaped lock control cam portion (second cam member) 316*d* for engaging by a boss portion 370*a* of the lock arm 370 and for effecting locking and unlocking of the carrier 2 via the lock arm 370. In FIGS. 44 and 45, the boss portion 370*a* of the lock arm 370 is engaged by the lock control cam portion 316*d* of the pump gear 316. As shown in FIGS. 3 and 31, the lock arm 370 is arranged within a range substantially equal to a width of the gear train including the LF gear 18 and the pump gear 316 at the right part of the apparatus and is disposed outside of the shifting movement range of the carrier 2 on which the recording head cartridge 1 is mounted.

Now, the mounting condition of the lock arm 370 will be described with reference to FIGS. 44 and 45. A rotation center portion 370*b* of the lock arm 370 is formed as a bearing a part of which is opened, and is rotatably supported on the guide shaft 5. Incidentally, the rotation center portion 370*b* has elasticity and is supported on the guide shaft 5 by forcibly fitting the opened portion of the rotation center portion 370*b* onto the guide shaft 5 from the above. The boss portion 370*a* is provided substantially at a central portion of the lock arm 370 and is engaged by the lock control cam portion 316*d* of the pump gear 316.

Further, the lock arm 370 extends from the rotation center portion 370*b* toward the boss portion 370*a* and is provided with a lock portion 370*c*. As shown in FIGS. 3 and 31, the lock portion 370*c* of the lock arm 370 is formed as an L-shape at a tip end of the elongated member extending from the rotation center portion 370*b* toward the boss portion 370*a*. Further, as shown in FIGS. 46 and 47, the lock portion 370*c* is provided with a carrier fixing portion 370*d* engageable with a lock projection 2*d* of the carrier 2 and a regulating portion 370*e* engageable between an arm engaging portion 12*a* of the guide rail 12 and the frame 4.

Now, a method in which the carrier 2 is locked and unlocked by the lock arm 370 will be explained with reference to FIGS. 44 and 46.

As explained in connection with above mentioned transmission of driving and recovery system, the pump gear 316 exists in an initial condition as shown in FIG. 44. In this condition, the driving force of the LF gear 18 is not transmitted to the pump gear 316 and the cap (not shown) is uncapped or released by the cap control cam portion 316*b*. In the initial condition, the lock arm 370 is lifted upwardly around the rotation center portion 370*b* by the boss portion 370*a* and the lock control cam portion 316*d* of the pump gear 316. As a result, the lock portion 370*c* is located at an elevated position. FIG. 46 shows a positional relation between the L-shaped portion of the lock portion 370*c* and the carrier 2. The carrier fixing portion 370*d* is positioned above the lock projection 2*d* of the carrier 2 so that the carrier 2 can be shifted.

Next, a condition that the carrier 2 is secured or fixed by the lock arm 370 will be explained with As explained in connection with the drive transmitting and recovery systems, the pump gear 316 is capped as shown in FIG. 45. That is to say, the lock arm 370 is lowered downwardly by lowering the boss portion 370*a* by means of the pump gear 316 and the lock control cam portion 316*d*. The lock portion 370*c* is also lowered. In this condition, FIG. 47 shows an engagement condition between the L-shaped portion of the lock portion 370*c* and the carrier 2. The carrier fixing portion 370*d* is engaged by the lock projection 2*d* so as not to permit the shifting movement of the carrier 2. Further, the regulating portion 370*e* is located between the arm engaging portion 12*a* of the guide rail 12 and the frame 4. Thus, even if the carrier 2 tries to be forcibly moved, the movement of the carrier 2 is prevented positively by the lock portion 370*c* of the lock arm 370 and useless force does not act on the rotation center portion 370*b* and the boss portion 370*a*, thereby providing a stable operation.

As shown in FIGS. 3 and 31, a tip end 370*f* of the lock arm 370 is located at the left of the cap 317. For example, if the carrier 2 is separated from the cap 317 for any reason to position the cap at a position same as the position where the cap 317 is mounted to the carrier 2, when the carrier 2 tries to be forcibly shifted to the cap position, since the cap 317 is in a convex condition, the cap 317 may be damaged by the carrier 2 and the recording head cartridge 1 or the recording head cartridge 1 may be damaged by the cap 317. To avoid this, as shown in FIGS. 3 and 31, since the tip end 370*f* of the lock arm 370 is extended, the lock projection 2*d* of the carrier 2 is prevented from shifting the cap mounting position by the tip end 370*f*, thereby preventing the damage of the cap or the recording head cartridge.

In FIGS. 44 to 47, an arm stopper 4*a* provided on the frame 4 is located above the lock arm 370 with a clearance 4*b* between the stopper and the upper surface of the lock arm 370 in the released condition shown in FIG. 46. The clearance 4*b* is selected to have the following relation with respect to a chamfered dimension 370*g* (FIG. 50) of the tip end of the boss portion 370*a* of the lock arm, a distance 370*h* (FIG. 44) between a rotation center of the lock arm and the center of the boss portion 370*a*, and a distance 370*i* between the rotation center and the arm stopper 4*a:*

Now, a condition that shock due to dropping is applied to the recording apparatus is considered. Normally, the carrier 2 is fixed by the lock arm 370. That is to say, the conditions shown in FIGS. 45 and 47 are maintained. If the recording apparatus is erroneously dropped with the upper surface thereof facing downwardly, strong inertia force directing upwardly in FIG. 47 acts on the lock arm 370 (According to tests, even when the recording apparatus is dropped at a height of 30 cm, acceleration of 150 to 200 G is applied to the apparatus). Although the boss 370*a* of the lock arm 370 can be held by the engagement between the boss portion and the lock control cam portion 316*d* of the pump gear 316 for a certain value of the force, if a greater force is applied, the pump gear 316 and the platen 14 supporting the pump gear are elastically deformed to prevent the damage of the boss portion 370*a*, with the result that the boss portion 370*a* is disengaged from the lock control cam portion 316*d* due to the deformation of the pump gear 316.

Figure 48:
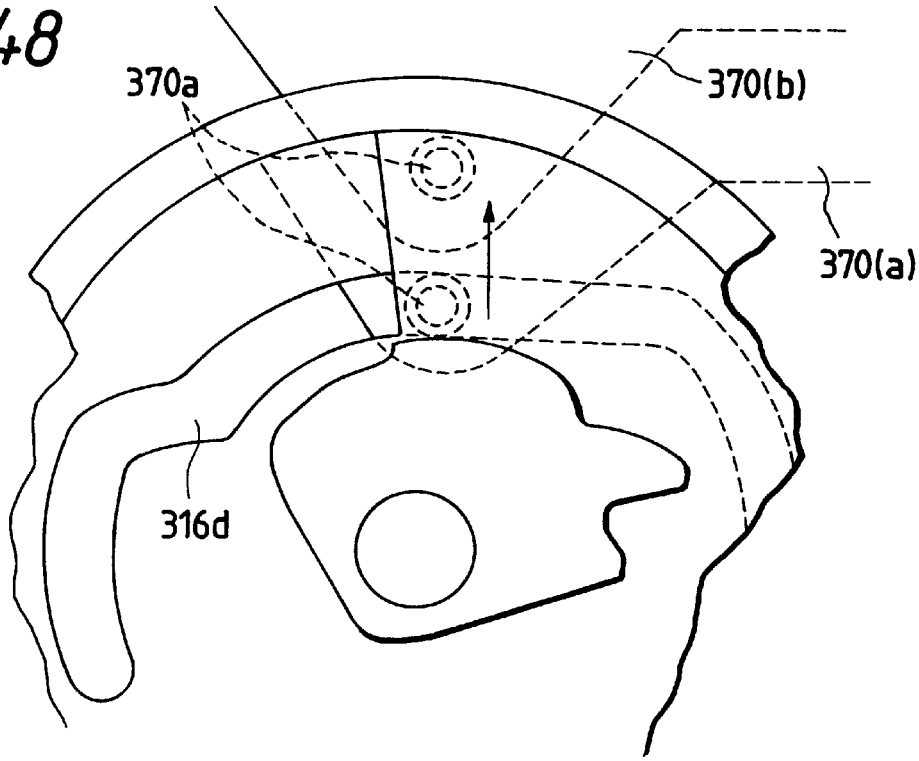
FIG. 48 is a view showing conditions that the locked and that the lock arm is unlocked by an external force, looked at from the left in FIG. 31.
Figure 49:
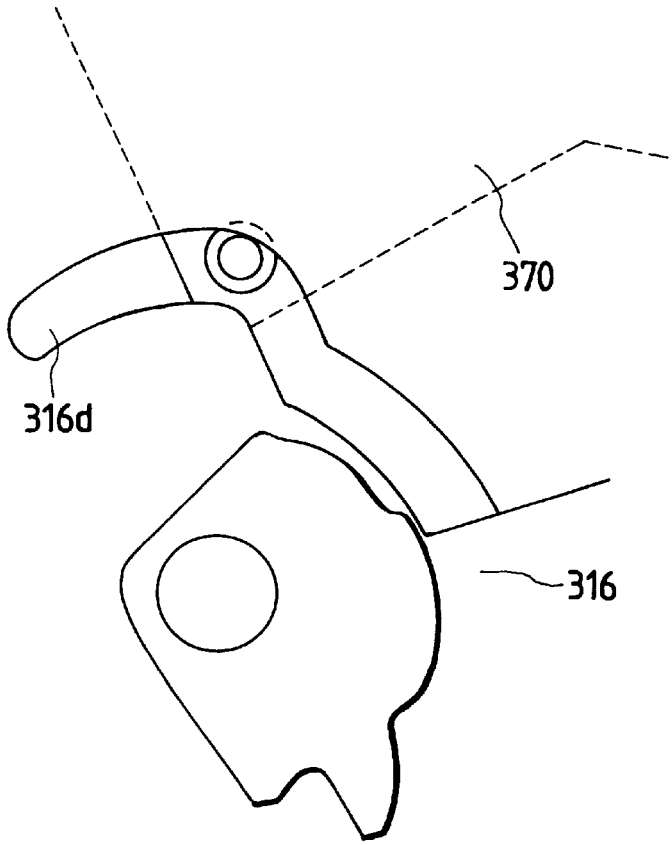
FIG. 49 is a view showing a condition that the lock arm is returned to a predetermined position, looked at from the left in FIG. 31.
Figure 50:
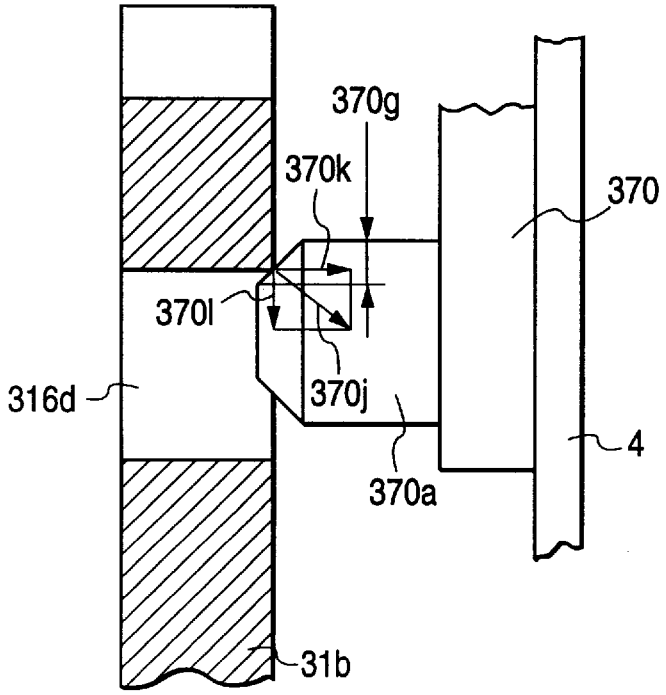
FIG. 50 is a sectional view showing engagement between the pump gear of FIG. 49 and boss portion of the lock arm.

Such a case will be explained with reference to FIGS. 48, 49 and 50. FIGS. 48 and 49 are enlarged views of the pump gear 316. In FIG. 48, the pump gear 316 is located at the position where the carrier 2 is fixed by the lock arm 370, and the position of the lock arm 370 in the normal condition is shown by the reference numeral 370(*a*).

If the shock is applied, in FIG. 48, since the boss portion 370*a* is disengaged from the lock control cam portion 316*d*, the lock arm 370 is shifted upwardly (shown by the arrow in FIG. 48). However, since the lock arm 370 abuts against the arm stopper 4*a* and is stopped there, the lock arm is stopped at a position shown by the reference numeral 370(*b*). In this condition, when the operator turns ON the power source, since the recording apparatus performs initialization, the cap releasing operation is firstly effected. That is to say, the pump gear 316 is rotated in the clockwise direction (FIG. 49).

Although the boss portion 370*a* of the lock arm is disengaged from the lock control cam portion 316*d*, a portion of the chamfered tip end of the boss portion 370*a* is always remained within the lock control cam portion 316*d* due to the presence of the clearance 4*b*. This condition is shown in FIG. 50 (sectional view). Since one side of the lock arm 370 is received by the frame 4, the lock arm is not inclined. The pump gear 316 is retarded by the boss portion

370*a*. Further, the portion of the chamfered tip end of the boss portion 370*a* enters into the lock control cam portion 316*d*. In this case, a force 370*j* which is received by the lock arm 370 due to repelling force of the pump gear 316 can be divided into a force component 370*k* and a force component 370*l*, and the force component 370*l* tries to shift the lock arm 370 downwardly.

In this condition, when the pump gear 316 is further rotated in the clockwise direction in FIG. 49, since the lock control cam portion 316*d* is slidingly shifting on the tip end of the boss portion 370*a*, the boss portion 370*a* of the lock arm 370 is shifted downwardly to be returned within the lock control cam portion 316*d*.

Accordingly, even if the operator erroneously drops the recording apparatus, by turning ON the power source again, the recording apparatus can be returned to the normal condition. Further, since the strength of the boss portion 370*a* of the lock arm 370 and/or pump gear 316 and/or platen 14 are not required to be increased excessively, a compact recording apparatus having light weight and high reliability can be provided.

Figure 51:
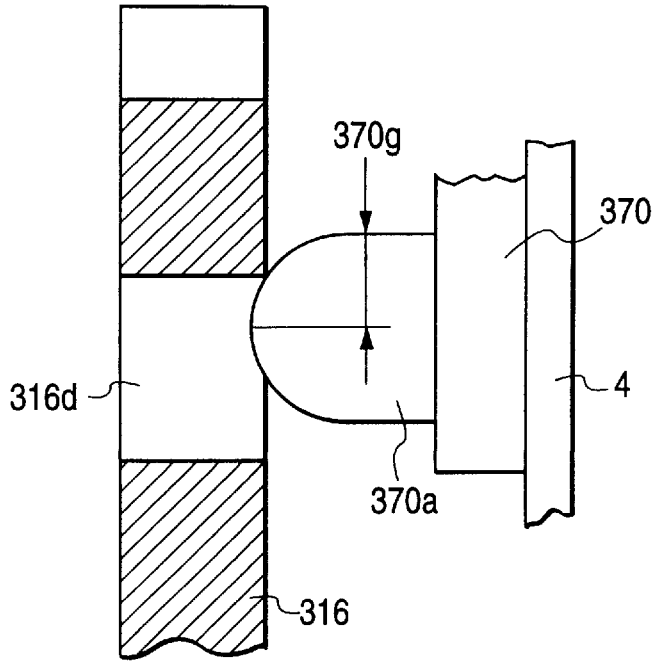
FIG. 51 is a sectional view showing the engagement between the pump gear and the boss portion in FIG. 50 when a tip end of the boss portion is spherical.

FIG. 51 shows another embodiment in which a tip end of the boss portion 370*a* is semi-spherical. In this case, a radius of the sphere corresponds to the chamfered dimension 370*g*. Of course, it is not necessary that the cylindrical boss is chamfered along the circumference, but, one surface of a prismatic boss may be chamfered. It is enough that there is a certain amount chamfer in a direction regulated by the stopper.

The recording apparatus also has a mechanism for detecting, with high accuracy, an amount of the disposal ink discharged from the recording head cartridge by the recovery means and collected in the disposal ink absorbing body 327, which will be described hereinbelow. An EEPROM 509 (FIG. 16) disposed on the control substrate plate 57 includes a four-byte area (referred to as "preliminary discharge counter" hereinafter) for integrating or calculating the amount of ink discharged by the preliminary discharge operation with a unit of 1 ng ($10^{-9}$ g), a two-byte area (referred to as "evaporation part counter" hereinafter) for integrating or calculating an amount of ink (occupying a predetermined ratio of the amount of ink discharged by the recovery operation) which is assumed to be evaporated as time goes on with a unit of 10 mg ($10^{-2}$ g), a two-byte area (referred to as "non-evaporation part counter" hereinafter) for integrating or calculating an amount of ink (occupying a predetermined ratio of the amount of ink discharged by the recovery operation) which is assumed not to be evaporated in the feature with a unit of 10 mg ($10^{-2}$ g), and a one-byte area (referred to as "disposal ink timer" hereinafter) for storing a time period elapsed from the previous disposal ink amount calculation to the present time with a unit of minute(s).

Figure 52:
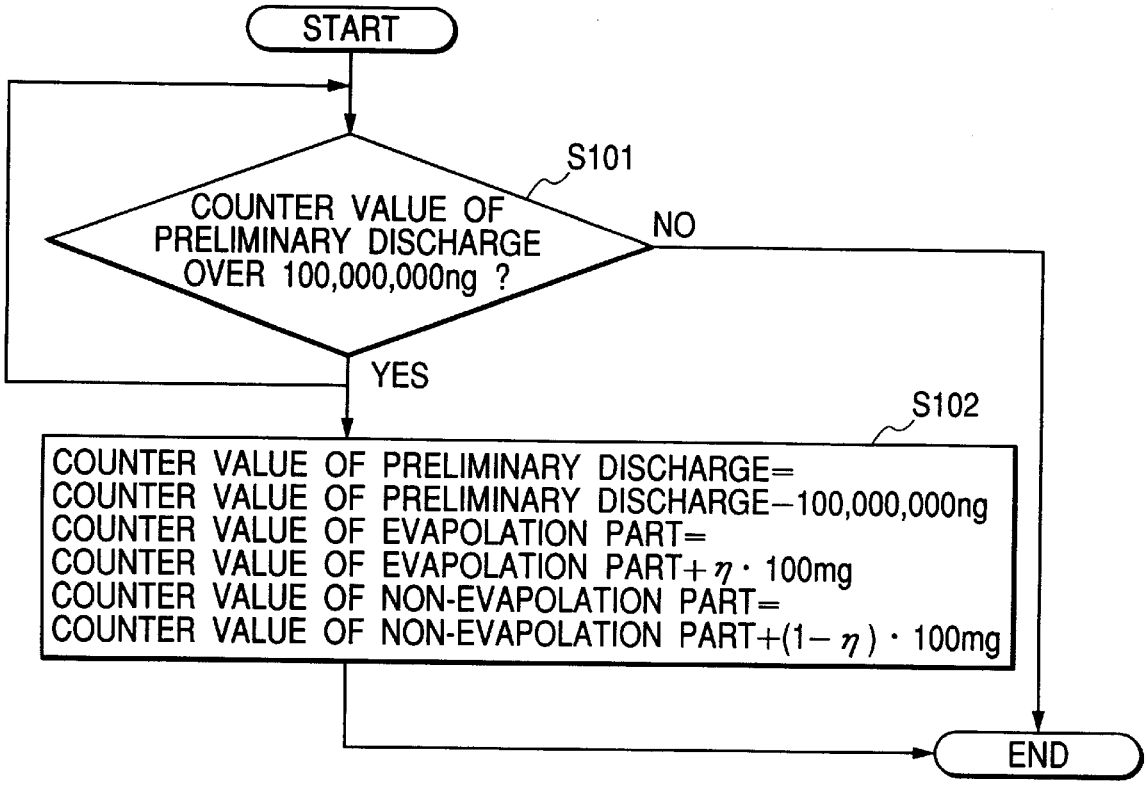
FIG. 52 is a flowchart for preliminary discharge counter check.

At each point, the total amount of the disposal ink contained in the disposal ink absorbing body 327 is determined by the sum of a value of evaporation part, a value of non-evaporation part and a value of the preliminary discharge counter. When the preliminary discharge is effected during the recovery operation, prior to the sheet supplying operation or during the recording operation, the sum of the preliminary discharge amount depending upon the number of discharges from each nozzle and an amount of ink per one discharge is added to the preliminary discharge counter. Although the preliminary discharge counter is capable of calculating up to about 4,000 mg, as indicated in a flowchart for preliminary discharge counter check shown in FIG. 52, at a point where 100,000,000 ng (100 mg) is exceeded, the ink amount is divided into the evaporation part and the non-evaporation part with a predetermined ratio, and the divided values are added to the evaporation part and non-evaporation part counters. When the ink is discharged by the recovery operation, in accordance with the kind of the recording head cartridge 1 and the kind of the recovery operation, the previously stored discharge amounts are added to the evaporation part and non-evaporation part counters, respectively.

Figure 53:
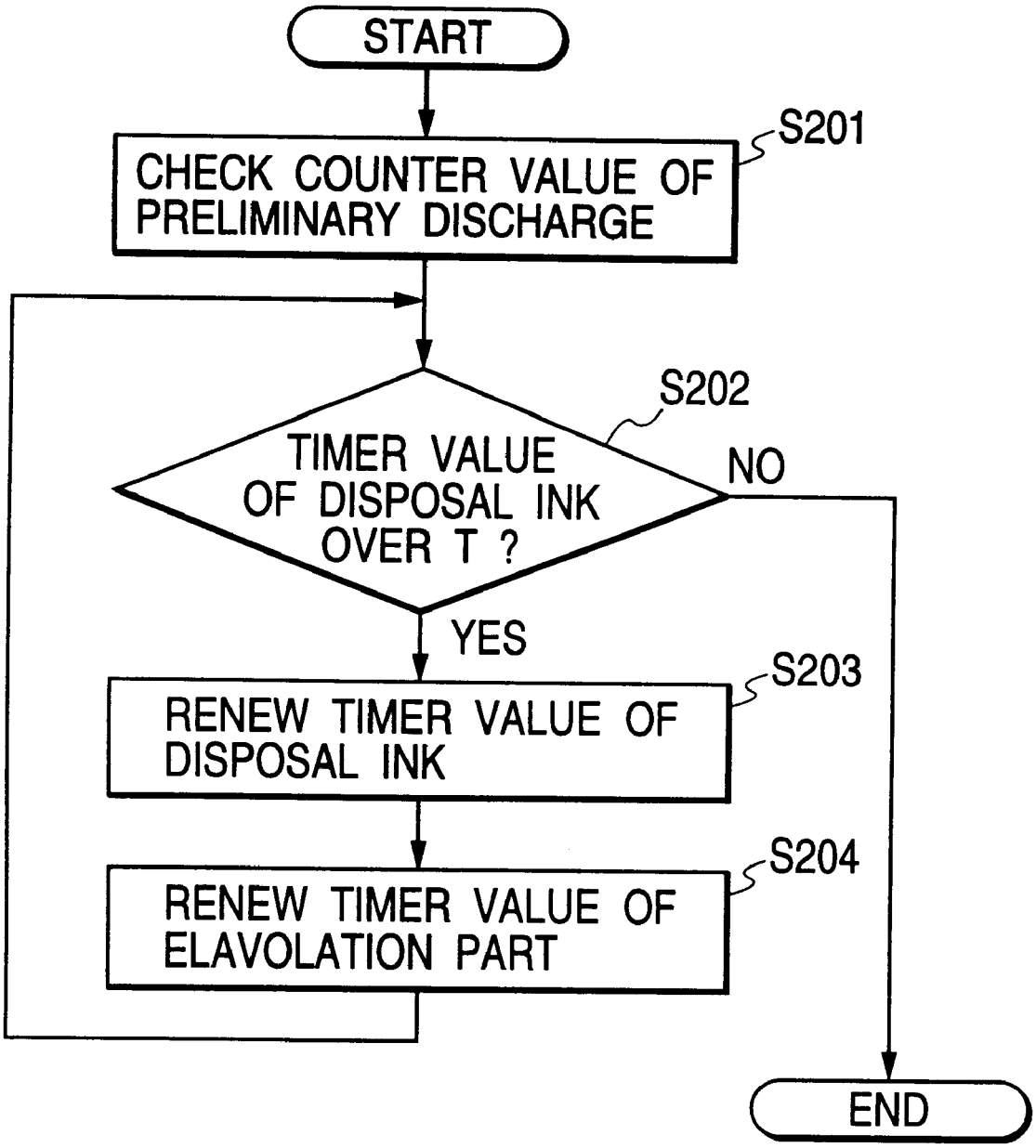
FIG. 53 is a flowchart for calculation of an amount of evaporation of disposal ink.

FIG. 53 shows a flowchart for disposal ink evaporation amount calculation in the recording apparatus. When the power source of the apparatus is turned ON or when the apparatus is reset or when the recovery operation is desired to be performed, in a step S202, it is judged whether the value of the disposal ink timer exceeds a predetermined time T, and, in a step S203, the value of the disposal ink timer is renewed to a value obtained by subtracting by the predetermined time T. Further, in a step S204, a value of the evaporation part counter obtained by subtracting an ink amount which is assumed to be evaporated within the predetermined time is calculated. Then, the program is returned to the step S202 again, and the sequence is repeated. Thereafter, an amount of disposal ink to be discharged by the operation which is now desired to be performed is calculated by the above-mentioned sequence, and a new total amount of the disposal ink is calculated.

The calculation of the amount of the ink which is assumed to be evaporated within the predetermined time utilizes the following equation:

(Evaporation ink amount per predetermined time T) =k1×(evaporation part counter value/non-evaporation part counter value).

Figure 54:
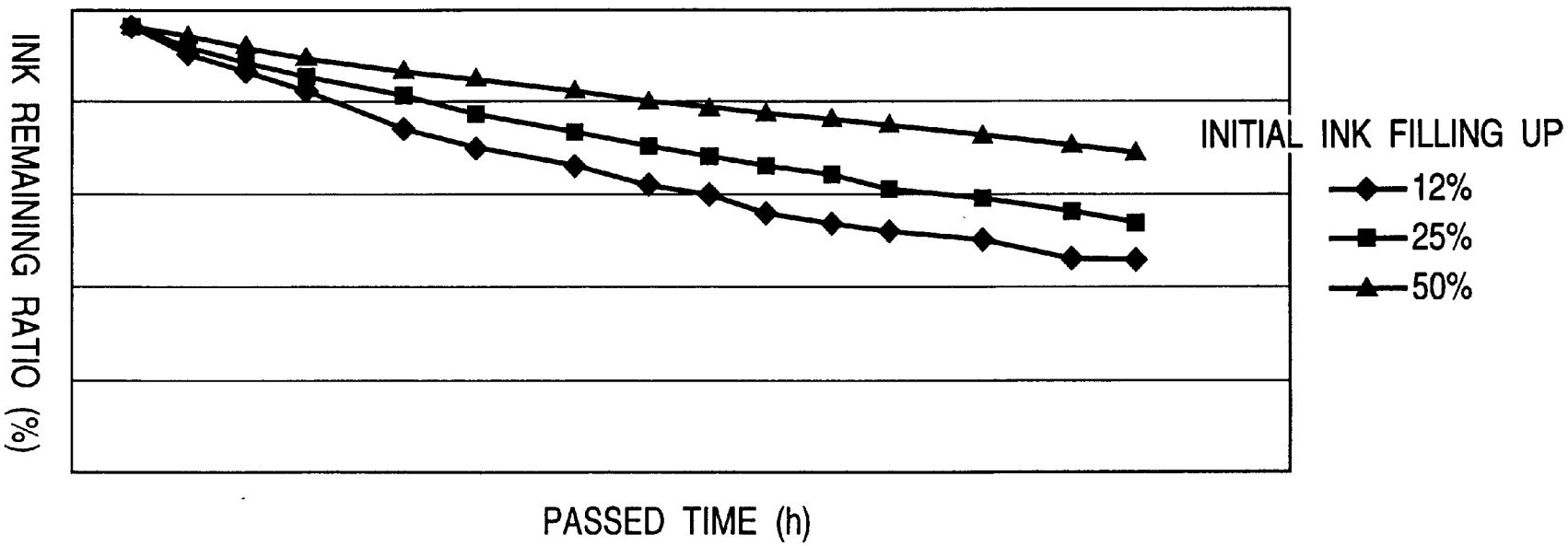
FIGS. 54 and 55 are graphs showing evaporation property of disposal ink.

Thus, the value of the evaporation part counter after the predetermined time is elapsed is represented as follows:

evaporation part counter value=evaporation part counter value×(1−k1/non-evaporation part counter value)

where, k1 is evaporation coefficient determined in FIGS. 54 and 55 which show evaporation feature (sought by tests) of the ink and the disposal ink absorbing body 327 used in the recording apparatus.

FIG. 54 shows ink remaining ratios (ratios by weight) when ink of 50%, 25% and 12% regarding the ink amount of about 84 grams which can be contained within the disposal ink absorbing body 327 is loaded and leaves as it is.

FIG. 55 shows a relation between an evaporation ink amount per predetermined time T and a ratio (ink remaining ratio of evaporation part) between the amount of non-evaporation part ink which is assumed not to be evaporated in the feature and the amount of evaporation part ink which is assumed to be evaporated as time goes on (occupying a predetermined ratio of the amount of loaded ink). The above-mentioned evaporation ink amount calculation equation is sought by closely resembling the above curves to a straight line having inclination of k1.

Incidentally, the amount of ink discharged to the disposal ink absorbing body 327 may be directly measured by using a weight meter or a flowmeter.

If the total amount of the disposal ink calculated by the above sequence exceeds a predetermined disposal ink alarming amount, such fact is informed to the operator by a buzzer or a flush lamp on the control substrate plate 57. However, when such a warning condition is removed by the operator, the recording apparatus can be used again. If the total amount of the disposal ink is decreased as the time goes on to be reduced below the above-mentioned disposal ink alarming amount, the information to the operator is stopped, and the apparatus can be used in the normal condition.

Further, if the total amount of the disposal ink is increased to exceed a predetermined disposal ink error amount, such fact is informed to the operator by a buzzer or a flush lamp on the control substrate plate 57. However, if the total amount of the disposal ink is decreased as the time goes on to be reduced below the above-mentioned disposal ink error amount, similar to the disposal ink alarming, when such an error condition is removed by the operator, the recording apparatus can be used again. Further, if the total amount of the disposal ink is decreased as the time goes on to be reduced below the above-mentioned disposal ink alarming amount, the information to the operator is stopped, and the apparatus can be used in the normal condition.

With the arrangement as mentioned above, by detecting the amount of the disposal ink contained within the disposal ink absorbing body 327 with high accuracy, leakage of the disposal ink during the transportation can be prevented without increasing the volume of the apparatus. Further, since the memory areas required for the detection are minimized, the capacity of the EEPROM 509 is not required to be increased, thereby preventing the volume of the apparatus from increasing and the apparatus from being expensive.

[Head Mounting Portion]

Now, a mountable head will be explained. In the above-mentioned explanation, while an example that the recording head cartridge 1 is detachably mounted on the carrier 2 of the recording apparatus was explained, this will be further described with reference to FIGS. 17 to 20.

Figure 18:
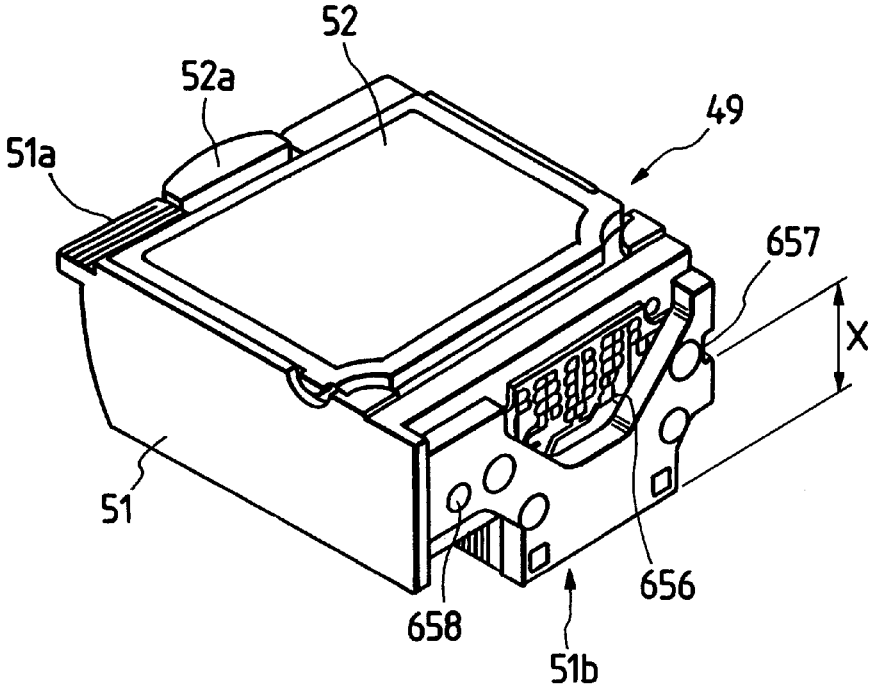
FIG. 18 is a perspective view of a monochromatic recording head.
Figure 19:
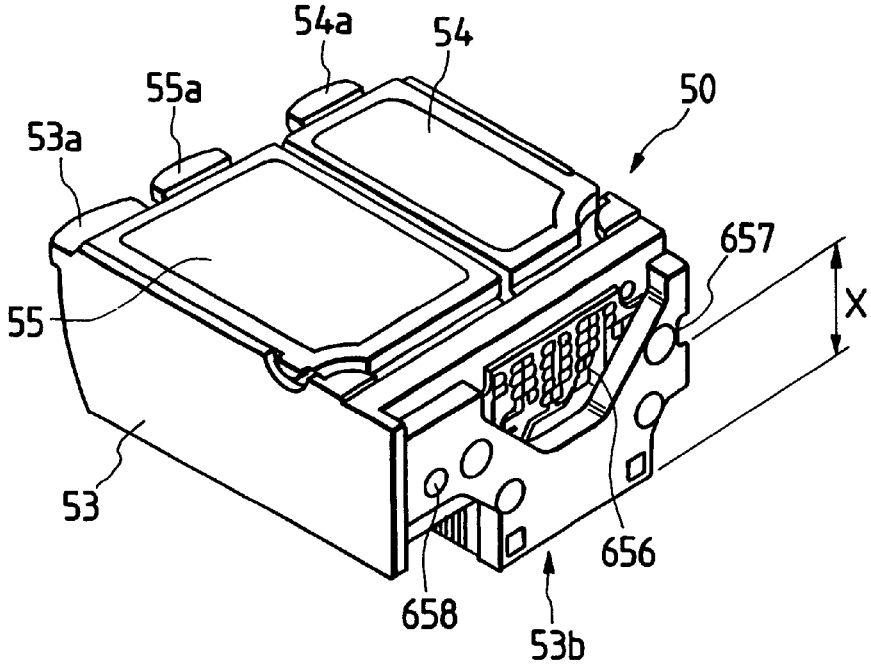
FIG. 19 is a perspective view of a color recording head.
Figure 20:
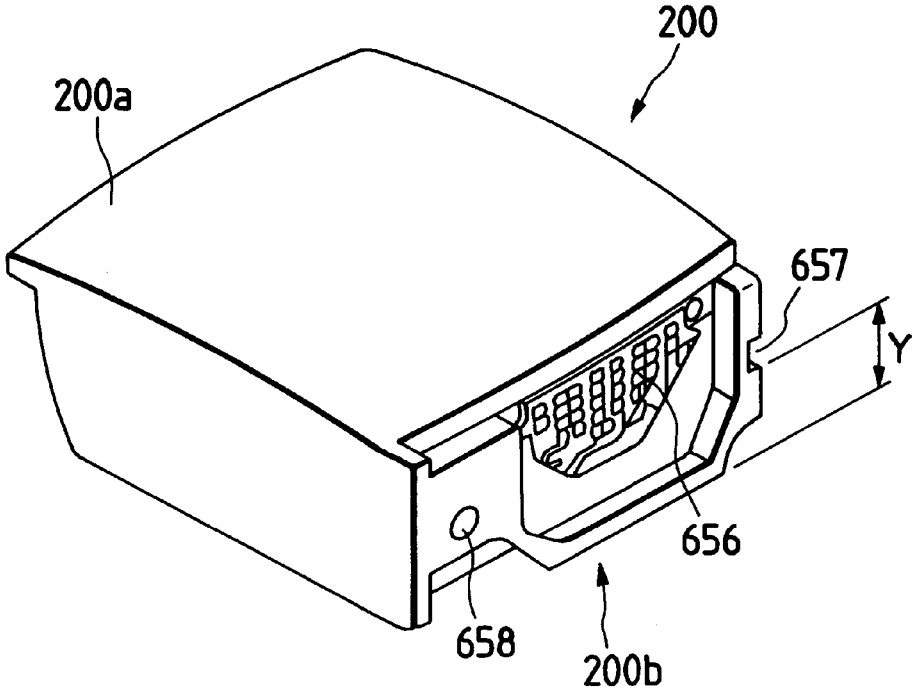
FIGS. 20 and 21 are perspective views of a scanner head.

There are two kinds of recording head cartridge 1, i.e., a monochromatic recording head portion 49 shown in FIG. 18 and a color recording head portion 50 shown in FIG. 19, and further, a scanner head 200 capable of reading an original inserted in place of the sheet as shown in FIG. 20 is also provided. Any one of these three kinds of head portions can be mounted on the carrier 2. Hereinafter, three kinds of monochromatic recording head portion 49, color recording head portion 50 and scanner head 200 are generically referred to as "head portion".

Figure 17:
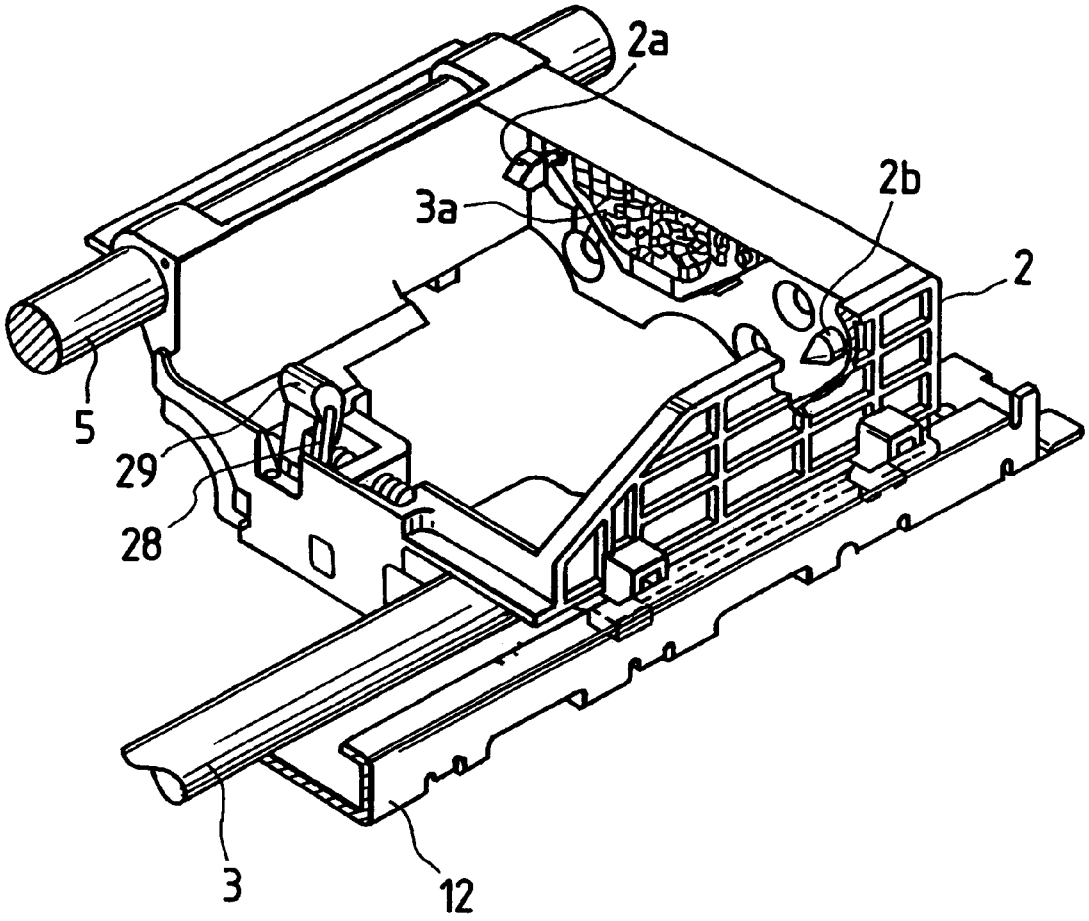
FIG. 17 is a perspective view of a carrier.

First of all, a method in which the three kinds of head portions are mounted will be explained with reference to FIG. 17. FIG. 17 is a perspective view of the carrier 2 on which the head portion (recording head cartridge 1) shown in FIG. 3 is not mounted. A cable terminal portion 3*a* of the flexible cable 3 is provided at one end of the carrier 2. When one of the monochromatic recording head portion 49, color recording head portion 50 and scanner head 200 is mounted on the carrier 2, the cable terminal portion 3*a* is contacted with a head terminal portion 656 of each head portion (FIGS. 18, 19 and 20) to electrical connection therebetween.

Two head portion positioning projections 2*a*, 2*b* are integrally formed on a surface of the carrier 2 on which the cable terminal portion 3*a* is provided. When the head portion is mounted to the carrier 2, the head portion positioning projection 2*a* is fitted in a positioning notch 657 of the head portion and the head portion positioning projection 2*b* is fitted in a positioning hole 658 of the head portion, thereby correctly positioning the head portion with respect to the carrier 2.

Further, a contact spring 28 is provided on the cable at a position opposed to the cable terminal portion 3*a*, and a resin-molded head guide 29 is mounted on a tip end of the contact spring. That is to say, the head guide 29 is elastically supported by the carrier 2.

In a condition that the head portion is mounted on the carrier 2, by biasing the head portion toward the cable terminal portion 3*a* by means of the head guide 29, the cable terminal portion 3*a* and the head terminal are electrically interconnected. When the head portion is exchanged, the head guide 29 is flexed, thereby permitting mounting and dismounting of the head portion, and the head guide serves to hold the head portion not to be disengaged upwardly.

When the operator exchanges the head portion, the head terminal portion 656 of the head portion is inserted into the cable terminal portion 3*a* of the carrier 2, and, by pushing the upper surface of the head portion downwardly, the head guide 29 is flexed, thereby completing the mounting of the head portion. In this case, the electrical connection is also completed. When the head portion is dismounted, by pulling a head portion mounting and dismounting operation portion 51*a*, 53*a* or 200*a* upwardly by the operator's finger, the head guide 29 is flexed, thereby permitting the dismounting of the head portion.

[Head Portion]

Next, head portions will be explained with reference to FIGS. 18, 19 and 20. FIG. 18 is a perspective view of the monochromatic recording head 49 for effecting mono-color (normally, black) printing alone. In FIG. 18, a discharge opening surface 51*b* having nozzles for discharging recording ink is formed on a front side of a monochromatic recording head cartridge 51. Further, the monochromatic recording head cartridge 51 has the head terminal portion 656 for receiving an electric signal. When the electric signal is supplied from the recording apparatus portion (not shown) to the monochromatic recording head cartridge 51 through the head terminal portion 656, the ink is discharged from the nozzle provided in the discharge opening surface 51*b* downwardly (FIG. 18), thereby effecting the recording. The positioning notch 657 and the positioning hole 658 are provided for fitting onto the head portion positioning projections 2*a*, 2*b* provided on the carrier 2 to positively position the head portion with respect to the carrier 2. The ink is contained in a monochromatic ink tank 52.

The monochromatic ink tank 52 is detachably fixed to the monochromatic recording head cartridge 51 by an elastic latch portion 52*a* integrally formed with the monochromatic ink tank 52. An ink flow passage defined by a detachable joint portion (not shown) is formed between the monochromatic ink tank 52 and the monochromatic recording head cartridge 51. Accordingly, when the ink is consumed by the recording and the ink in the monochromatic ink tank 52 is used up, the monochromatic ink tank 52 is removed from the monochromatic recording head cartridge 51 and a new monochromatic ink tank 52 is mounted to the monochromatic recording head cartridge 51. In this way, the recording can be continued.

FIG. 19 is a perspective view of the color recording head portion 50 for effecting the color recording. Only the difference from the monochromatic recording head portion 49 will be described. Four kinds of independent nozzle groups (not shown) for discharging yellow color ink, magenta color ink, cyan color ink and black color ink to effect the color recording are provided in a discharge opening surface 653*b* of a color recording head cartridge 53. A black ink tank 54 contains the black ink therein and is connected to the nozzle group for black ink provided in the discharge opening surface 653*b* through a detachable joint portion (not shown). Interior of a color ink tank 55 is divided into three chambers within which the yellow ink, magenta ink and cyan ink are contained, respectively. Similar to the black ink tank 54, the yellow ink chamber, magenta ink chamber and cyan ink chamber of the color ink tank 55 are connected to the nozzle group for yellow ink, nozzle group for magenta ink and nozzle group for cyan ink through three independent detachable joint portions (not shown). The black ink tank 54 has a latch portion 54*a* for exchange of the tank, and the color ink tank 55 has a latch portion 55*a* for exchange of the tank.

As mentioned above, by mounting the color recording head portion 50 to the recording apparatus portion 401, color recording can be performed, and, when the black ink is used up, the black ink tank 54 alone can be exchanged, and, when one or all of the yellow ink, magenta ink and cyan ink are used up, the color ink tank 55 alone can be exchanged.

FIG. 20 is a perspective view of the scanner head 200 which will be described later. In FIGS. 18 and 19, "X" indicates a distance from the positioning notch 657 to the discharge opening surface 651*b* or 653*b*. In the monochromatic recording head cartridge 51 and the color recording head cartridge 53, such distances X are the same, and, in the illustrated embodiment, the distance is selected to about 13 mm. To the contrary, in the scanner head 200, "Y" indicates a distance from the positioning notch 657 to a reading surface 200*b*, which distance is set to be smaller than the distance X, and, in the illustrated embodiment, the distance Y is selected to about 9 mm. From the value of the distance Y, a difference between the position of the discharge opening surface and the reading surface in the vertical direction becomes 4 mm (difference between 13 mm and 9 mm). Thus, even when the scanner head 200 is mounted, even when the capping operation and the wiping operation are effected, the cap and the blade are not contacted with the reading surface 200*b* of the scanner head 200. With this arrangement, when the scanner head 200 is mounted, the reading surface 200*b* is not contaminated by the cap 301 and the blade to which the ink is adhered.

[Scanner Portion]

Figure 21:
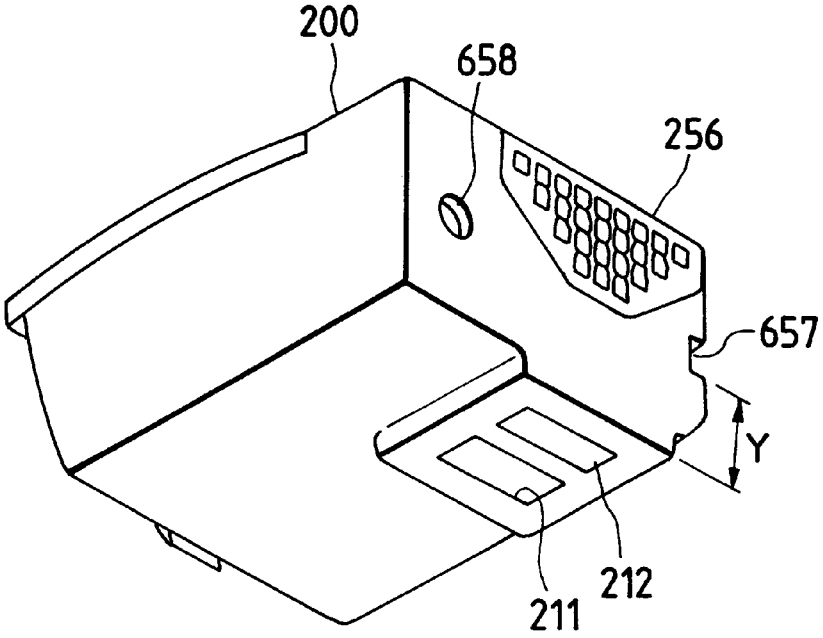
Figure 22:
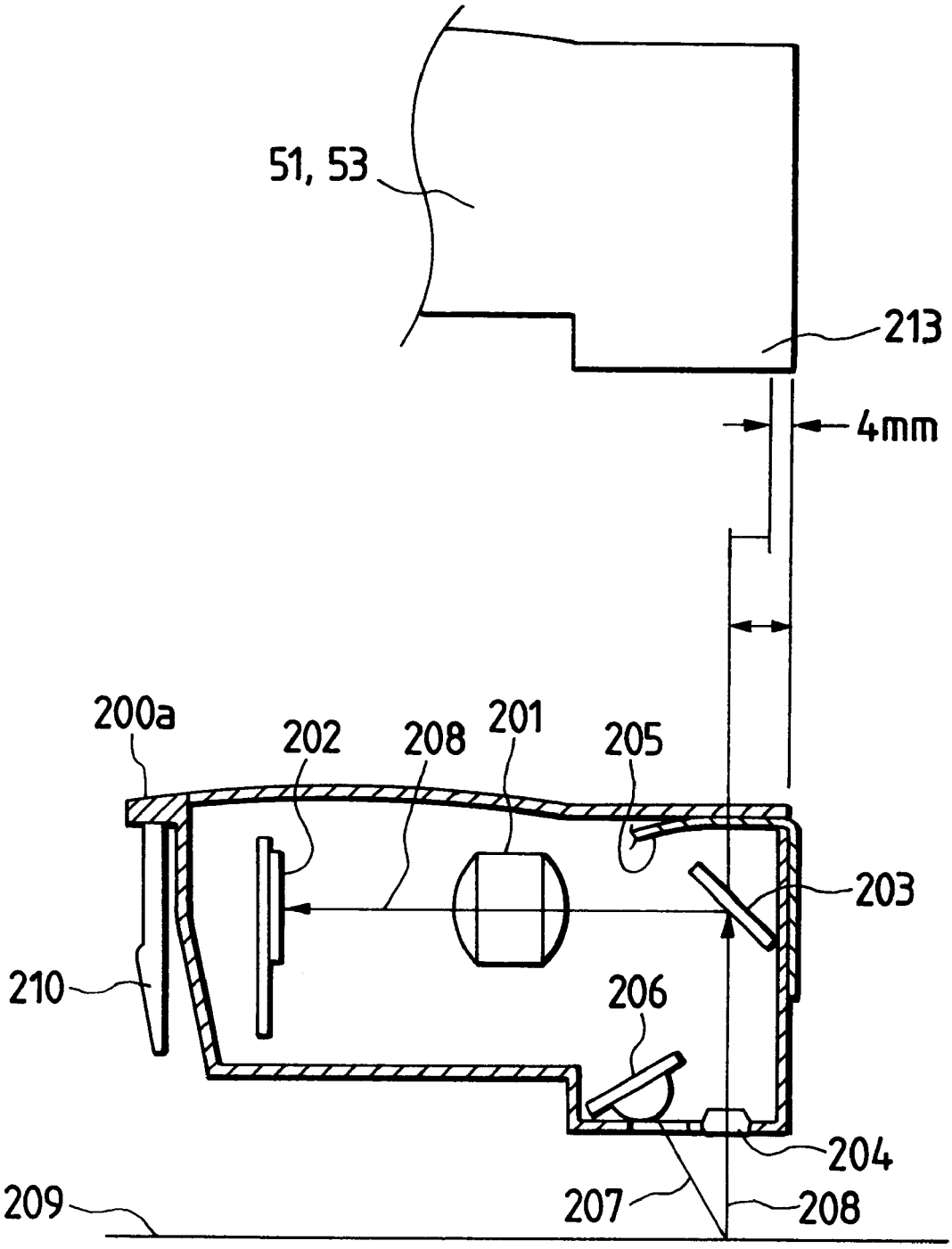
FIG. 22 is a sectional side view of the scanner head.

Next, the scanner portion which is one of characteristics of the recording apparatus according to the illustrated embodiment will be explained. FIGS. 21 and 22 are schematic sectional view and a perspective view showing the scanner head 200, respectively. LED light 207 emitted from an LED 206 for illuminating a surface 209 of an original is illuminated onto the original surface 209 through an LED opening 211. Image light 208 from the original surface 209 passes through a field lens 204 provided in a sensor opening 212 and is deflected at a right angle by a mirror 203 and passes through a focusing lens 201 to be focused on a sensor 202.

The center of the sensor opening 212 is greater than a distance between the ink discharge opening 213 of the monochromatic recording cartridge 51 and the color recording cartridge 53 and the surface at which the recording head cartridge abuts against the carrier 2 for positioning, and, in the illustrated embodiment, it is deviated by about 4 mm. The LED 206 and the sensor 202 are electrically connected and are drawn outside through a wiring substrate 205. An electrode formed on a head terminal portion 256 of the wiring substrate 205 is contacted with an electrode (not shown) of the carrier 2 to direct a signal to a control circuit of the apparatus.

The scanner head 200 has an outer configuration same as a configuration when the ink tank 8 is mounted to the recording head cartridge 1 and can be mounted to the carrier 2 by a latching action of a pawl 210 (a part of an outer wall), similar to the recording head cartridge 1. When the scanner head is dismounted, by lifting the head portion mounting and dismounting operation portion 200*a* to unlatch the pawl 210, the scanner head can easily be dismounted.

When the scanner head 200 is mounted to the carrier 2, an AISIC (CPU) 500 (FIG. 16) which will described later automatically discriminates the scanner to provide a scanner mode. When a scanner reading signal is inputted to the AISIC 500 from a host computer, similar to a recording sheet 22, the original to be read is conveyed to a predetermined position by the sheet feeding motor 23. After the LED 206 is turned ON, the image signal is read through a scanner driver 513 while driving the carrier motor 10.

In this case, the driving speed of the carrier motor 10 can be changed in dependence upon the original reading mode of the scanner head 200. The mode is a combination of a reading resolving power and gradation of read values. Since the resolving power of the scanner head 200 in the sheet supplying direction (main scan direction) is 360 dpi and the resolving power of the sensor 202 of the scanner head 200 in the scan direction of the carrier 2 (sub-scan direction) is 360 dpi, output having 64 gradations can be obtained. Thus, for example, the scanner head 200 can perform the reading with 64 gradations including resolving powers of 360 dpi in the main scan direction and 360 dpi in the sub-scan direction through the reading with 2 gradations including resolving powers of 90 dpi in the main scan direction and 90 dpi in the sub-scan direction. Further, there is a mode in which the reading with the resolving power of 200 dpi in the main scan direction is effected in consideration of registration with a facsimile.

In the mode having a large amount of data such as the reading with 64 gradations including resolving powers of 360 dpi in the main scan direction and 360 dpi in the sub-scan direction, since it takes a long time to perform data treatment and transfer, the driving speed of the carrier is delayed; whereas, in the reading with 2 gradations including resolving powers of 90 dpi in the main scan direction and 90 dpi in the sub-scan direction, the driving speed of the carrier is increased. After one-line reading is finished, one-line conveyance is effected by the sheet feeding motor 23, and, then, next one-line reading is effected. These operations are repeated until the reading of the original is completed.

As mentioned above, in the recording apparatus according to the illustrated embodiment, both the recording on the sheet 22 by using the recording head cartridge 1 and the reading of the original by using the scanner head 200 can be performed. Thus, in this specification, the term "recording sheet" also includes the original, except for explanation regarding the recording alone.

[Circuit Portion]

Figure 16:
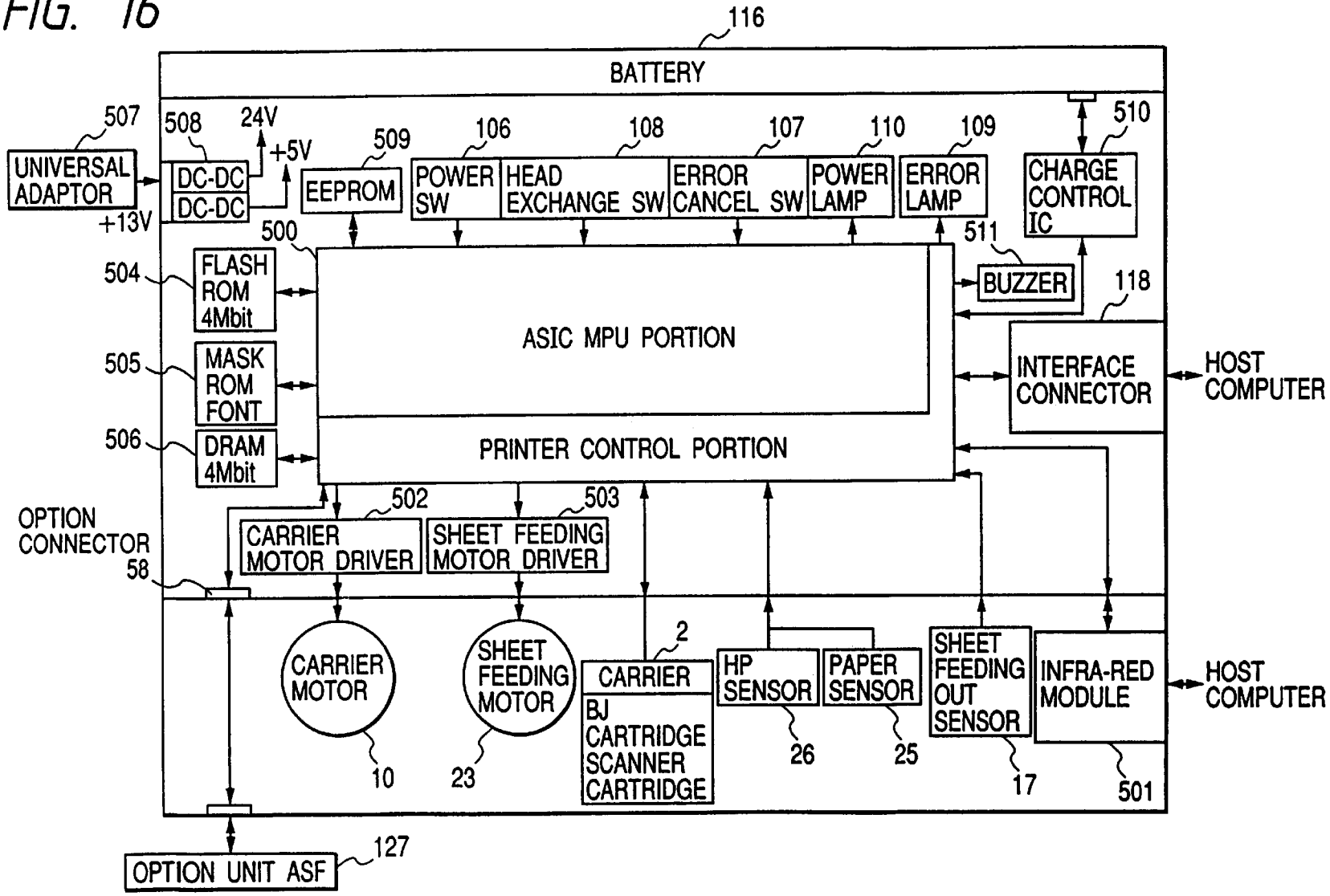
FIG. 16 is a circuit block diagram of the recording apparatus.

FIG. 16 shows an electrical block diagram of the recording apparatus. The reference numeral 500 denotes ASIC in which an MPU and a controller of the recording apparatus are integrally formed. The reference numeral 504 a flash ROM storing a program for controlling the entire recording apparatus; 505 denotes a mask ROM storing character fonts and the like; 506 denotes a DRAM used as a work area of the ASIC 500 and a signal buffer.

The EEPROM 509 is constituted by re-writable ROM, so that the contents in the ROM is not erased even when the power is not supplied to the ROM. Thus, in this EEPROM, information regarding setting performed by the operator after the power source is turned ON, used ink amount and calculated disposal ink amount remaining in the recording apparatus and the like are stored.

DC-DC converters 508 serve to convert voltage from an adaptor 507 into power source voltage used in the recording apparatus. The adaptor 507 is a transformer for converting domestic AC voltage of 100 V into DC voltage of 13 V.

The recording apparatus includes a battery 116 therein for permitting the use of the apparatus outdoors. Further, since the recording apparatus includes a battery charge TC 510 therein, the apparatus can be re-charged without an additional charger.

The reference numeral 502 denotes a carrier motor driver for driving the carrier 2; 503 denotes a sheet feeding motor driver for driving the sheet feeding roller 6. The carrier motor driver 502 and the sheet feeding motor driver 503 control the motors on the basis of control signals outputted from the AISIC 500.

The reference numeral 106 denotes a power source switch for turning ON and OFF the power source; 108 denotes a head exchange switch for shifting the carrier 2 to an exchange position; 107 denotes an error cancel (release) switch; 110 denotes a power lamp; 109 denotes an error lamp; and 511 denotes a buzzer.

Signal communication with respect to the external host computer is effected through an interface connector 118 and an infrared ray module 501. The interface connector is a wire connected to the host computer. The infrared ray module 501 is a serial communication port for infrared ray aligned with an infrared ray port of the host computer to effect infrared signal communication therebetween.

Further, an option connector 58 is prepared for effecting communication to an option ASF 127. The home position sensor 26 is of photo-interrupter type for detecting the position of the carrier 2 by sensing the edge of the carrier 2. The sheet sensor 25 and the discharge sheet sensor 17 are of contact type for detecting the presence/absence of the recording sheet in the recording apparatus.

In the illustrated embodiment, while an example that the openable tray (sheet supply tray 111) is provided at the sheet supply opening 121 was explained, an openable tray also acting as a sheet discharge tray may be provided at the sheet discharge opening 122. In this case, when the trays are formed as beams, the rigidity of the recording apparatus can be enhanced.

Further, as the openable tray, there may be provided an engagement portion directly engaged by the sheet supply opening or the sheet discharge opening 122. In this case, by inserting the engagement portion of the tray into the opening portion of the sheet supply path, the closed condition of the tray can be maintained.

Further, in the illustrated embodiment, while an example that the ink jet recording head is used as the recording means was explained, the recording system is not limited to the ink jet type, but, other type such as wire dot type or heat-transfer type may be used.

In addition, the present invention is not limited to the recording apparatus, but, the present invention can be applied to image reading apparatuses or various sheet conveying apparatuses.

What is claimed is:

1. A recording apparatus for recording an image on a sheet material by a recording head, comprising:

head mounting means for mounting said recording head;

a convey path for conveying a sheet material;

a first case and a second case opposed to each other with an interposition of said convey path and defining a box-shaped outer case;

a sheet feeding opening for feeding the sheet material to said convey path, said sheet feeding opening including said first case and second case;

a discharging opening for discharging the sheet material from said convey path, said discharging opening including said first case and said second case and said discharging opening being disposed at a side opposite to said sheet feeding opening with respect to said head mounting means as a center; and a lid member for closing one of said feeding opening and said discharging opening, said lid member being capable of positioning selectively at a first position where a positional relation between said first case and said second case is maintained by engaging with engaging portions provided on said first case and said second case, respectively, and a second position where said lid member does not engage with at least one of said first case and said second case.

2. A recording apparatus according to claim 1, wherein said convey path is disposed substantially horizontally, and said outer case has a left-and-right direction dimension and a front-and-rear direction dimension greater than a height direction dimension, looked at from at a side of one of said feeding opening and said discharge opening.

3. A recording apparatus according to claim 2, wherein the height direction dimension of said outer case is 60 mm or less.

4. A recording apparatus according to claim 1, wherein said lid member closes said opening at said first position and opens said opening at said second position.

5. A recording apparatus according to claim 4, wherein a height direction rigidity of said outer case is increased by fitting an outer periphery of said lid member inside of said outer case along a peripheral portion of said opening at said first position.

6. A recording apparatus according to claim 4, wherein said lid member located at said second position also acts as a convey guide for forming a part of said convey path and for guiding the sheet material.

7. A recording apparatus according to claim 1, wherein said lid member is rotatably attached to one of said first case and second case, and said lid member is engaged by an engagement portion provided on a peripheral edge of said opening of the other of said first case and said second case.

8. A recording apparatus according to claim 1, further comprising a sheet material conveying means for conveying the sheet material along said convey path, wherein a battery for driving said sheet material conveying means and said recording means can be housed within said outer case.

* * * * *

UNITED STATES PATENT AND TRADEMARK OFFICE

CERTIFICATE OF CORRECTION

PATENT NO. : 6,382,858 B1 
DATED : May 7, 2002
INVENTOR(S) : Takashi Nojima et al.

It is certified that error appears in the above-identified patent and that said Letters Patent is hereby corrected as shown below:

Drawings,
Sheet 36, “EVAPOLATION” (both occurrences) should read -- EVAPORATION --; and “NON-EVAPOLATION” should read -- NON-EVAPORATION --.
Sheet 37, “EVAVOLATION” should read -- EVAPORATION --.
Sheet 39, “EVAPOLATION” (three occurrences) should read -- EVAPORATION -- and “NON-EVAPOLATION” should read -- NON-EVAPORATION --.

Column 1,
Line 40, “portable ability” should read -- portability --.

Column 2,
Line 21, “less” should read -- much --; and “strong” should read -- resistant --; and
Line 24, “portable ability.” should read -- portability. --.

Column 3,
Line 61, “teeth,” should read -- tooth, --.

Column 6,
Line 20, "11a" should read -- 111a --; and
Line 47, "tray" should read -- tray 111 --.

Column 7,
Line 7, "portable ability" should read -- portability --; and
Line 58, "Jammed" should read -- jammed --.

Column 8,
Line 40, "indicating" should read -- indicates --; and
Line 63, "having" should read -- preferably has --.

Column 9,
Line 20, "re-cording" should read -- recording --;
Line 52, "portability." should read -- portability. ¶ [Entire internal construction] --; and
Line 53, "view" should read -- views --.

Column 10,
Line 22, “in synchronous” should read -- synchronously --.

Column 11,
Line 57, “may” should read -- may be --.

UNITED STATES PATENT AND TRADEMARK OFFICE

CERTIFICATE OF CORRECTION

PATENT NO. : 6,382,858 B1
DATED : May 7, 2002
INVENTOR(S) : Takashi Nojima et al.

It is certified that error appears in the above-identified patent and that said Letters Patent is hereby corrected as shown below:

Column 12,
Line 61, “driving” should read -- driven --.

Column 13,
Line 21, "the greater wall of the pipe more the" should read -- a thicker pipe wall is needed to ensure that the --; and
Line 52, "aliminium" should read -- aluminum --.

Column 14,
Line 9, “rollers” should read -- rollers 15 --.

Column 15,
Line 5, "semi-conductor" should read -- semiconductor --;
Line 32, "in coaxial" should read -- in a coaxial relation --; and
Line 60, "in coaxial" should read -- coaxially --.

Column 16,
Line 22, "32b." should read -- 32b. Incidentally, the pitch angle means an angle of a space (pitch) between adjacent teeth with respect to a center of the gear. --; and
Line 40, "are" should read -- is --.

Column 18,
Line 58, “uncappling” should read -- uncapping --.

Column 19,
Line 64, “suctio nopening” should read -- suction opening --.

Column 20,
Line 48, “t he” should read -- the --; and
Line 55, “a front side” should read -- the front side --.

Column 21,
Line 16, “from the” should read -- from --; and
Line 49, “with” should read -- with reference to FIGS. 45 and 47. --.

Column 22,
Line 24, “4a:” should read -- 4a: ¶ 370 g × (370i/370h)>4b --.

Column 24,
Line 61, “flush” should read -- flash --.

UNITED STATES PATENT AND TRADEMARK OFFICE

CERTIFICATE OF CORRECTION

PATENT NO. : 6,382,858 B1 
DATED : May 7, 2002
INVENTOR(S) : Takashi Nojima et al.

It is certified that error appears in the above-identified patent and that said Letters Patent is hereby corrected as shown below:

Column 25,
Line 3, “flush” should read -- flash --.

Column 28,
Line 47, “504” should read -- 504 denotes --; and
Line 53, “is” should read -- are --.

Signed and Sealed this

First Day of April, 2003

JAMES E. ROGAN
*Director of the United States Patent and Trademark Office*